US007115359B2

(12) United States Patent
Usagawa et al.

(10) Patent No.: US 7,115,359 B2
(45) Date of Patent: Oct. 3, 2006

(54) PHOTOTHERMOGRAPHIC MATERIAL

(75) Inventors: Yasushi Usagawa, Hino (JP); Takeshi Habu, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 10/893,504

(22) Filed: Jul. 15, 2004

(65) Prior Publication Data

US 2005/0037298 A1 Feb. 17, 2005

(30) Foreign Application Priority Data

Jul. 25, 2003 (JP) ..... 2003-201439

(51) Int. Cl.
*G03C 1/498* (2006.01)
*G03C 1/34* (2006.01)
*G03C 1/494* (2006.01)

(52) U.S. Cl. ..... 430/619; 430/224; 430/243; 430/264; 430/529; 430/598; 430/600; 430/603; 430/607; 430/613; 430/620; 430/629

(58) Field of Classification Search ..... 430/619, 430/264, 598, 620, 631, 629, 600, 603, 607, 430/613, 618, 529, 224, 243
See application file for complete search history.

(56) References Cited

U.S. PATENT DOCUMENTS

| | | | | |
|---|---|---|---|---|
| 6,413,712 | B1 * | 7/2002 | Yoshioka et al. | 430/619 |
| 2004/0005521 | A1 * | 1/2004 | Kudo | 430/527 |

FOREIGN PATENT DOCUMENTS

| | | | |
|---|---|---|---|
| EP | 0 370 404 A2 | | 5/1990 |
| EP | 1 048 975 A1 | | 11/2000 |
| EP | 1 134 611 A2 | | 9/2001 |
| JP | 11 231460 | | 8/1999 |
| JP | 11-231460 | * | 8/1999 |
| JP | 2003-005323 | * | 1/2003 |
| JP | 2003 005323 A | | 1/2003 |

* cited by examiner

*Primary Examiner*—Thorl Chea
(74) *Attorney, Agent, or Firm*—Lucas & Mercanti, LLP

(57) ABSTRACT

A photothermographic material having a support provided on at least one side of the support light-sensitive silver halide particles, an organic silver salt and a reducing agent, as well as a leuco dye of a specific structure and a compound of a specific structure.

17 Claims, No Drawings

PHOTOTHERMOGRAPHIC MATERIAL

TECHNICAL FIELD

The present invention relates to a thermally developable light-sensitive material (or is called as a photothermographic material) which forms an image by heat development, and particularly to a thermally developable light-sensitive material exhibiting high sensitivity, low fog, as well as excellent image lasting quality after development.

BACKGROUND

In recent years, photothermographic materials, which provides no effluent resulting from wet type processing, have been strongly desired in the medical and printing fields with respect to environmental protection and workability, and, in particular, photothermographic materials for use in photographic techniques which can form clear black images at high resolution by heat development have been brought into the market and rapidly prevailing. Since these photothermographic materials are generally developed at a temperature of not lower than 80° C., they are called as photothermographic materials to be distinguished from conventional light-sensitive materials which are developed with a liquid developer at a temperature of 25–45° C.

Thermally developable light-sensitive materials of this type are conventionally constituted of a light-sensitive layer which contains high sensitive silver halide grains spectrally sensitized with dyes, organic silver salts and reducing agents; an anti-irradiation layer (AI layer) to prevent light scattering of light, which is irradiated on said light-sensitive layer, passed through said layer without having been absorbed and reflected randomly at the boundary of a support, an intermediate layer and an adhesive layer; or a back-coating layer (BC layer) provided on the opposite side of the support; as well as are provided with a protective layer on the light-sensitive layer and BC layer to prevent abrasion marks during handling.

Thermally developable light-sensitive materials are generally characterized by simple processing because images are formed only by heat development after exposure, however, it is important to improve image lasting quality after development because of no fixing process being provided. To improve the image lasting quality, it is preferable to develop at a high temperature to form images, however, fogging is liable to be generated and the sensitivity is decreased when the developing temperature is too high. Therefore, they are generally developed at the vicinity of 120±10° C.

As an anti-fogging agent, to utilize specific propenenitrile compounds is disclosed in patent literature 1, and to utilize specific alkene compounds is disclosed in patent literatures 2 and 3.

Further, as an anti-fogging agent or an image lasting quality improving agent, to utilize specific blocked nitrogen-containing heterocyclic derivatives are disclosed in patent literatures 4–7.

However, these compounds were still insufficient with respect to the image lasting quality after heat development.

Further, as a leuco dye, to utilize specific bisphenol compounds is disclosed in patent literature 8, and to utilize specific coupler leuco dyes is disclosed in patent literature 9, however, these compounds were still insufficient with respect to the image lasting quality after heat development.

Herein, the image lasting quality after heat development refers to heat resistance (prevention of fog increase) and light fastness (prevention of the maximum density decrease and silver tone change) after heat development.

Polyhalomethane compounds have been proposed as an anti-fogging agent for thermally developable materials because they can decrease fog by releasing a halogen radial by heat or light excitation. For example, U.S. Pat. Nos. 3,874,946, 4,452,885, 4,546,075, 4,756,999 and 5,340,712; Japanese Patent Publication No. 54-165; JP-A Nos. 50-137126, 7-2781 and 9-265150 (hereinafter, JP-A refers to Japanese Patent Publication Open to Public Inspection); and Japanese Patent Publication No. 2-32614 are listed.

There are proposed that variety of chemical structures as groups to be bonded to the polyhalomethane group to enhance the releasing efficiency of a halogen, however, it cannot be said that sufficient ability has been achieved. That is, because sensitivity is often decreased when the releasing efficiency of a halogen radical is high, and fog is hardly depressed when the releasing efficiency of a halogen radical is low, resulting in difficulty of improving image lasting quality.

[Patent Literature 1] Japanese Translated PCT Patent Publication No. 2000-515995

[Patent Literature 2] JP-A No. 2002-207273

[Patent Literature 3] JP-A No. 2003-140298

[Patent Literature 4] JP-A No. 2000-330235

[Patent Literature 5] JP-A No. 2002-236335

[Patent Literature 6] JP-A No. 2002-258442

[Patent Literature 7] JP-A No. 2003-5323

[Patent Literature 8] JP-A No. 2002-169249

[Patent Literature 9] JP-A No. 11-231460

SUMMARY

An object of the invention is to provide a thermally developable light-sensitive material (hereafter, it is also referred to a photothermographic material) exhibiting high sensitivity, low fog, and excellent image lasting quality after heat development.

An embodiment of the invention includes a photothermographic material having a support provided on at least one side of the support light-sensitive silver halide particles, an organic silver salt and a reducing agent, as well as a leuco dye of a specific structure and a compound of a specific structure.

DESCRIPTION OF PREFERRED EMBODIMENTS

The preferred embodiments of the present invention include as below.

1. A photothermographic material containing a support having at least on one side of the support:
   photosensitive silver halide particles;
   an organic silver salt;
   a reducing agent for silver ions;
   a leuco dye represented by General Formula (1); and
   a stabilizing compound represented by General Formula (2), (3) or (4):

General Formula (1)

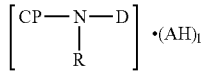

wherein CP represents a coupler group; —N(R)D represents a developer group, R represents a hydrogen atom or a blocking group and D represents a hydrogen atom or a substituent; AH represents an acid; and l represents an integer of 0 to 5, General Formula (2)

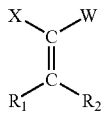

wherein, X represents an electron withdrawing group; W represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, a N-sulfonylimino group, an ammonium group, a sulfonium group, a phosphonium group, a pyrylium group or an immonium group; $R_1$ represents a hydroxyl group or a salt thereof; and $R_2$ represents an alkyl group, an alkenyl group, an alkynyl group, an aryl group or a heterocyclic group, provided that X and W may form a ring structure by bonding to each other, X and $R_1$ may be a cis-form or a trans-form, General Formula (3)

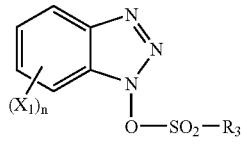

wherein $X_1$ represents a substituent; $R_3$ represents an alkyl group, an alkenyl group, an alkynyl group, an aryl group or a heterocyclic group; and n represents an integer of 0 to 4, General Formula (4)

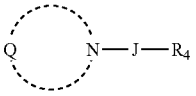

wherein Q represents an atomic group to form a nitrogen-containing heterocyclic ring; J represents —$SO_2$—, —CO—, —COO—or —CON($R_5$)—, $R_5$ represents a hydrogen atom or a substituent; $R_4$ represents an alkyl group, an alkenyl group, an alkynyl group, an aryl group or a heterocyclic group.

2. The photothermographic material of Item 1, wherein the stabilizing compound is represented by General Formula (2).
3. The photothermographic material of Item 1, wherein the stabilizing compound is represented by General Formula (3).
4. The photothermographic material of Item 1, wherein the stabilizing compound is represented by General Formula (4).
5. The photothermographic material of any one of Items 1 to 4, further contains a compound represented by General Formula (5) on the same side of the support:

General Formula (5)

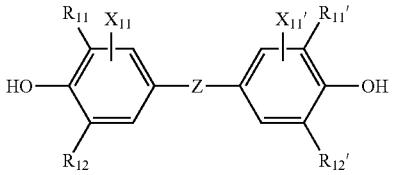

wherein Z represents a —S— group or a —C($R_{13}$)($R_{13'}$)— group, $R_{13}$ and $R_{13}$, each represent a hydrogen atom or a substituent; $R_{11}$, $R_{12}$, $R_{11}$, and $R_{12}$, each represent a substituent; $X_{11}$ and $X_{11}$, each represent a hydrogen atom or a substituent.

6. The photothermographic material of any one of Items 1 to 5, further contains a compound represented by General Formula (6) on the same side of the support:

General Formula (6)

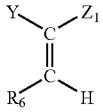

wherein Y represents an electron withdrawing group; $Z_1$ represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxy sulfinyl group, a —S-sulfinyl group, a sulfinamoyl group, a phosphoryl group, a nitro group, an imino group, a N-carbonylimino group, a N-sulfonylimino group, an ammonium group, a sulfonium group, a phosphonium group, a pyrilium group or an immonium group; and $R_6$ represents a halogen atom, an oxy group, a thio group, an amino group or a heterocyclic group; provided that Y and $Z_1$ may form a ring structure by bonding to each other, and Y and $R_6$ may be a cis-form or a trans-form.

7. The photothermographic material of any one of Items 1 to 6, further contains a hydrazine compound on the same side of the support.
8. The photothermographic material of any one of Items 1 to 7, further contains a compound represented by General Formulas (7) or (8) at least on one side of the support:

$MO_3S—(CF_2)_m—SO_3M$ General formula (7)

wherein M represents H, Li, Na, K or an ammonium group, and m represents an integer of 1 to 4 when M represents Li, m represents an integer of 1 to 6 or 8 when M represents H, m represents an integer of3 or 4 when M represents Na, m represents an integer of 1 to 6 when M represents K, and m represents an integer of 1 to 8 when M represents an ammonium group.

$$L[O_3S—(CF_2)_n—SO_3] \qquad \text{General Formula (8)}$$

wherein L represents Ba, Ca or Mg; n represents an integer of 1 to 5 when L represents Ba and n represents an integer of 1 to 8 when L represents Ca or Mg.

9. The photothermographic material of any one of Items 1 to 8, wherein at least 47 weight % of the organic silver salt is silver behenate.

10. The photothermographic material of any one of Items 1 to 9, wherein the organic silver salt is prepared by using a potassium salt of an organic acid obtained from:

potassium hydroxide; and the organic acid.

The preferred embodiments of the present invention are detailed below.

First, leuco dyes represented by General Formula (1) will be detailed.

CP is a coupler group and preferably a photographic coupler group. A coupler is a substance which forms a dye by coupling with an oxidized developing agent(it is called also a developer), for example, p-phenylenediamine or derivatives thereof), and the reduced form of said dye is called a leuco dye. Examples of photographic couplers useful in this invention are described in "Theory of the Photographic Process, 4th version (1977)", written by T. H. James, published by Macmillan, New York.

Among coupler groups represented by CP, cyan coupler groups include the following.

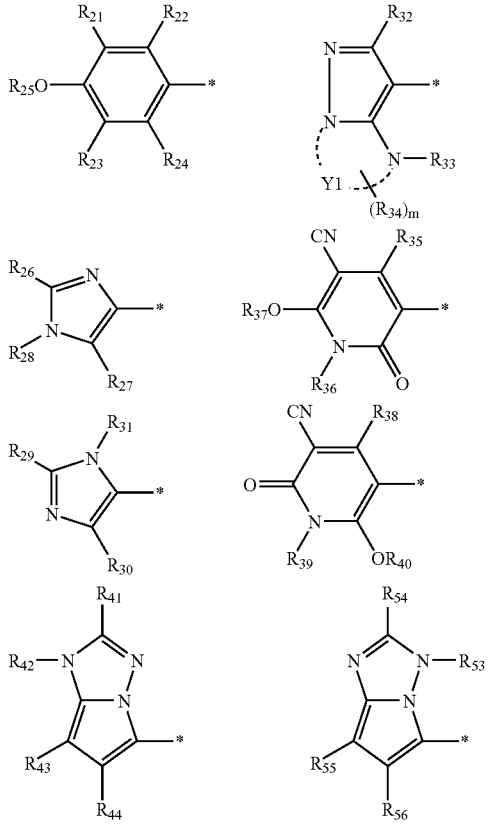

-continued

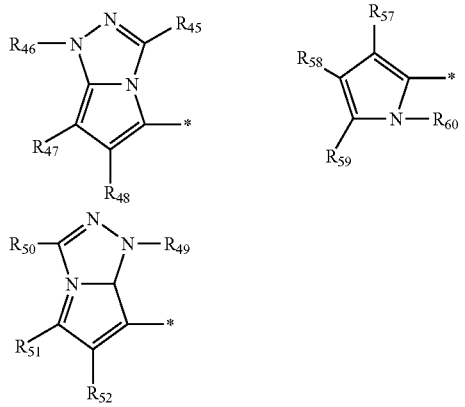

In the formula, $R_{21}$–$R_{24}$ each represent a hydrogen atom and substituents which can substitute to a benzene ring. Further, $R_{21}$ and $R_{22}$, and $R_{23}$ and $R_{24}$ may bond to each other to form a 5- to 7-membered ring. $R_{25}$ represents a hydrogen atom or a blocking group. $R_{26}$ and $R_{27}$ each represent a hydrogen atom, an alkyl group, an alkenyl group, an alkynyl group, an aryl group or a heterocyclic group. $R_{28}$ is identical with $R_{25}$. $R_{29}$ and $R_{30}$ are identical with $R_{26}$ and $R_{27}$. $R_{31}$ is identical with $R_{28}$. $R_{32}$ represents a sulfonyl group, a trifluoromethyl group, a carboxyl group, an aryloxycarbonyl group, an alkoxycarbonyl group, a carbamoyl group or a cyano group. $R_{33}$ is identical with $R_{25}$. $R_{34}$ represents a substituent, and m represents 0 or an integer of 1–3. $Y_1$ represents an atomic group necessary to constitute a 5- or 6-membered monocyclic or condensed ring nitrogen-containing heterocyclic ring. $R_{35}$ and $R_{36}$ represent a hydrogen atom, an alkyl group, an alkenyl group, an alkynyl group, an aryl group or a heterocyclic group. $R_{37}$ is identical with $R_{25}$. $R_{38}$ and $R_{39}$ are identical with $R_{35}$ and $R_{36}$. $R_{40}$ is identical with $R_{37}$. $R_{41}$, $R_{44}$ and $R_{44}$ represent a hydrogen atom or a substituent. $R_{42}$ is identical with $R_{25}$. $R_{45}$, $R_{47}$ and $R_{48}$ are identical with $R_{41}$, $R_{43}$ and $R_{44}$. $R_{46}$ is identical with $R_{42}$. $R_{50}$, $R_{51}$ and $R_{52}$ are identical with $R_{41}$, $R_{43}$ and $R_{44}$. $R_{49}$ is identical with $R_{42}$. $R_{54}$, $R_{55}$ and $R_{56}$ are identical with $R_{41}$, $R_{43}$ and $R_{44}$. $R_{53}$ is identical with $R_{42}$. $R_{57}$, $R_{58}$ and $R_{59}$ are identical with $R_{41}$, $R_{43}$ and $R_{44}$. $R_{60}$ is identical with $R_{42}$. "*" represents a bonding point of CP with another partial structure.

$R_{21}$–$R_{24}$ each represent a hydrogen atom and groups which can substitute to a benzene-ring, and groups which can substitute to a benzene ring include halogen atoms (such as fluorine, chlorine and bromine), alkyl groups (such as a methyl group, an ethyl group, an isopropyl group, a hydroxyethyl group, a methoxymethyl group, a trifluoromethyl group, a t-butyl group, a cyclopentyl group and a cyclohexyl group), alkenyl groups (such as a vinyl group and an allyl group), alkynyl groups (such as acetylene group and a methylacetylene group), aralkyl groups (such as a benzyl group and a 2-phenetyl group), aryl groups (such as a phenyl group, a naphthyl group, p-tolyl group and a p-chlorophenyl group), alkoxy groups (such as a methoxy group, an ethyoxy group, an iso-propoxy group and n-butoxy group), aryloxy groups (such as phenoxy group), a cyano group, acylamino groups (such as an acetylamino group and a propionylamino), alkylthio groups (such as a methylthio group, an ethylthio group and n-butylthio group), arylthio groups (such as a phenylthio group), sulfonylamino groups (such as a methanesulfonylamino group and a benzenesulfonylamino group), ureido groups (such as a 3-methylurido group, a 3,3-dimethylureido group and 1,3-dimethylureido group), sulfamoyl groups (such as a dimethylsulfamoylamino group), carbamoyl groups (such as a methylcarbamoyl group, an ethylcarbamoyl group and a dimethylcarbamoyl group), sulfamoyl groups (such as an ethylsulfamoyl group and a dimethylsulfamoyl group), alkoxycarbonyl groups (such as a methoxycarbonyl group and an ethoxycarbonyl group), aryloxycarbonyl groups (such as a phenylcarbonyl group), sulfonyl groups (such as a methanesulfonyl group, a butanesulfonyl group and a phenylsulfonyl group), acyl groups (such as an acetyl group, a propanoyl group and a butyroyl group), amino groups (such as a methylamino group, an ethylamino group and a dimethylamino group), a hydroxyl group, a nitro group, an imido groups (such as a phthalimido group), heterocyclic ring groups (such as a pyridyl group, benzimidazolyl group, a benzthiazolyl group and a benzoxazolyl group).

$R_{21}$–$R_{24}$ each is preferably a halogen atom, an alkyl group, an acylamino group, an ureido group or a carbamoyl group.

5–7 membered rings, which are formed by $R_{21}$ and $R_{22}$, and $R_{23}$ and $R_{24}$ bonding to each other, include aromatic carbon rings and heterocyclic rings, however, preferably a benzene ring.

$R_{25}$ represents a hydrogen atom or a blocking group, and said blocking group includes an acyl group, a sulfonyl group, a carbamoyl group, a sulfo group, a sulfamoyl group, an alkoxycarbonyl group, an aryloxycarbonyl group and an oxalyl group.

Acyl groups represented by $R_{25}$ include preferably such as an acetyl group, a trifluoroacetyl group and a benzoyl group. Sulfonyl groups include preferably such as a methanesulfonyl group and a benzenesulfonyl group. Carbamoyl groups include preferably such as a diethylcarbamoyl, a phenylcarbamoyl group and a p-toluensulfonylcarbamoyl group. Sulfamoyl groups include preferably such as a diethylsulfamoyl group. Alkoxycarbonyl groups include preferably such as a methoxycarbonyl group and an ethoxycarbonyl group. Aryloxycarbonyl groups include preferably such as a phenoxycarbonyl group.

Oxalyl groups include preferably an ethoxyoxalyl group, a methylaminooxalyl group and a methyloxalyl group.

Alkyl groups, alkenyl groups, alkynyl groups and aryl groups represented by $R_{26}$ and $R_{27}$ include alkyl groups, alkenyl groups, alkynyl groups and aryl groups listed as $R_{21}$–$R_{24}$, and heterocyclic rings include 5-–6-membered aromatic heterocyclic rings having at least one kind of O, S and N atoms in the ring (for example, 6-membered azines such as pyridine, pyrazine and pyrimidine and benzelogues thereof; pyrrole, thiophene and furan and benzelogues thereof; 5-membered azoles such as imidazole, pyrazole, triazole, tetrazole, thiazole, oxazole, thiadiazole and oxadiazole, and benzelogues thereof). $R_{26}$ and $R_{27}$ include preferably a phenyl group, a pyrazolyl group and a pyridyl group.

Sulfonyl groups represented by $R_{32}$ include such as a methanesulfonyl group and a benzenesulfonyl group. Aryloxycarbonyl groups include such as a phenoxycarbonyl group. Alkoxycarbonyl groups include such as an ethoxycarbonyl group. Carbamoyl groups include such as a diethylaminocarbamoyl group.

$R_{34}$ represents a substitute, and include the same substituents listed as $R_{21}$–$R_{24}$.

Nitrogen-containing heterocyclic rings represented by $Y_1$ include each ring of such as imidazole, triazole or tetrazole, and benzelogues thereof.

Alkyl groups, alkenyl groups, alkynyl groups, aryl groups or heterocyclic ring groups represented by $R_{35}$ and $R_{36}$ include the groups listed as $R_{26}$ and $R_{27}$.

Substituents represented by $R_{41}$, $R_{43}$ and $R_{44}$ include the substituents listed as $R_{21}$–$R_{24}$.

In leuco dyes represented by General Formula (1), R represents a hydrogen atom or a blocking group, however, preferably a blocking group. Blocking groups represented by R include an acyl group, a sulfonyl group, a carbamoyl group, a sulfo group, a sulfamoyl group, an alkoxycarbonyl group, an aryloxycarbonyl group and an oxalyl group. Specifically, listed are the blocking groups explained in aforesaid $R_{25}$ of a cyan coupler chemical structure.

In leuco dyes represented by General Formula (1), —N(R)D represents a developer group and D is preferably those represented by following General Formula (9).

General Formula (9)

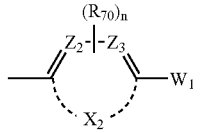

wherein, $W_1$ represents —N($R_{71}$)$R_{72}$, —OH or —$OZ_4$, $R_{71}$ and $R_{72}$ each represent an alkyl group, an alkenyl group, an alkynyl group, an aryl group or a heterocyclic group; and $Z_4$ represents a cation. $R_{70}$ represents a substituent, n represents 0 or an integer of 1–4, and $Z_2$ and $Z_3$ each represent a nitrogen atom or ═CH—.

$X_2$ represents an atomic group which is necessary to form an aromatic ring together with $Z_2$, $Z_3$ and the adjacent carbon atoms.

Alkyl groups, alkenyl groups, alkynyl groups, aryl groups or heterocyclic ring groups represented by $R_{71}$ and $R_{72}$ include the groups listed as $R_{26}$ and $R_{27}$ explained in chemical structures of cyan coupler groups, preferably alkyl groups and aryl groups and most preferably alkyl groups. Alkyl groups represented by $R_{71}$ and $R_{72}$ include such as a methyl group, an ethyl group, a propyl group and a butyl group. These may be further substituted and preferable substituents include a hydroxyl group and a sulfonamide group.

Aryl groups represented by $R_{71}$ and $R_{72}$ include preferably a phenyl group.

$Z_4$ represents a cation and preferably metal ions (such as $Li^+$, $Na^+$ and $K^+$) or ammonium ions (such as ammonium, triethylammonium, trimethylbenzylammonium, tetrabutylammonium and tetradecylammonium).

$R_{70}$ represents a substituent and is identical with $R_{34}$ in chemical structures of cyan coupler groups. It is preferred that n=1 so that $R_{70}$ represents a methyl group.

Aromatic rings constituted of $X_2$, $Z_2$, $Z_3$ and the adjacent carbon atoms include such as a benzene ring, a naphthalene ring, a quinoline ring, a pyridine ring, a pyrimidine ring, a pyridazine ring, a pyrazine ring, a triazine ring, a tetrazine ring, a pyrrole ring, a furan ring, a thiophene ring, a thiazole ring, an oxazole ring, an imidazole ring, a thiadiazole ring and oxadiazole ring. Among them preferred are a benzene ring and a pyridine ring.

In leuco dyes represented by General Formula (1), AH represents an acid and specifically includes organic acids such as trifluoroacetic acid, perfluorobutanoic acid and those represented by $R_{73}SO_3H$ in addition to inorganic acids such as HCl, $H_2SO_4$ and $H_3PO_4$. AH is preferably an organic acid represented by $R_{73}SO_3H$, and $R_{73}$ represents aliphatic groups or aromatic groups. Aliphatic groups represented by $R_{73}$ include such as a methyl group, a butyl group, a perfluorobutyl group, a cyclohexyl group and a dodecyl group, and aromatic groups include such as a phenyl group, a p-tolyl group and a dodecylphenyl group.

In the following, with respect to leuco dyes represented by General Formula (1), listed are specific examples for each of CP (a coupler group) as a partial structure of the cyan coloring leuco dye and —N(R)D (a developer group) as a partial structure of the leuco dye, however, this invention is not limited thereto.

Specific examples for CP (a coupler group) as a partial structure of the cyan coloring leuco dye are described below.

CP—*

CP-1

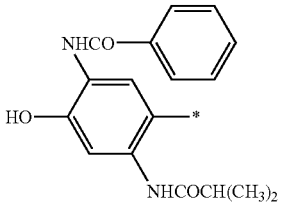

CP-2

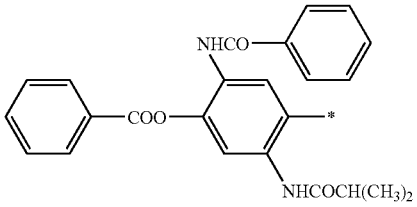

CP-3

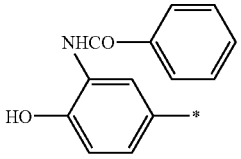

CP-4

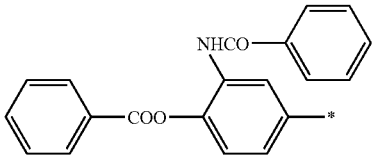

CP-5

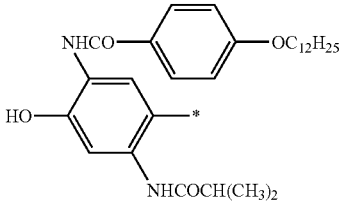

CP-6

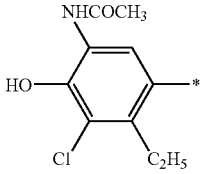

-continued

CP-7

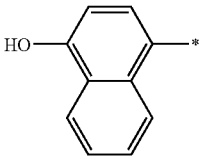

CP-8

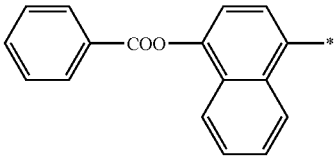

CP-9

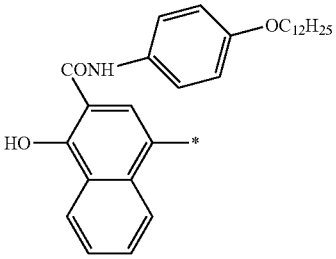

CP-10

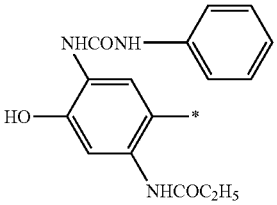

CP-11

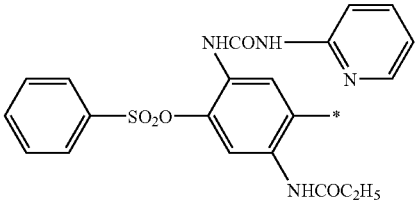

CP-12

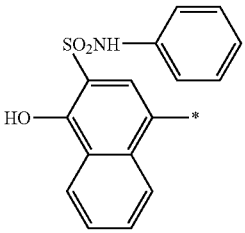

CP-13

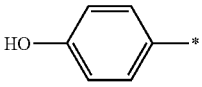

CP-14

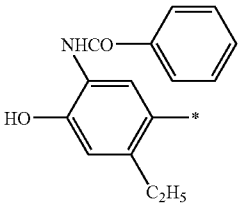

-continued
CP-15
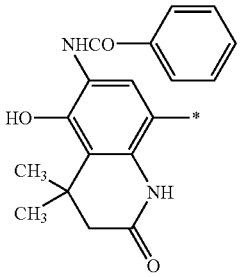
CP-16
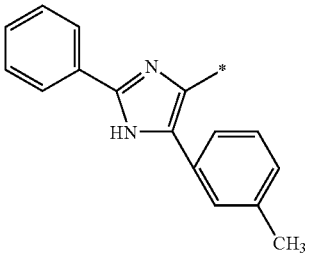
CP-17
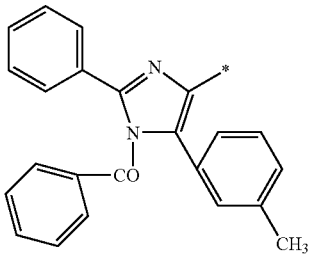
CP-18
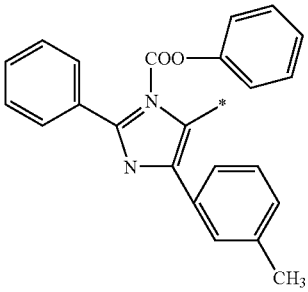
CP-19
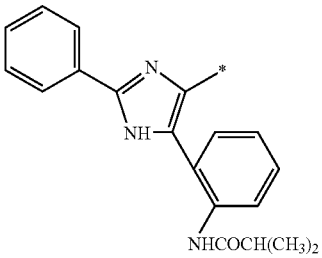
CP-20
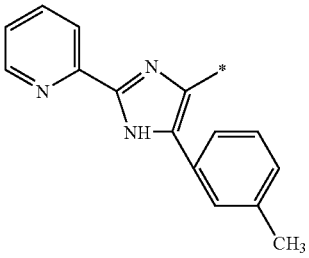
-continued
CP-21
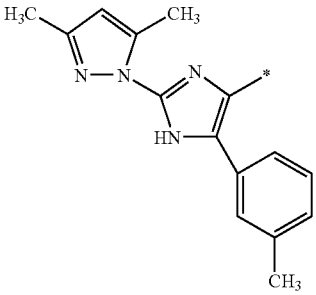
CP-22
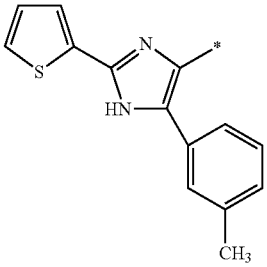
CP-23
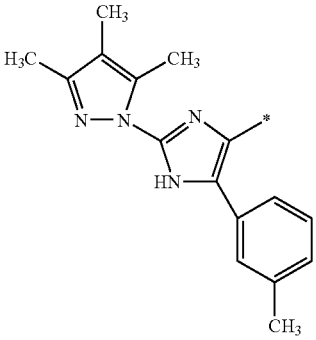
CP-24
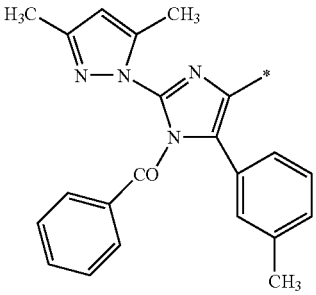
CP-25
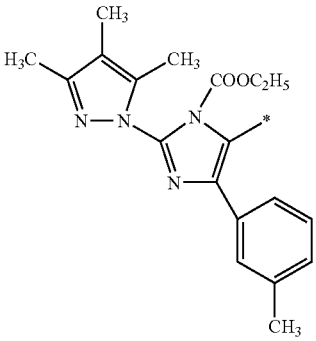

-continued
CP-26
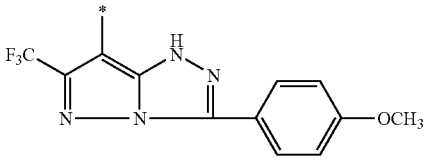
CP-27
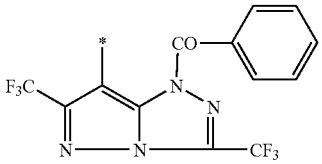
CP-28
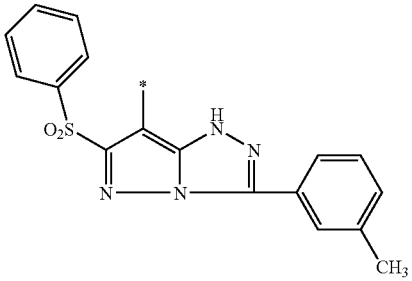
CP-29
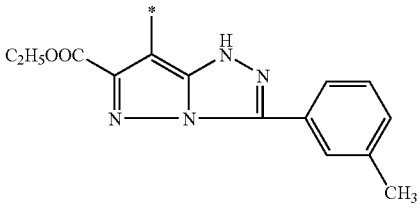
CP-30
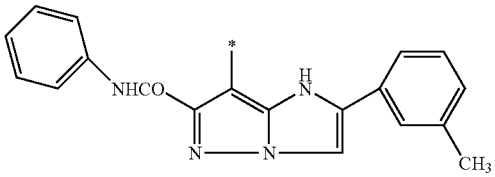
CP-31
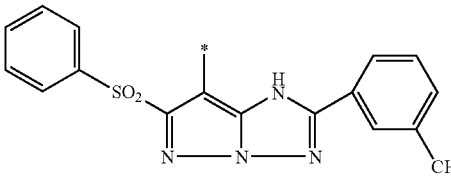
CP-32
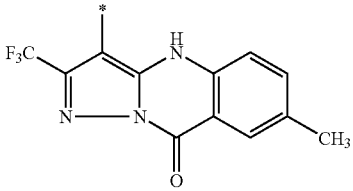
-continued
CP-33
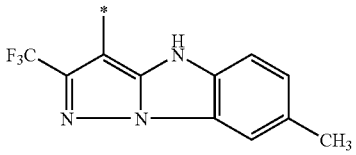
CP-34
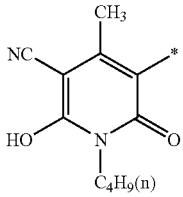
CP-35
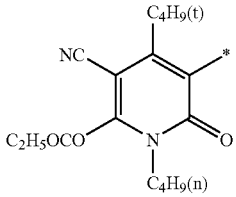
CP-36
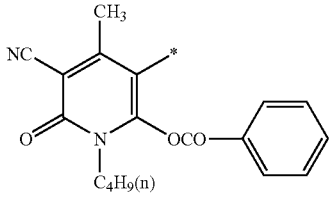
CP-37
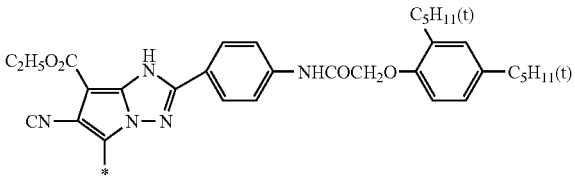
CP-38
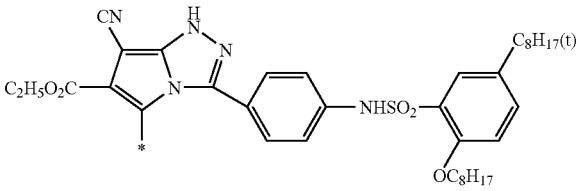
CP-39
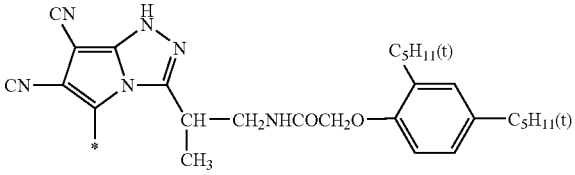

-continued
CP-40
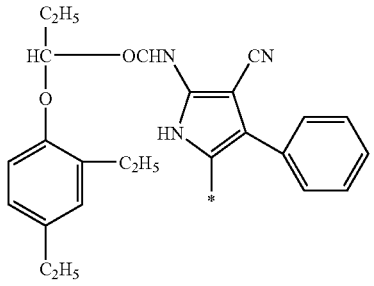
CP-41
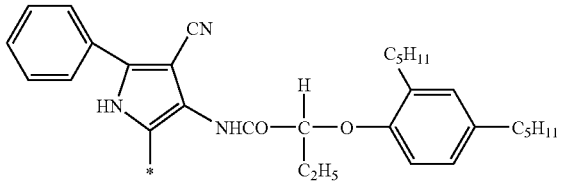
CP-42
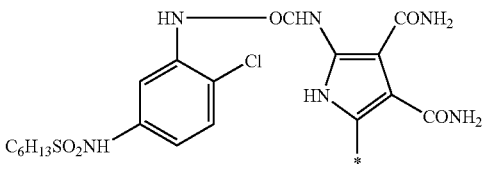
CP-43
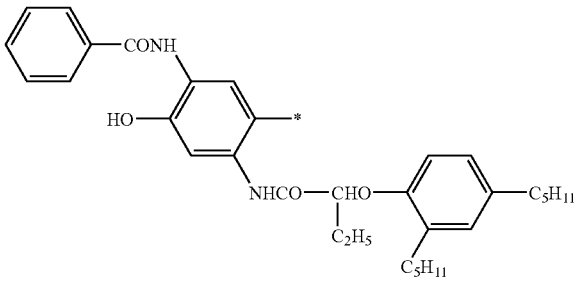
CP-44
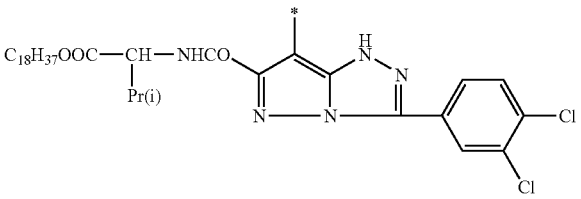
CP-45
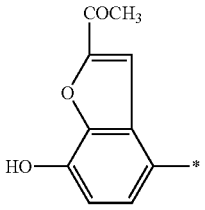
-continued
CP-46
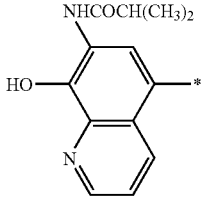
Specific examples for —N(R)D (a developer group) as a partial structure of the cyan coloring leuco dye are described below.
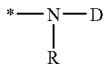
CD-1
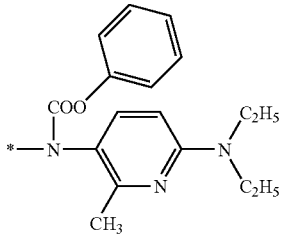
CD-2
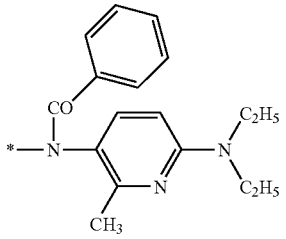
CD-3
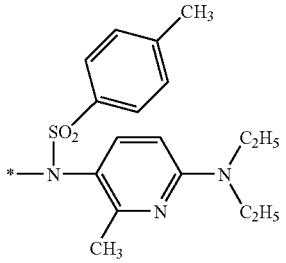
CD-4
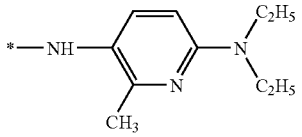
CD-5
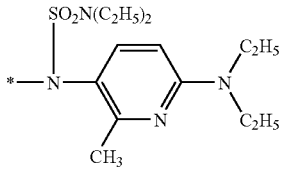

-continued
CD-6
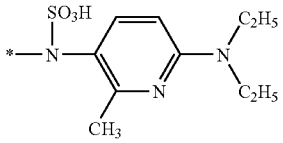
CD-7
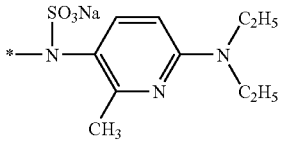
CD-8
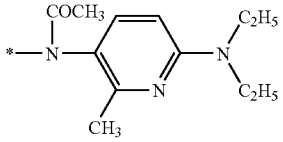
CD-9
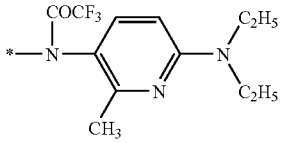
CD-10
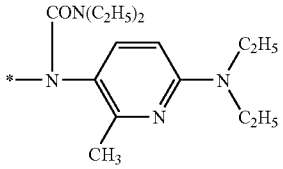
CD-11
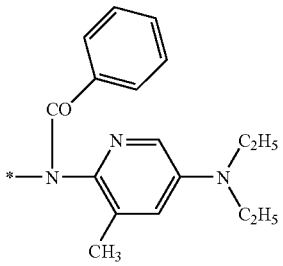
CD-12
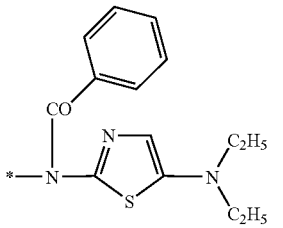
CD-13
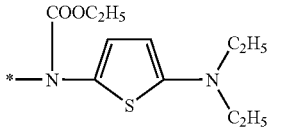
CD-14
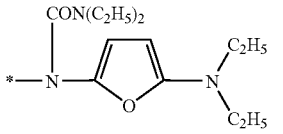
-continued
CD-15
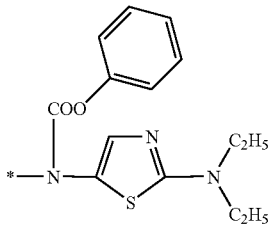
CD-16
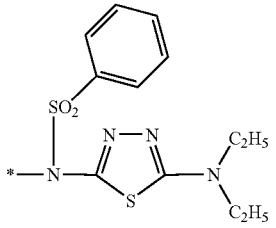
CD-17
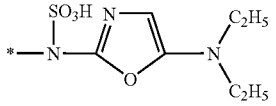
CD-18
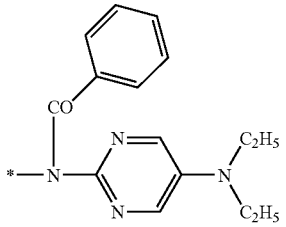
CD-19
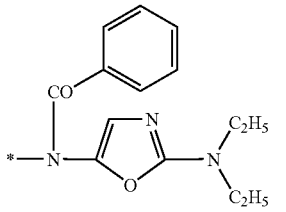
CD-20
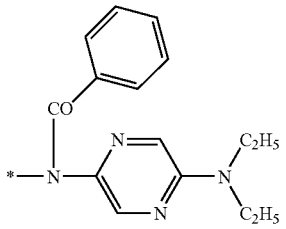
CD-21
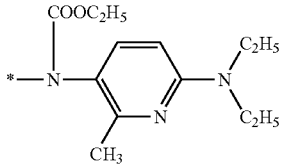

-continued
CD-22
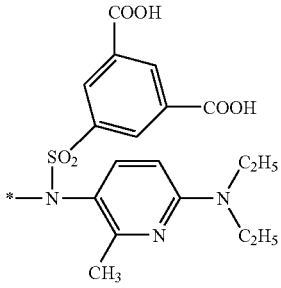
CD-23
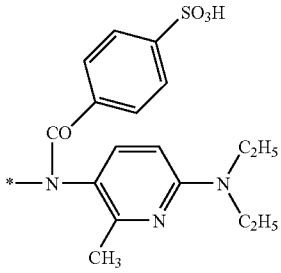
CD-24
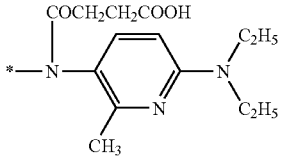
CD-25
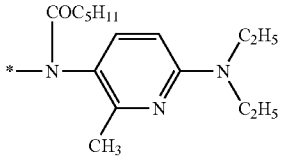
CD-26
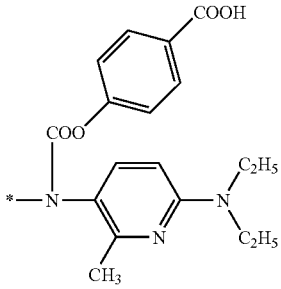
CD-27
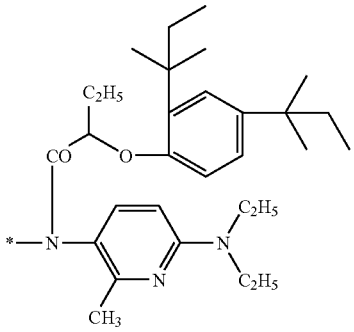
-continued
CD-28
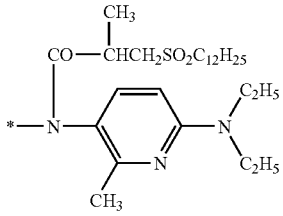
CD-29
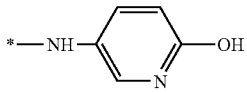
CD-30
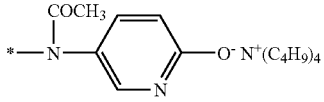
CD-31
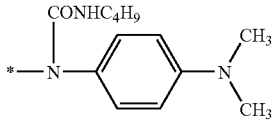
CD-32
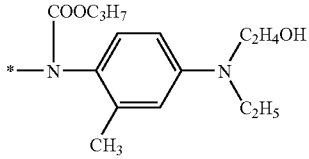
CD-33
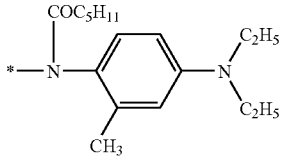
CDv34
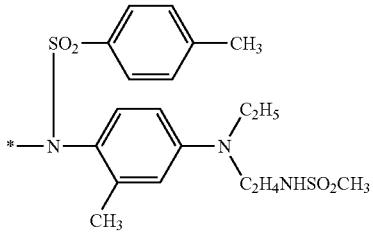
CD-35
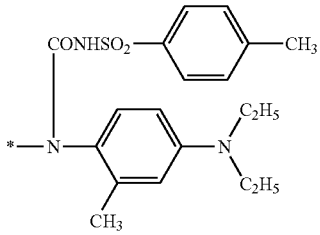

-continued
CD-36
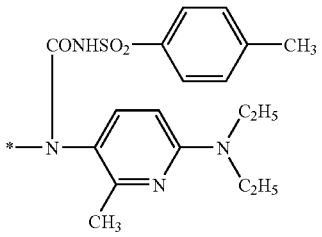
CD-37
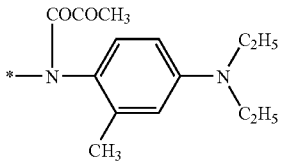
CD-38
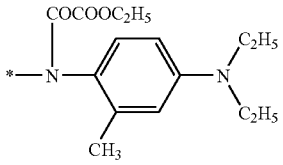
CD-39
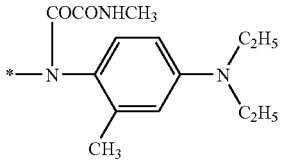
CD-40
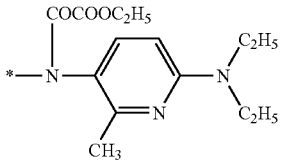
CD-41
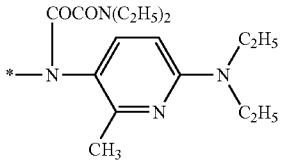
-continued
CD-42
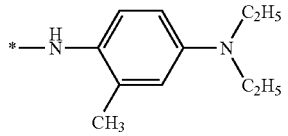
CD-43
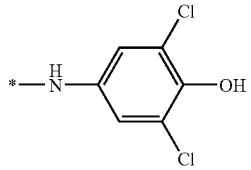
CD-44
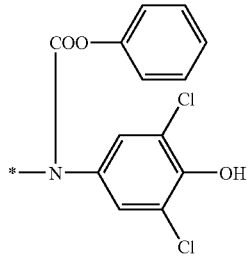
CD-45
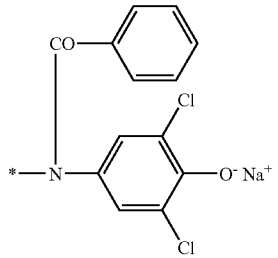
CD-46
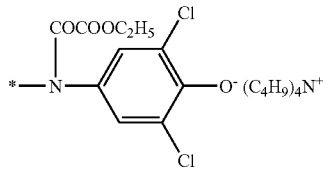
Next, specific examples of cyan leuco dyes represented by General Formula (1) will be listed, however this invention is not limited thereto.
CL-1
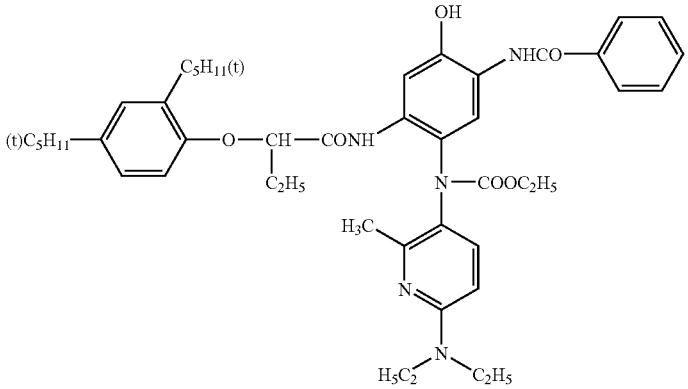

-continued
CL-2
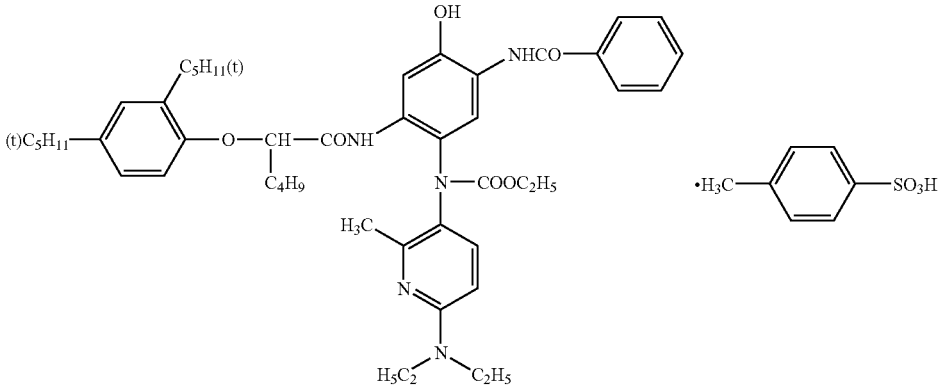
CL-3
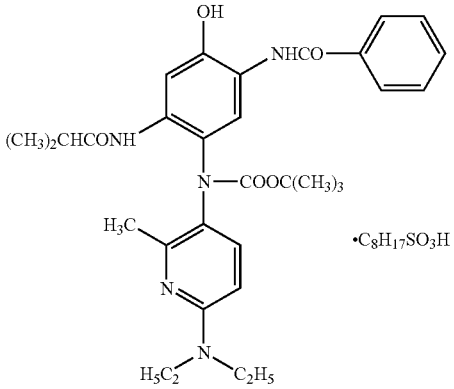
CL-4
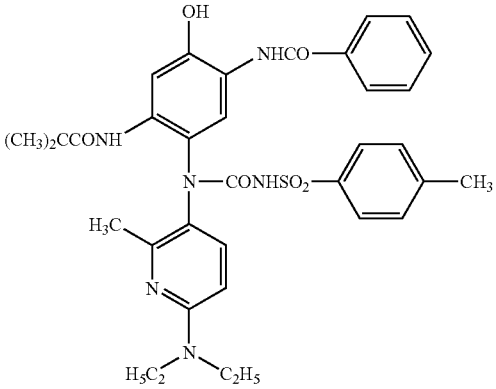
CL-5
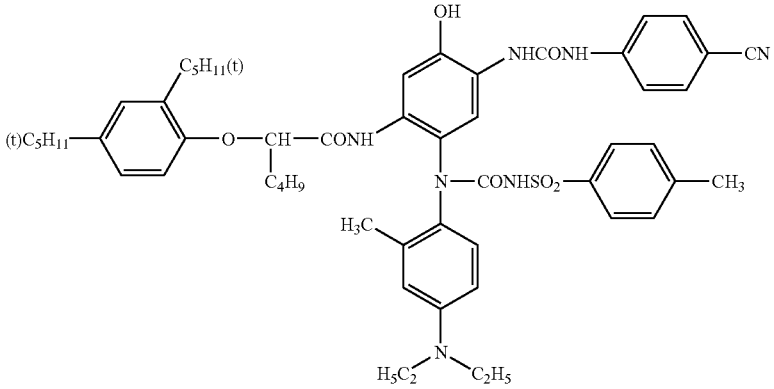
CL-6
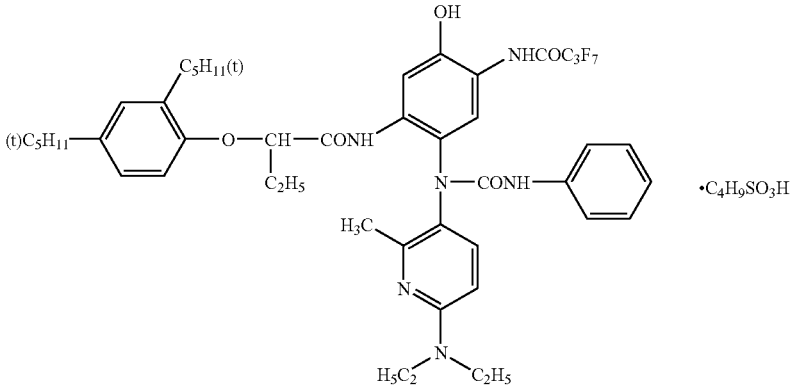

-continued
CL-7
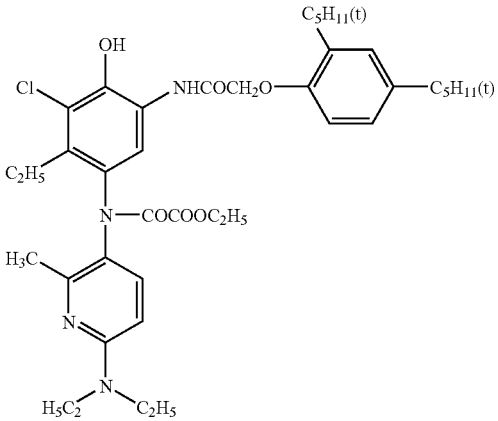
CL-8
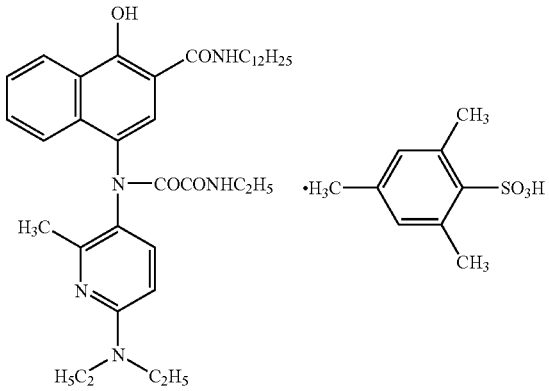
CL-9
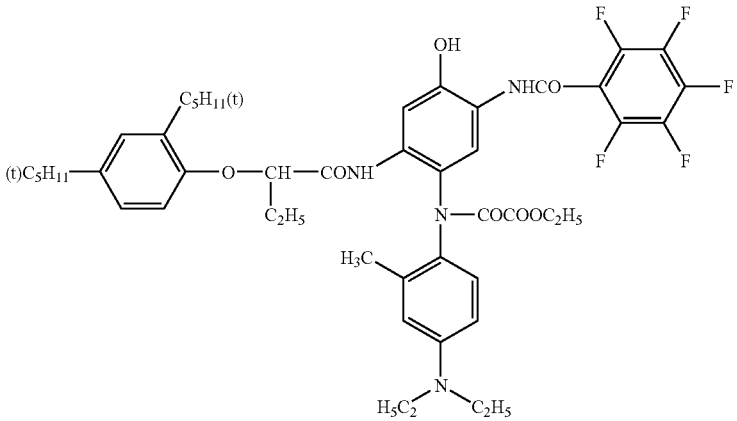
CL-10
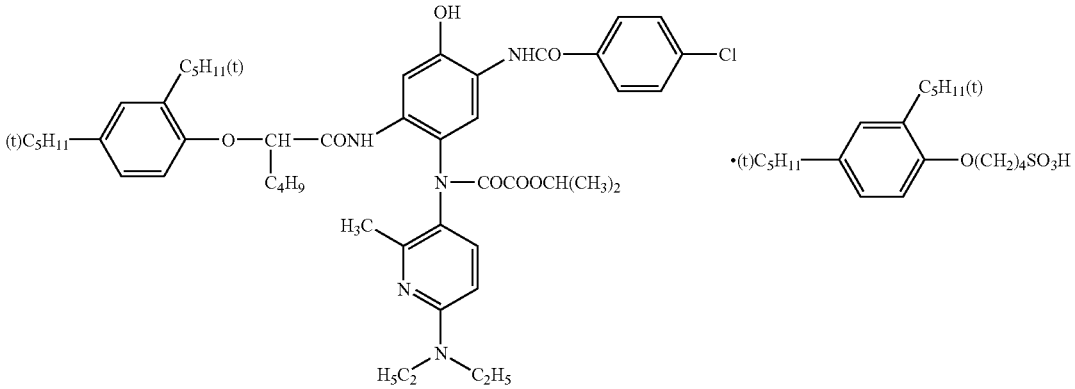
CL-11
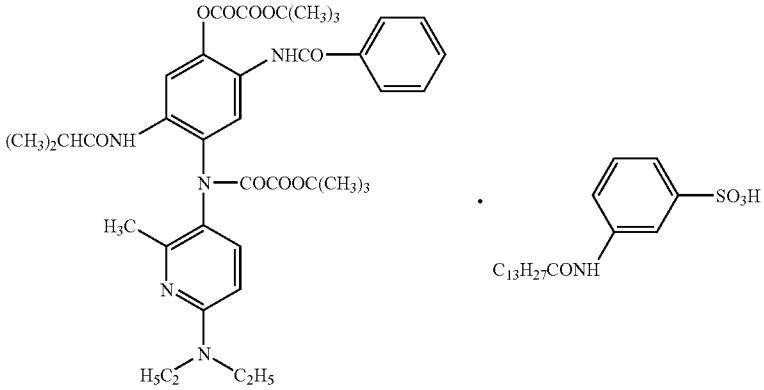

-continued
CL-12
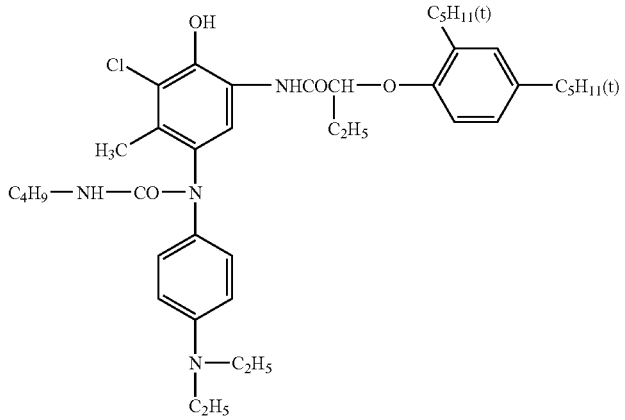
CL-13
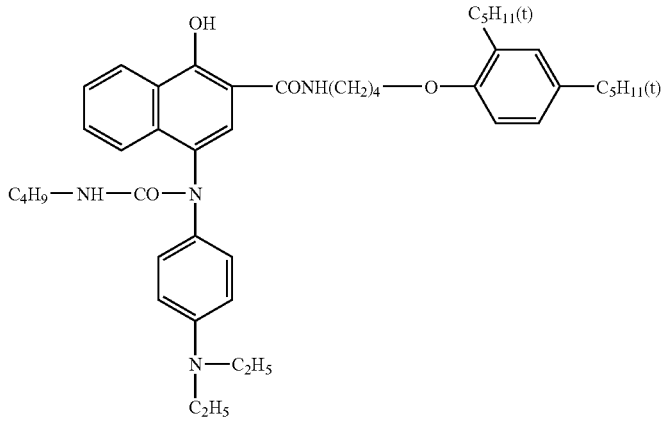
CL-14
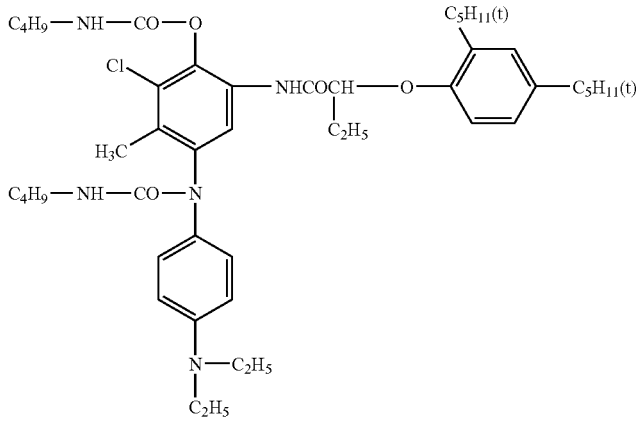
CL-15
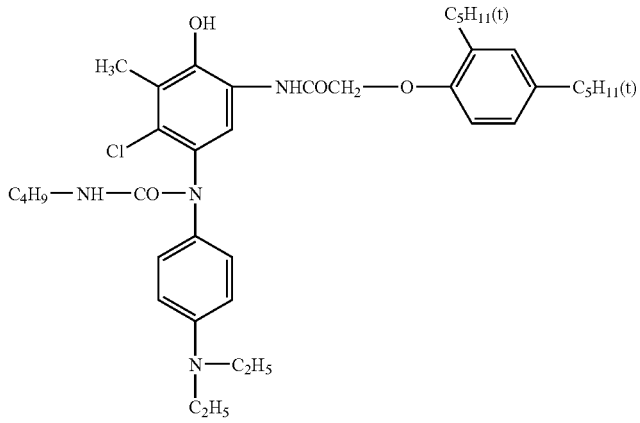

-continued
CL-16
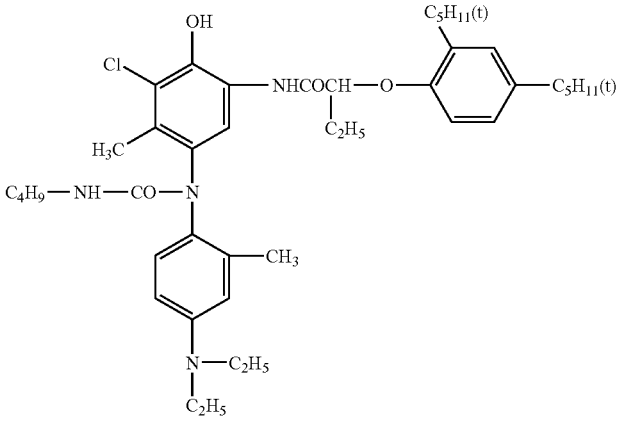
CL-17
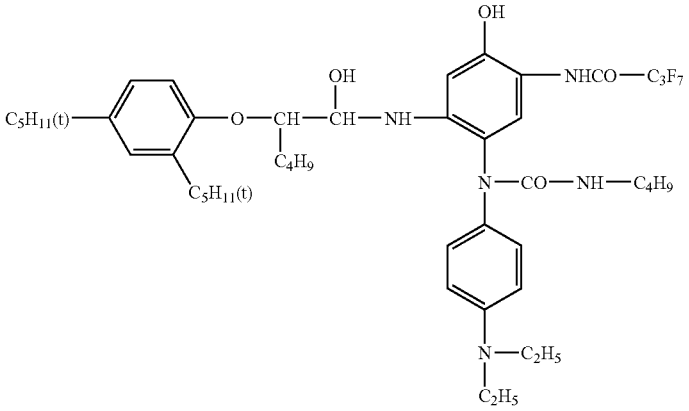
CL-18
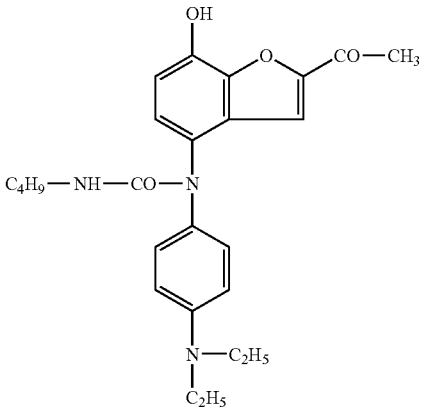
CL-19
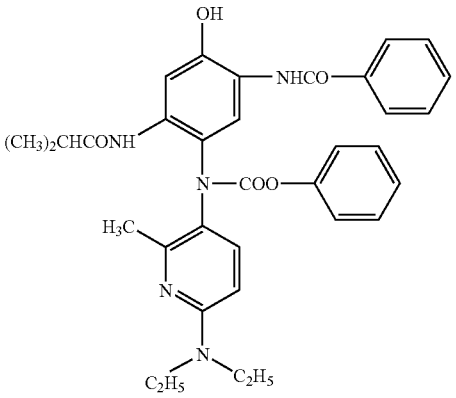
CL-20
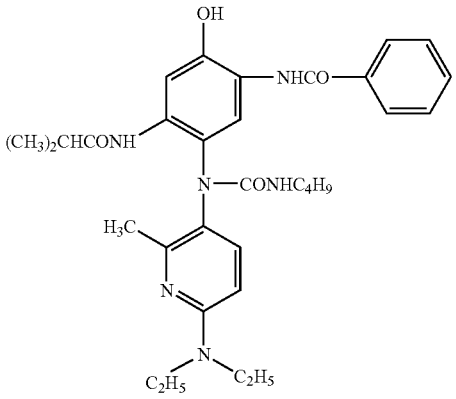
CL-21
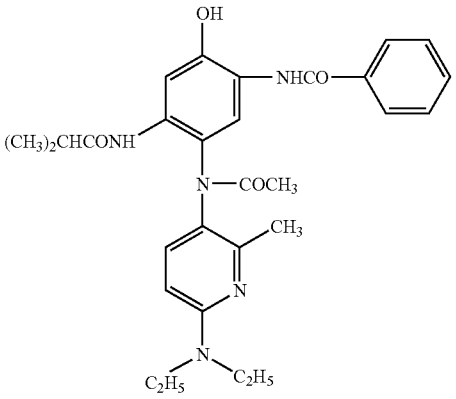

-continued
CL-22
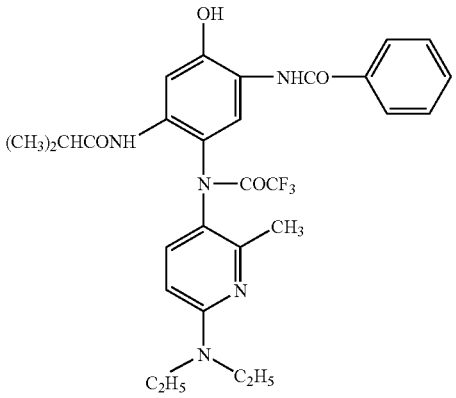
CL-23
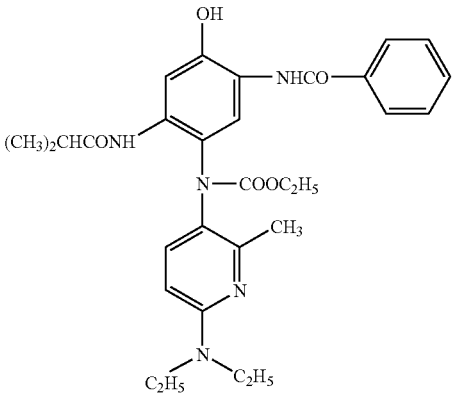
CL-24
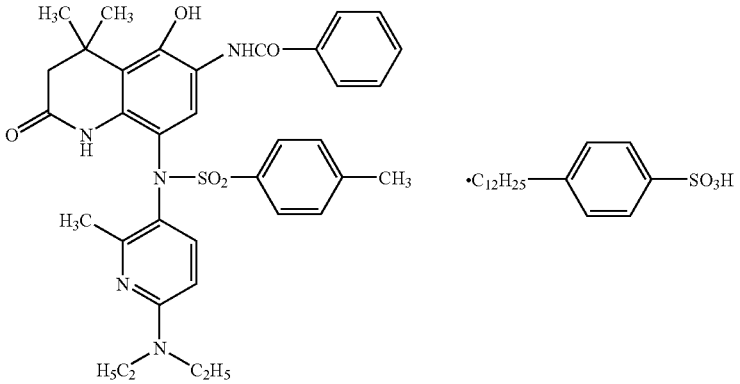
CL-25
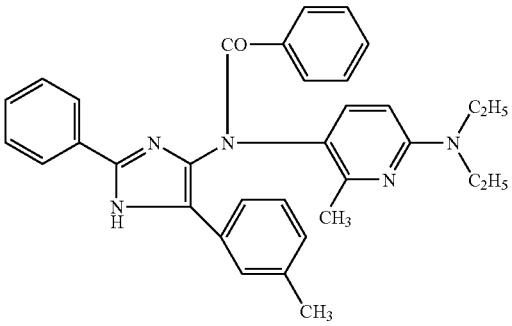
CL-26
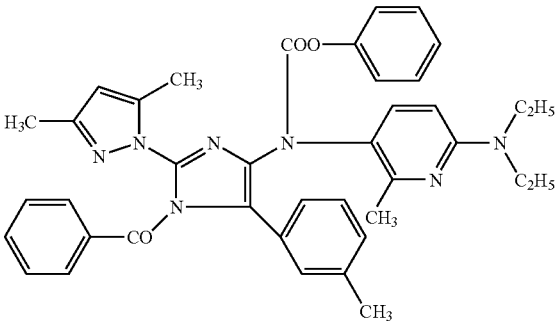
CL-27
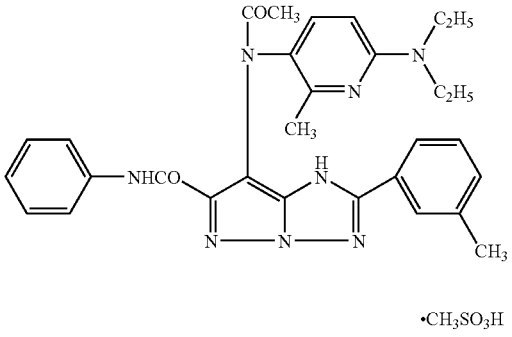
CL-28
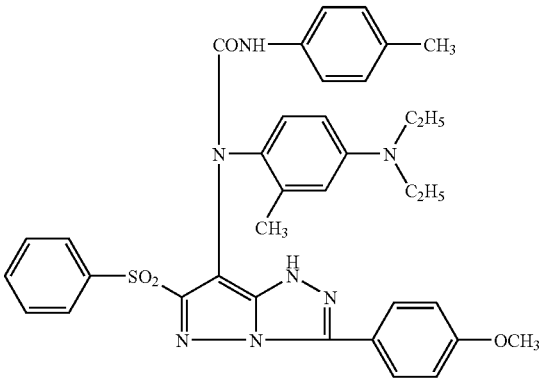

-continued
CL-29
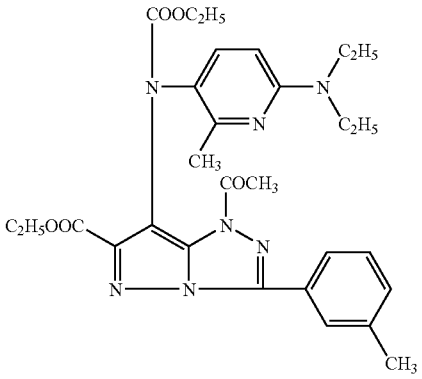
CL-30
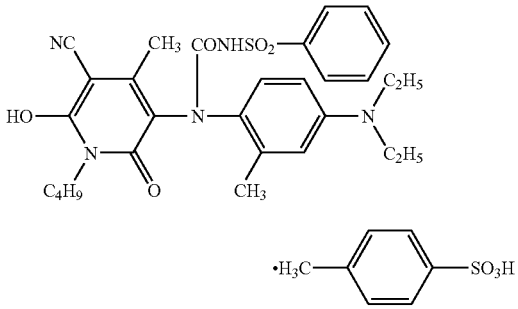
CL-31
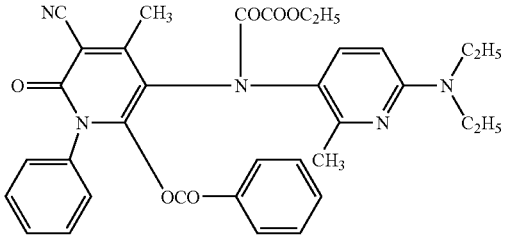
CL-32
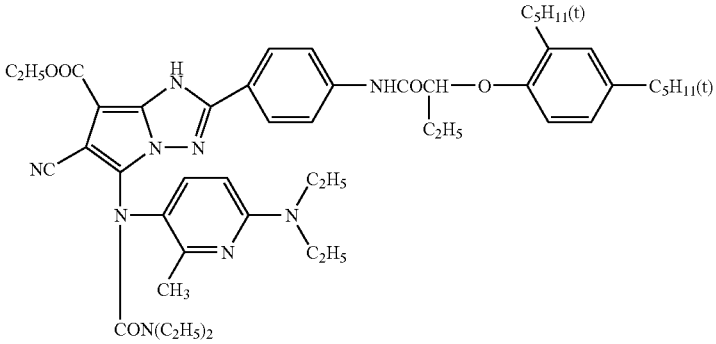
CL-33
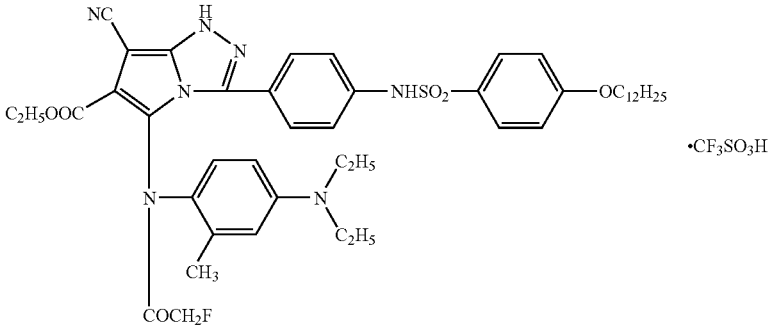

-continued
CL-34
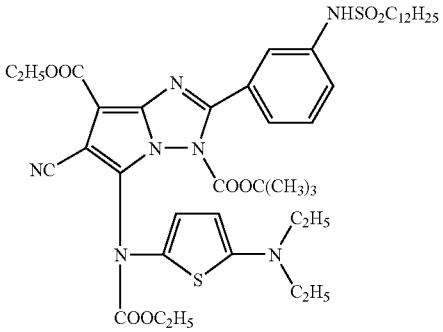
CL-35
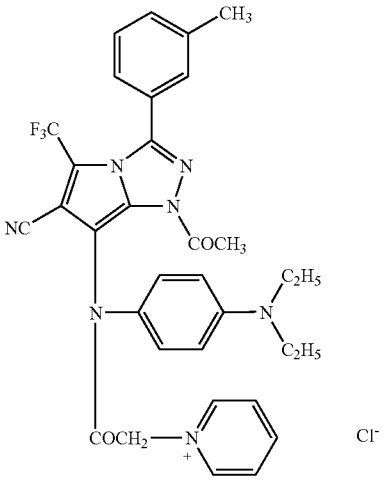
CL-36
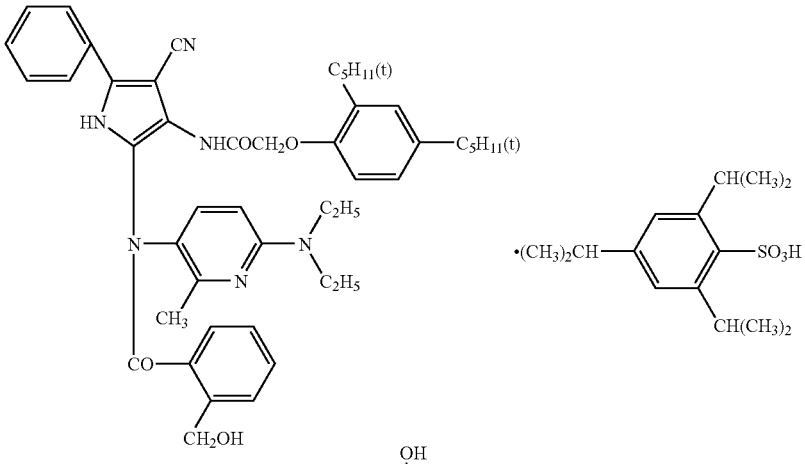
CL-37
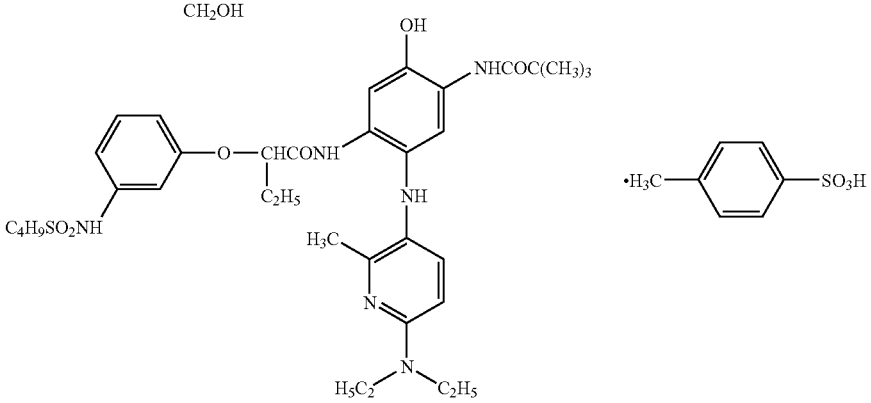
CL-38
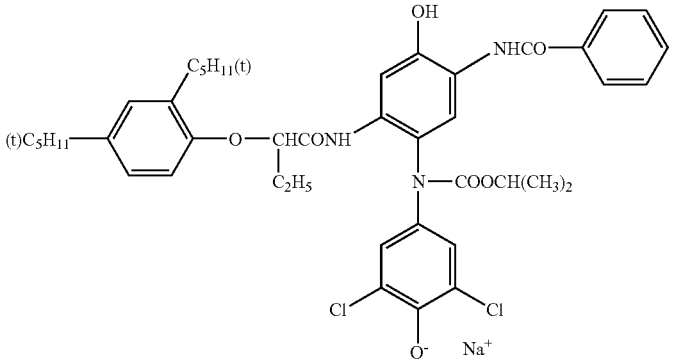

-continued

CL-39

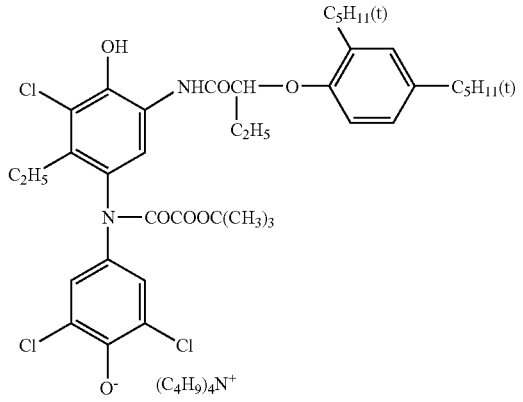

CL-40

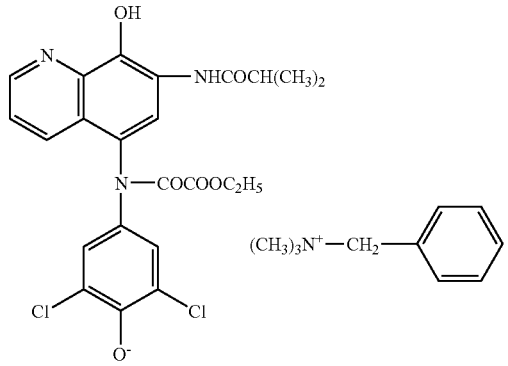

Among coupler groups represented by CP, yellow coupler groups include the following.

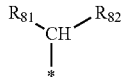

wherein, $R_{81}$ and $R_{82}$ each represent a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrilium group or an immonium group; and at least one of $R_{81}$ and $R_{82}$ represents an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrylium group or an immonium group.

$R_{81}$ and $R_{82}$ include a hydrogen atom, alkyl groups (such as methyl, ethyl and trifluoromethyl), alkenyl groups (such as vinyl, halogen-substituted vinyl and cyanovinyl), alkynyl groups (such as acetylenyl and cyanoacetylenyl), aryl groups (such as phenyl, chlorophenyl, nitrophenyl, cyanophenyl and pentafluorophenyl), heterocyclic groups (such as pyridyl, pyrimidyl, pyrazinyl, quinoxalinyl, triazinyl, succineimido, tetrazonyl, triazolyl, imidazolyl and benzooxazolyl), a halogen atom, a cyano group, acyl groups (such as acetyl, pivalyl and benzoyl), thioacyl groups (such as thioformyl and thioacetyl), oxalyl groups (such as methyloxalyl), oxyoxalyl groups (such as ethoxalyl), —S-oxalyl groups (such as ethylthiooxalyl), oxamoyl groups (such as methyloxamoyl), oxycarbonyl groups (such as ethoxycarbonyl and carboxyl), —S-carbonyl groups (such as ethylthiocarbonyl), carbamoyl groups (such as phenylcarbamoyl), a thiocarbamoyl group, a sulfonyl group, a sulfinyl group, oxysulfonyl groups (such as ethoxysulfonyl), —S-sulfonyl groups (such as ethylthiosulfonyl), a sulfamoyl group, oxysulfinyl groups (such as methoxysulfinyl), —S-sulfinyl groups (such as methylthiosulfinyl), a sulfinamoyl group, a phosphoryl group, a nitro group, imino groups (such as imino, N-methylimino, N-phenylimino, N-pyridylimino, N-cyanoimino and N-nitroimino), N-carbonylimino groups (such as N-acetylimino, N-ethoxycarbonylimino, N-ethoxalylimino, N-formylimino, N-trifluoroacetylimino and N-carbamoylimino), N-sulfonylimino groups (such as N-methanesulfonylimino, N-trifluoromethanesulfonylimino, N-methoxysulfonylimino and N-sulfamoylimino), an ammonium group, a sulfonium group, a phosphonium group, a pyrilium group or an immonium group, and also include heterocyclic groups in which rings are formed by such as an ammonium group, a sulfonium group, a phosphonium group and an immonium group.

At least one of $R_{81}$ and $R_{82}$ is preferably an electron withdrawing group having a plus Hammett's σ, and more preferably a σp of not less than 0.2.

As a yellow coupler group, preferable yellow coupler groups can be provided by employing preferable combinations of $R_{81}$ and $R_{82}$ among the groups listed as $R_{81}$ and $R_{82}$. Herein, as combinations of $R_{81}$ and $R_{82}$ for yellow coupler groups, excluded are a combination of a cyano group with a cyano group, a combination of a cyano group with a dicyanovinyl group and a combination of a cyano group with an aroyl group (aromatic acyl groups such as benzoyl among the acyl groups). Preferable combinations as $R_{81}$ and $R_{82}$ are those in which one is an acyl group and the other is a carbamoyl group.

Herein, in this invention, a keto-enol tautomerism as shown in the following equation can be possible when $R_{81}$ and $R_{82}$ contain carbonyl groups.

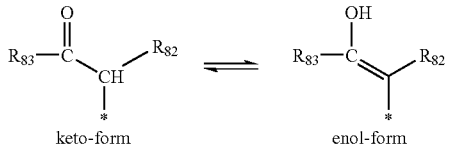

Further, compounds-represented by the following formula, in which an enol form has been blocked, are also included in this invention.

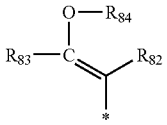

Wherein, $R_{84}$ is a blocking group and specifically includes the blocking groups explained as $R_{25}$ in the chemical structures of a cyan coupler group.

In the following, with respect to leuco dyes represented by General Formula (1), specific examples of CP (a coupler group) as a partial structure of a yellow coloring leuco dye are listed, however, this invention is not limited thereto.

Specific examples of CP (a coupler group) as a partial structure of a yellow coloring leuco dye are listed below.

CP-101

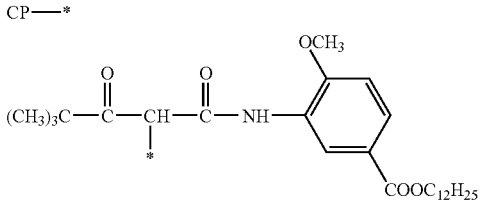

CP-102

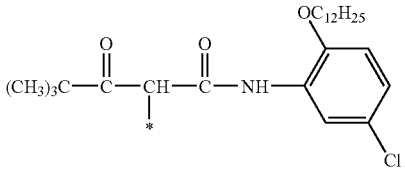

CP-103

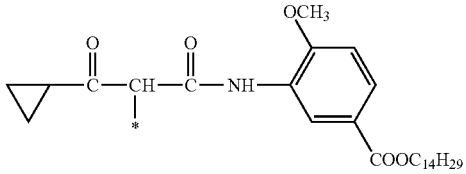

CP-104

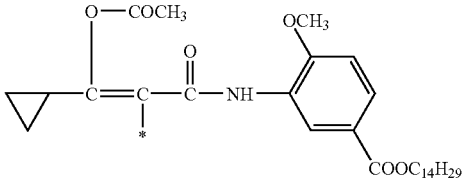

CP-105

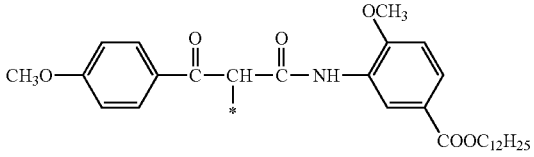

CP-106

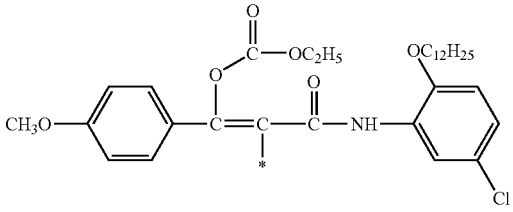

CP-107

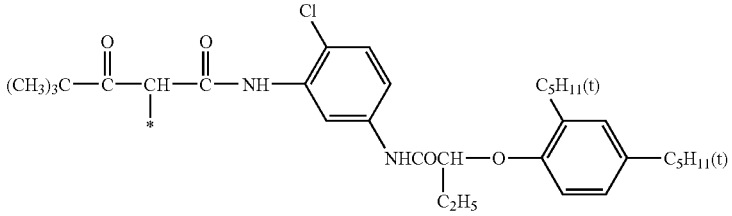

CP-108

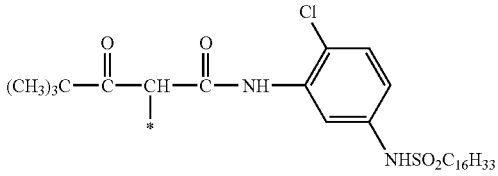

CP-109

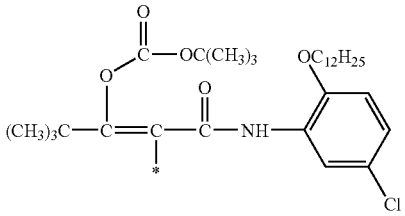

CP-110

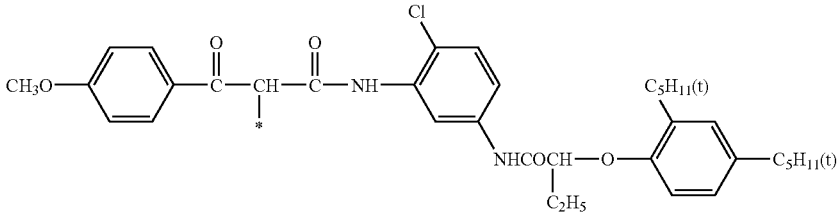

-continued
CP-111
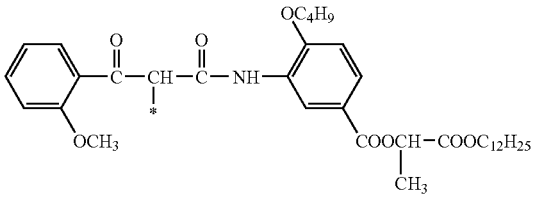
CP-112
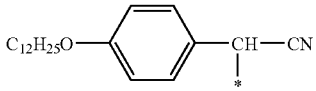
CP-113
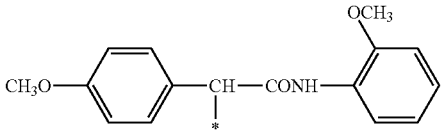
CP-114
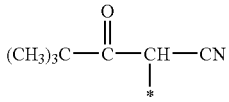
CP-115
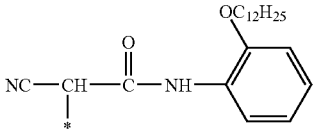
CP-116
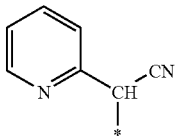
CP-117
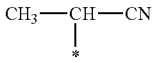
CP-118
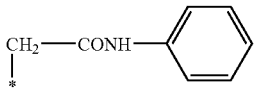
CP-119
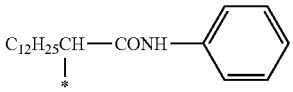
CP-120
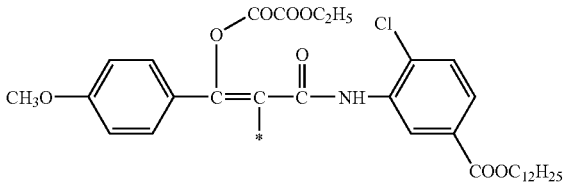
CP-121
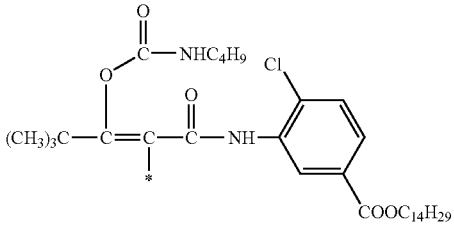
Next, specific examples of a yellow coloring leuco dye are listed, however, this invention is not limited thereto.
YL-1
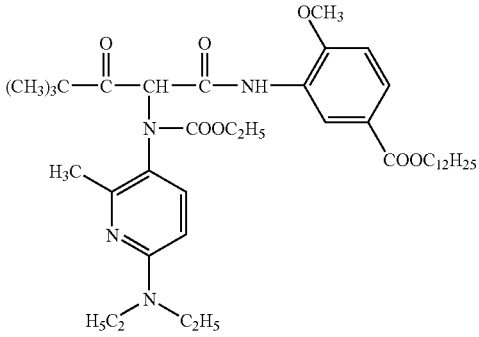
YL-2
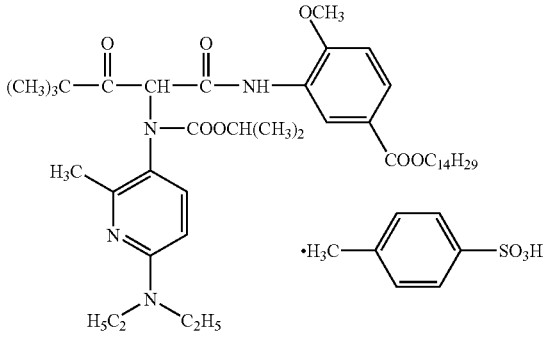

-continued
YL-3
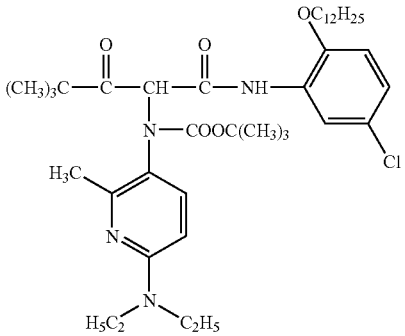
YL-4
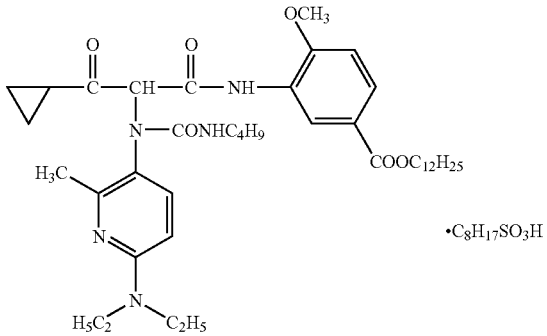
YL-5
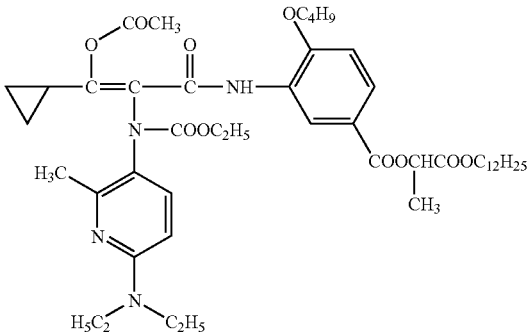
YL-6
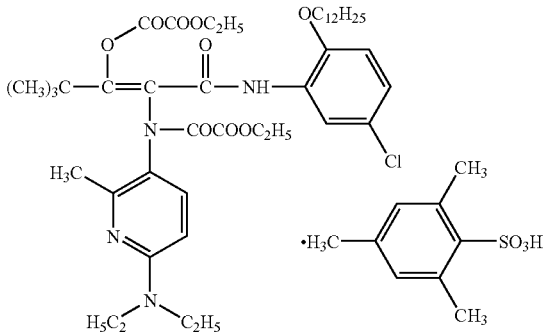
YL-7
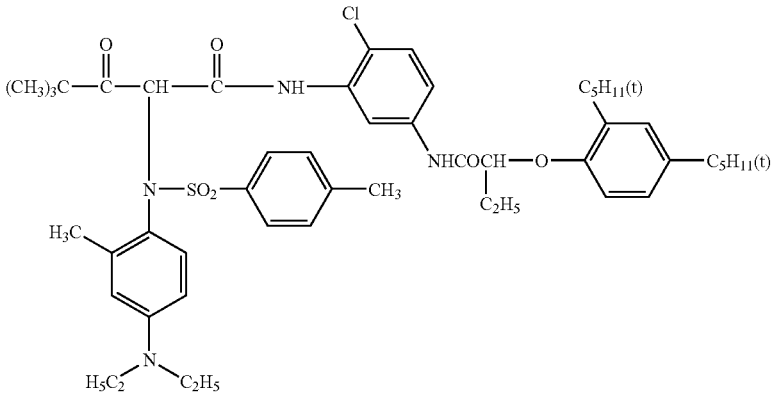
YL-8
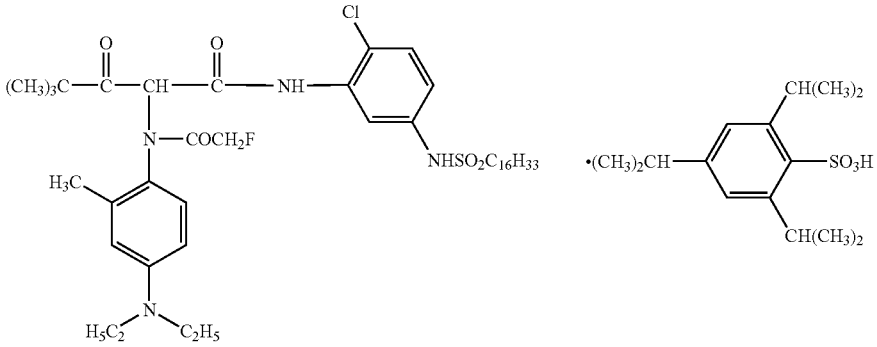

-continued
YL-9
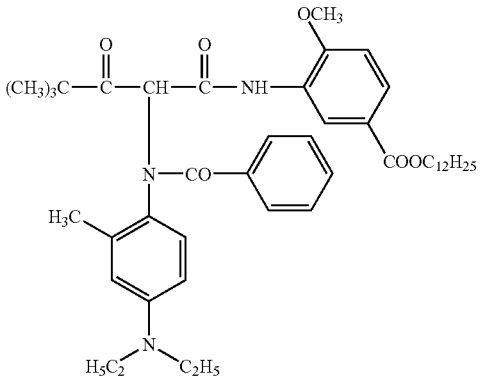
YL-10
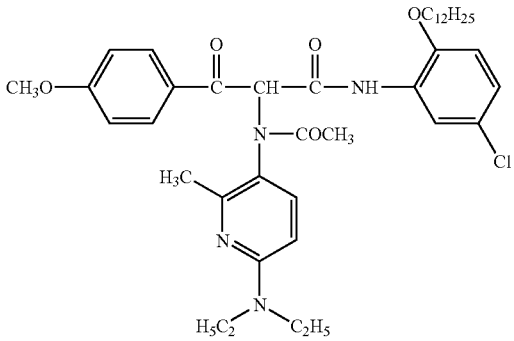
YL-11
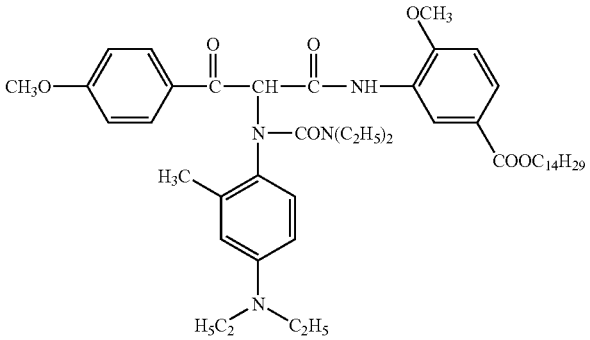
YL-12
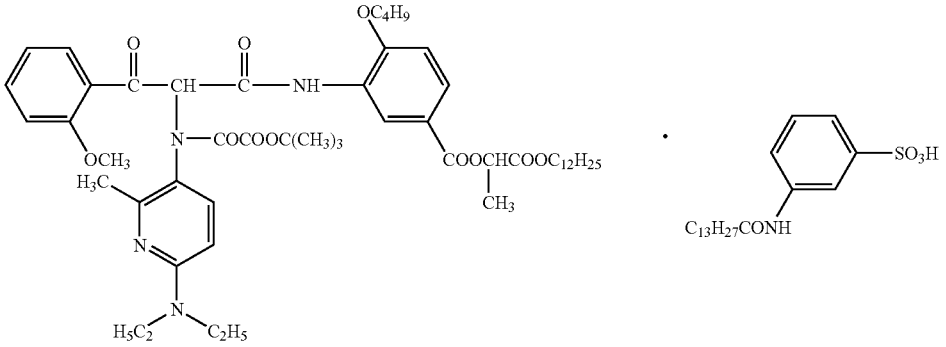
YL-13
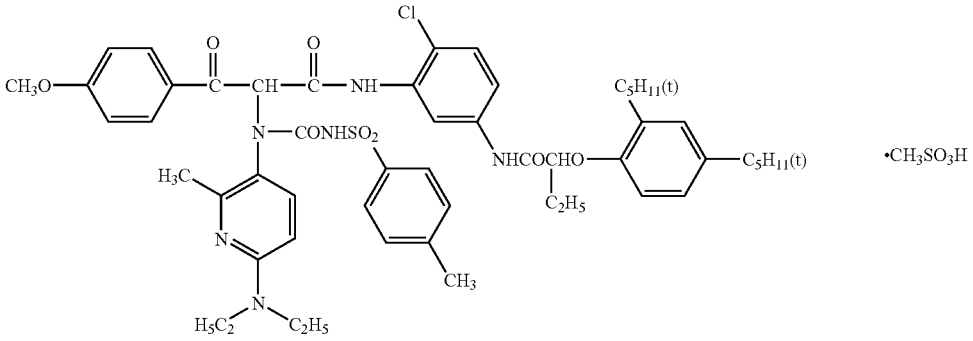

-continued
YL-14
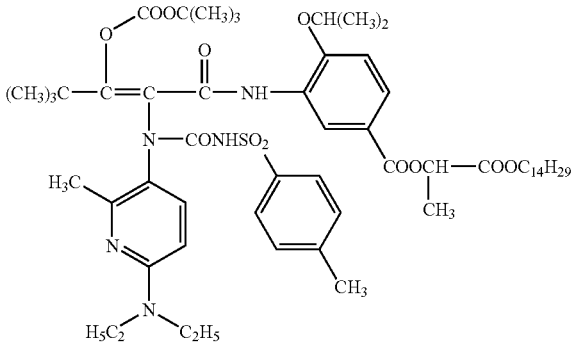
YL-15
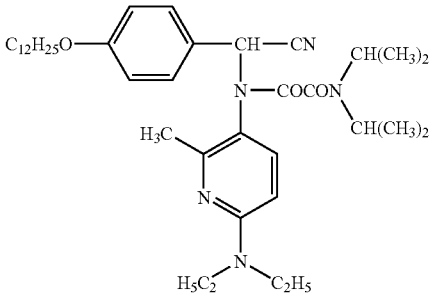
YL-16
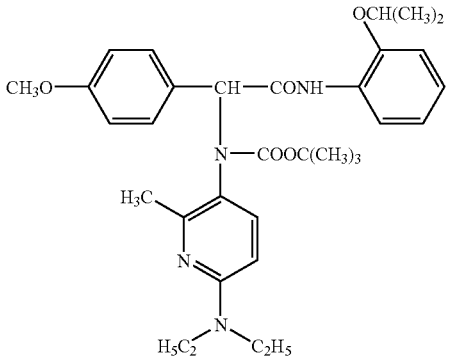
YL-17
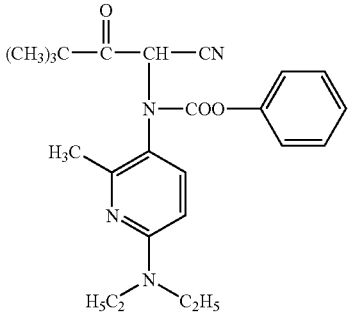
YL-18
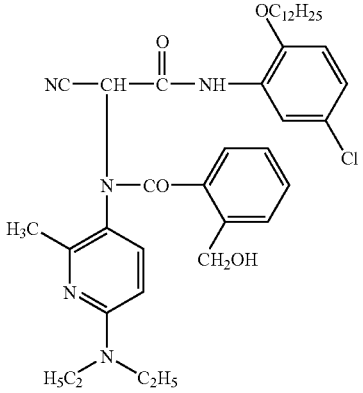
YL-19
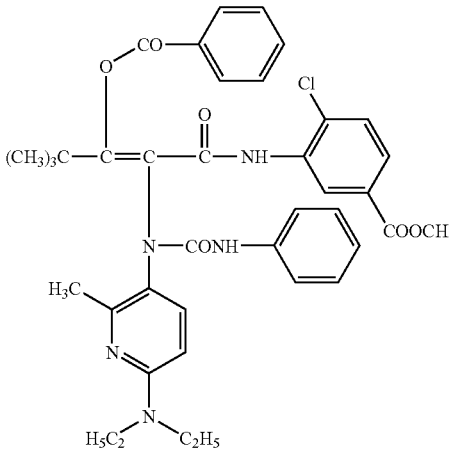
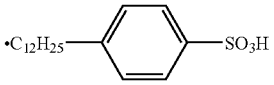

-continued
YL-20
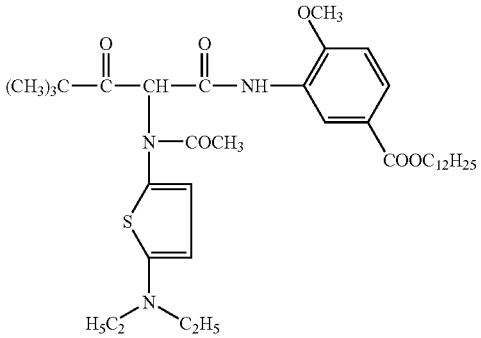
YL-21
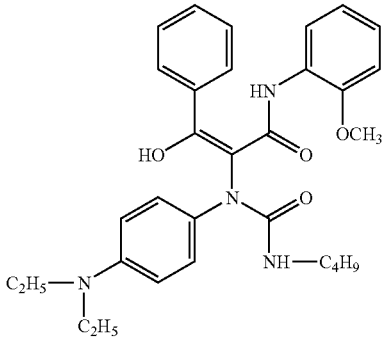
YL-22
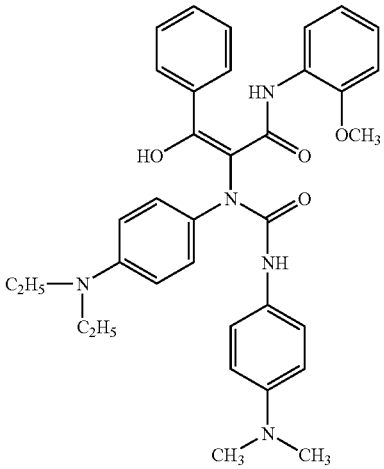
YL-23
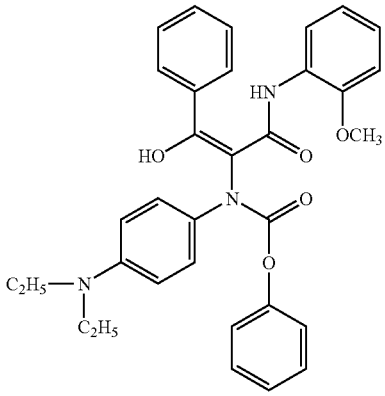
YL-24
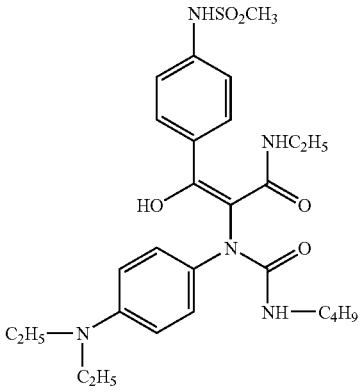
YL-25
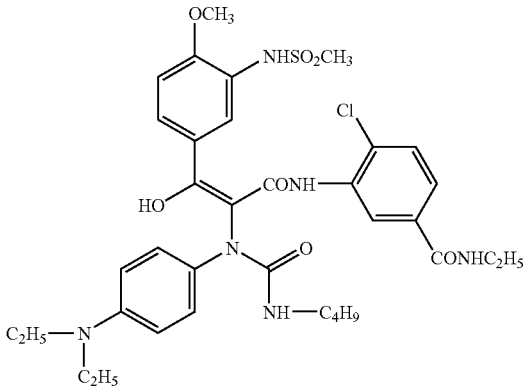
YL-26
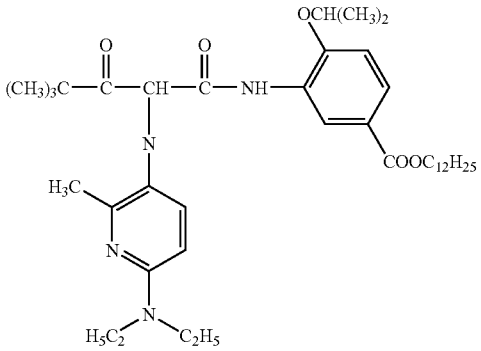
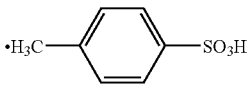

-continued
YL-27
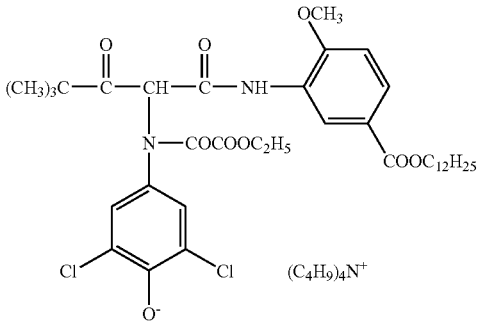
YL-28
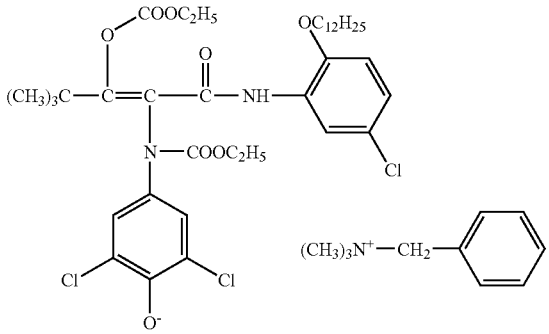
YL-29
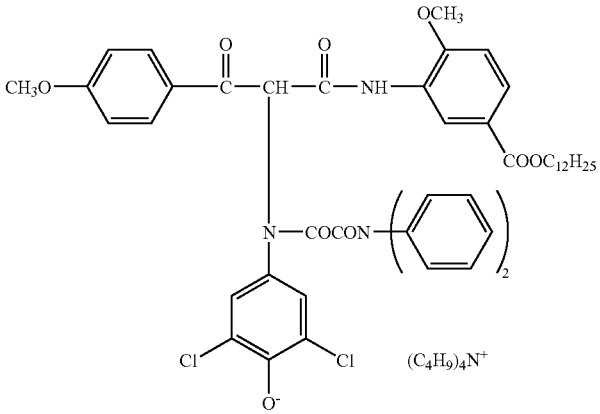
Another examples of leuco dyes which produce yellow colors are as follows. Each of these leuco dyes has no yellow coupler portion, however, they yield yellow due to a combination effect of a leuco dye and a developer.
YL-30
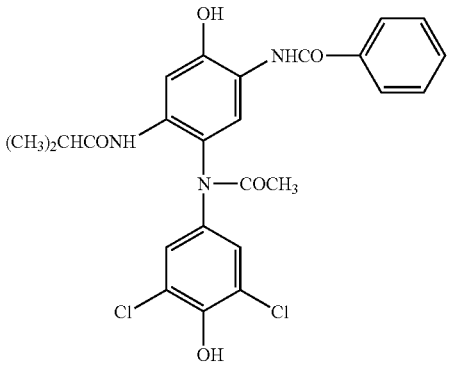
YL-31
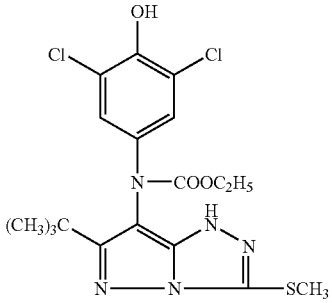
Among coupler groups represented by CP, magenta coupler groups include the following.
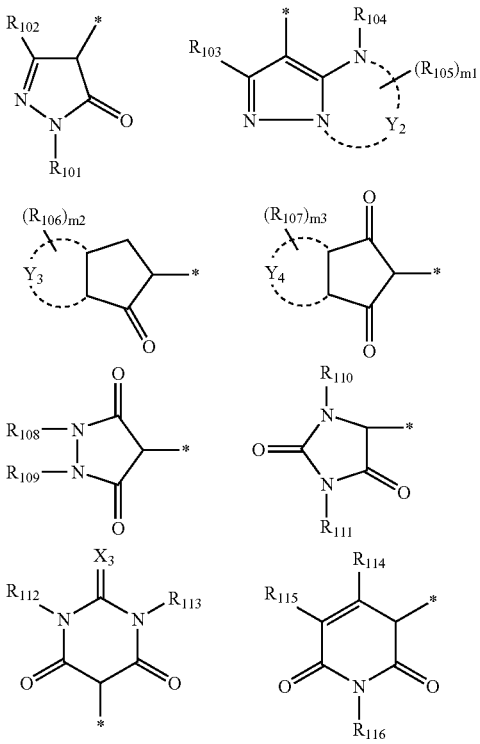

-continued

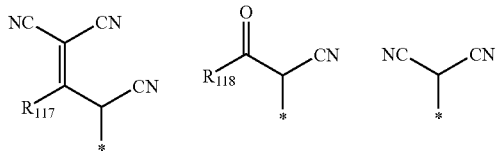

wherein, $R_{101}$ and $R_{102}$ represents a hydrogen atom or a substituent. $R_{103}$ represents a hydrogen atom, an alkyl group, an alkenyl group, an alkynyl group, an aryl group or a heterocyclic group. $R_{104}$ represents a hydrogen atom or a blocking group. $R_{105}$ represents a substituent, and m1 represents 0 or an integer of 1–3. $Y_2$ represents an atomic group necessary to form a 5- and 6-membered monocyclic or condensed cyclic nitrogen-containing heterocyclic ring together with two nitrogen atoms. $Y_3$ represents an atomic group necessary to form an aromatic ring. $R_{106}$ is identical with $R_{105}$, and m2 represents 0 or an integer of 1–10. $Y_4$ is identical with $Y_3$, $R_{107}$ is identical with $R_{106}$ and m3 is identical with m2. $R_{108}$ and $R_{109}$ represent a hydrogen atom or a substituent. $R_{110}$ and $R_{111}$ are identical with $R_{108}$ and $R_{109}$. $R_{112}$ and $R_{113}$ represents a hydrogen atom or a substituent, and $X_3$ represents an oxygen atom or a sulfur atom. $R_{114}$, $R_{115}$ and $R_{116}$ represents a hydrogen atom or a substituent, however $R_{115}$ never represents a cyano group. $R_{117}$ represents a hydrogen atom or a substituent. $R_{118}$ represents an aromatic ring group.

Substituents of $R_{101}$, $R_{102}$ and $R_{108}$–$R_{117}$ include the substituents listed as $R_{21}$–$R_{24}$ in the chemical structures of a cyan coupler group.

Alkyl groups, alkenyl groups, alkynyl groups, aryl groups and heterocyclic groups among the groups represented by $R_{103}$ include the alkyl groups, alkenyl groups, alkynyl groups, aryl groups and heterocyclic groups listed as $R_{21}$–$R_{24}$ in the chemical structures of a cyan coupler group.

Blocking groups of $R_{104}$ include the blocking groups listed as $R_{25}$ in the chemical structures of a cyan coupler group.

Heterocyclic rings formed by $Y_2$ include the heterocyclic rings listed as $Y_1$ in the chemical structures of a cyan coupler group.

Substituents represented by $R_{105}$ include the substituents listed as $R_{21}$–$R_{24}$ in the chemical structures of a cyan coupler group.

Aromatic rings represented by $Y_3$ and $R_{118}$ include such as a benzene ring, a naphthalene ring, a quinoline ring, a pyridine ring, a pyrimidine ring, a pyrrole ring, a furan ring and a thiophene ring.

Herein, in this invention, since a keto-enol tautomerism is possible when a carbonyl group is contained in a structure of a magenta coupler group, compounds in which an enol-form has been blocked are also included in this invention in the same manner as explained in a yellow coupler group. The blocking groups at this case include the blocking groups explained as $R_{25}$ in chemical structures of a cyan coupler group.

In the following, with respect to leuco dyes represented by General Formula (1), specific examples of CP (a coupler group) as a partial structure of a magenta coloring leuco dye are listed, however, this invention is not limited thereto.

CP-201

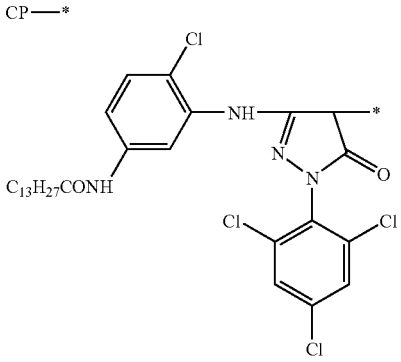

CP-202

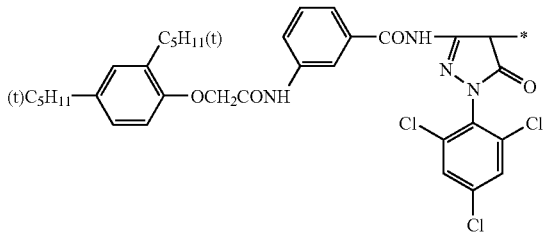

CP-203

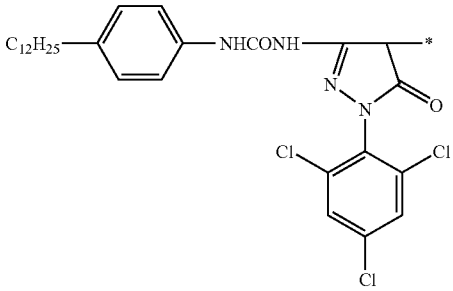

CP-204

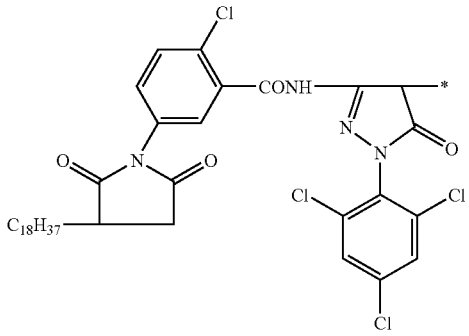

-continued
CP-205
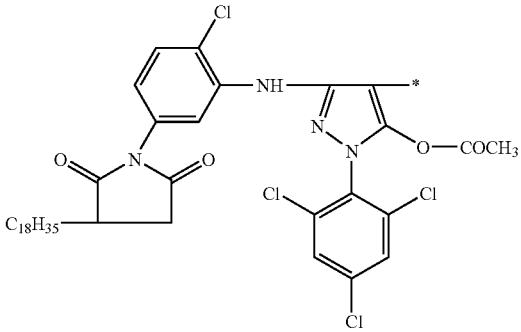
CP-206
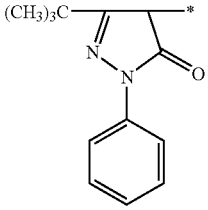
CP-207
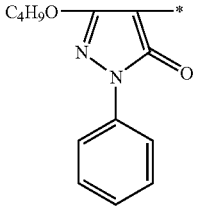
CP-208
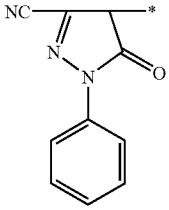
CP-209
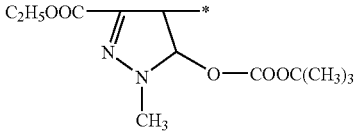
CP-210
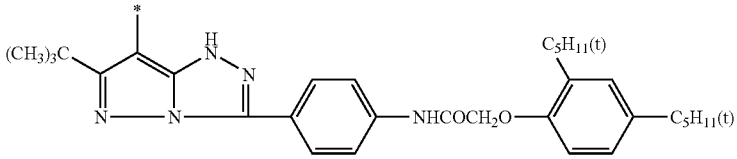
CP-211
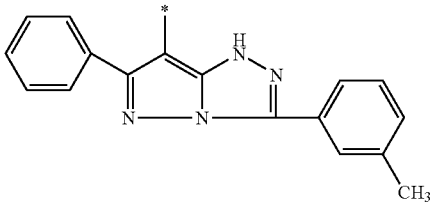
CP-212
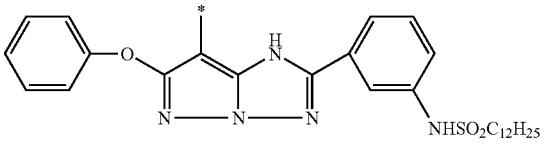
CP-213
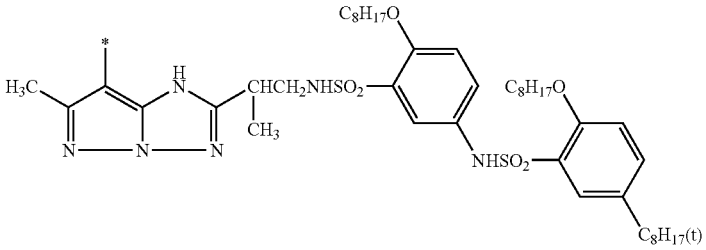
CP-214
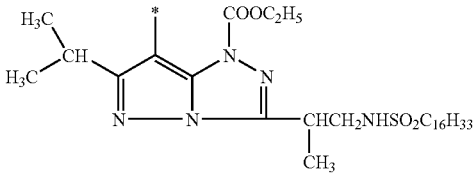
CP-215
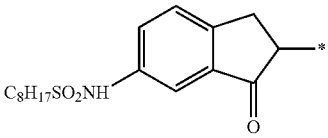

-continued
CP-216
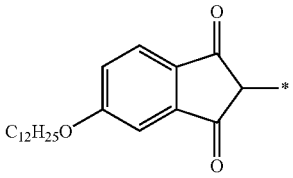
CP-217
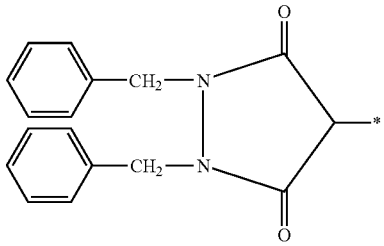
CP-218
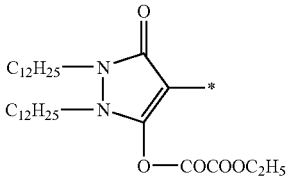
CP-219
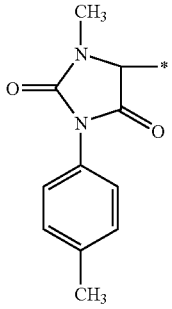
CP-220
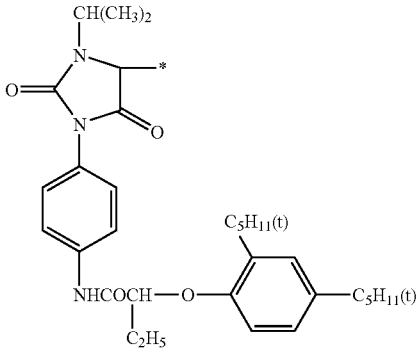
CP-221
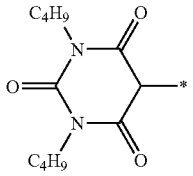
CP-222
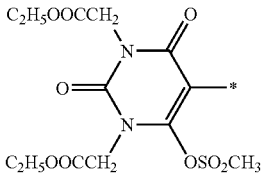
CP-223
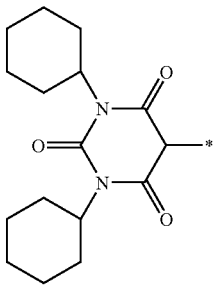
CP-224
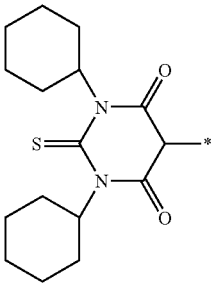
CP-225
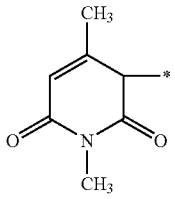

-continued
CP-226
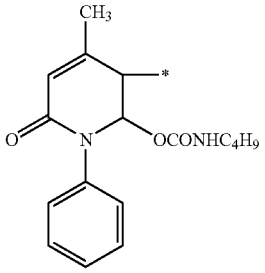
CP-227
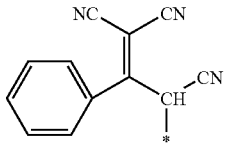
CP-228
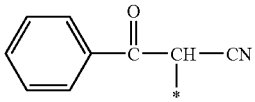
CP-229
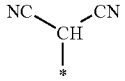
Examples of megenta leuco dyes represented by General Formula (1) are shown below. The leuco dyes of the present invention are not limited by these compounds.
ML-1
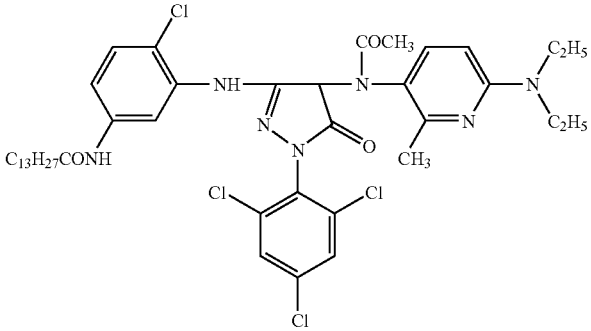
ML-2
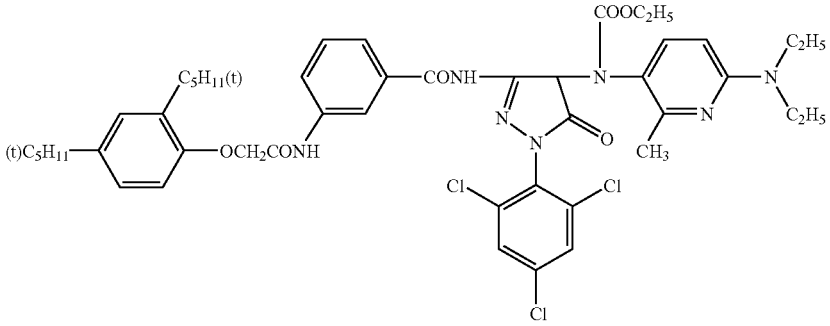
ML-3
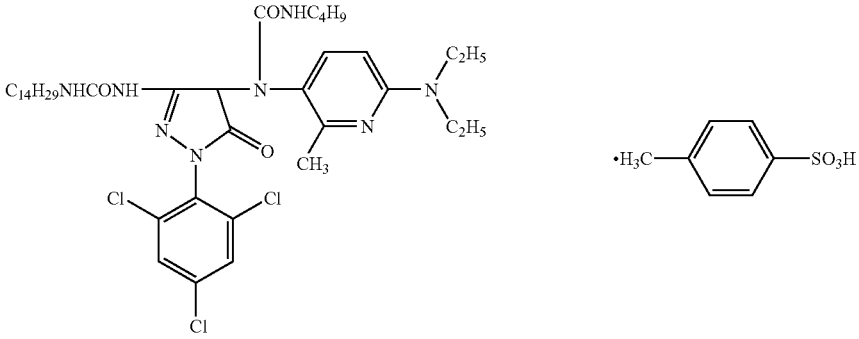

-continued
ML-4
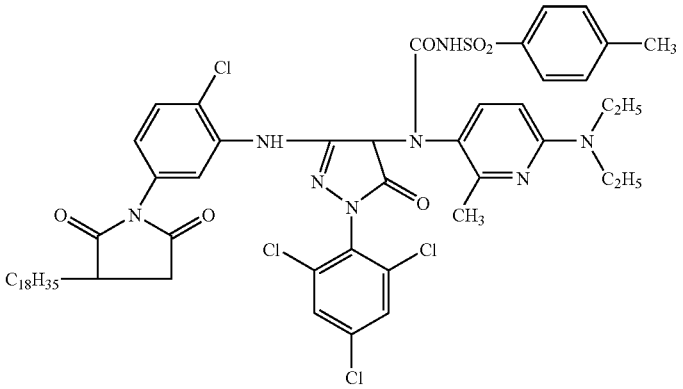
ML-5
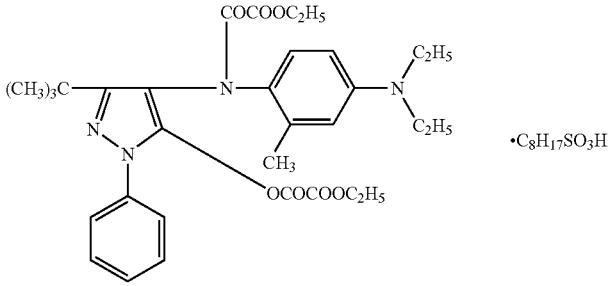
ML-6
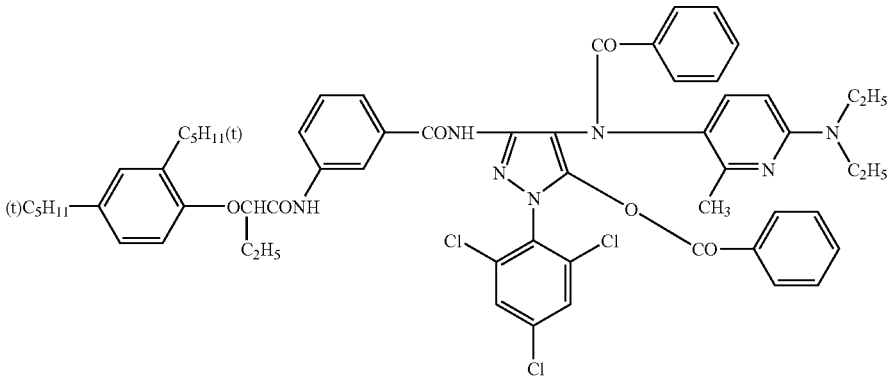
ML-7
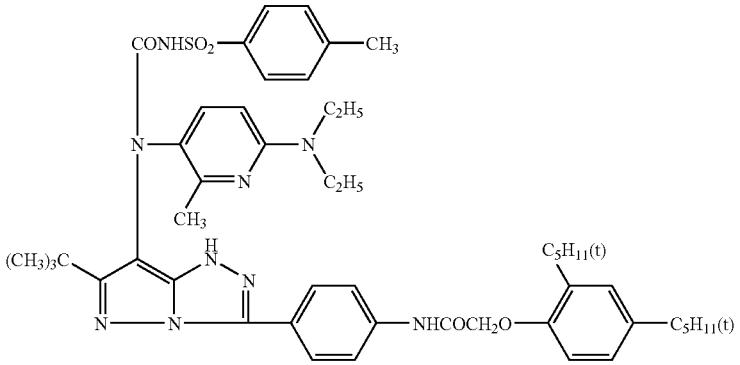

-continued
ML-8
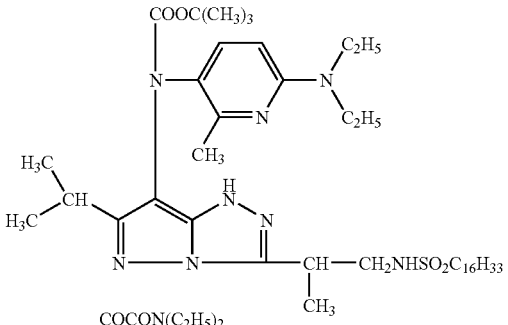
ML-9
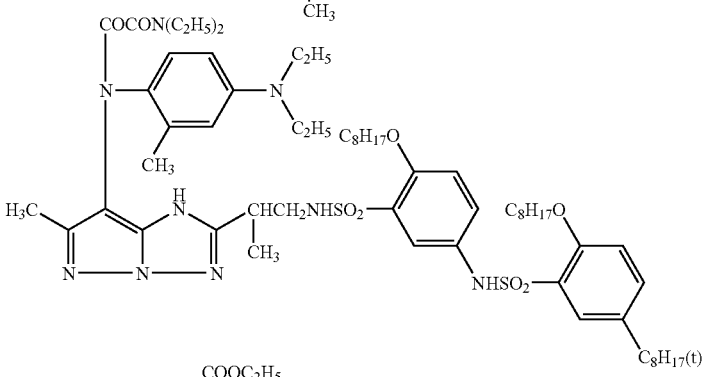
ML-10
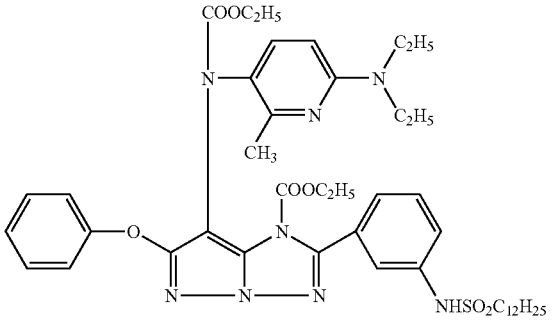
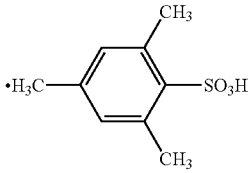
ML-11
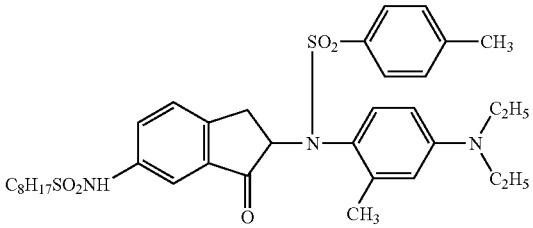
ML-12
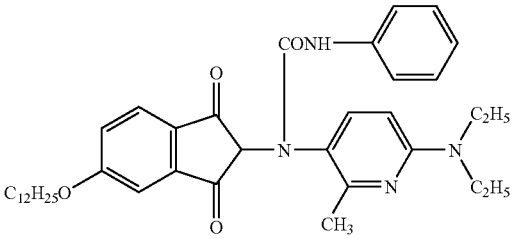
ML-13
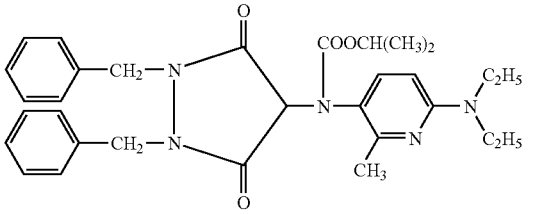
ML-14
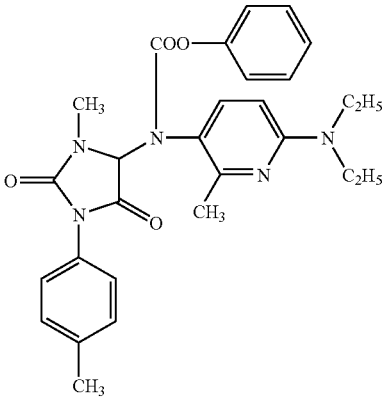

-continued
ML-15
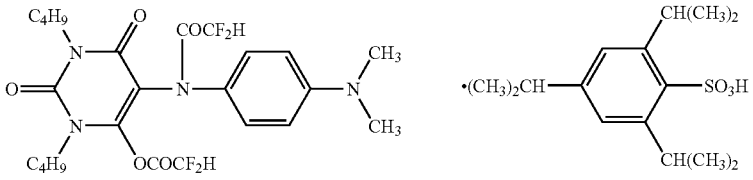
ML-16
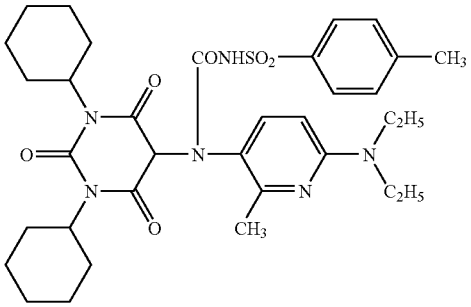
ML-17
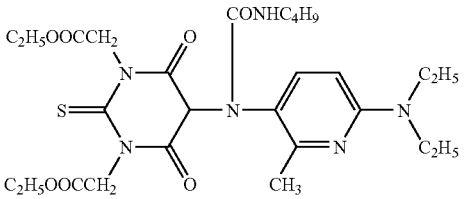
ML-18
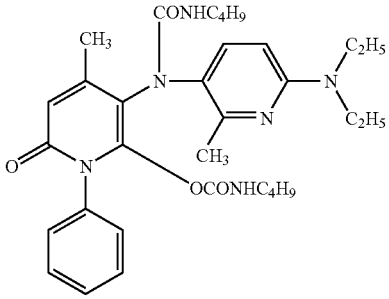
ML-19
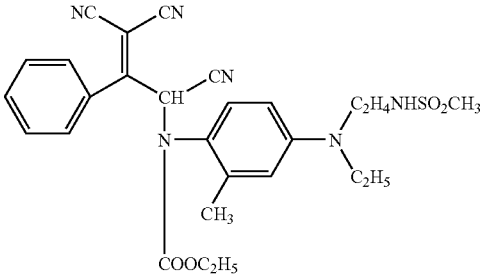
ML-20
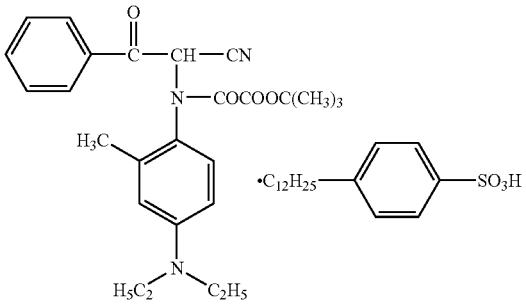
ML-21
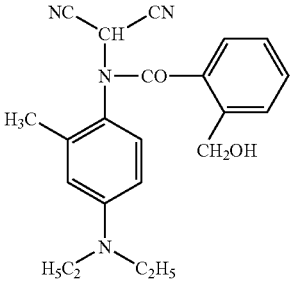
ML-22
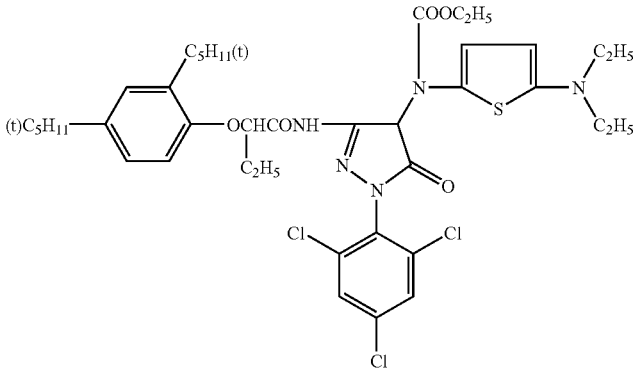

-continued

ML-23

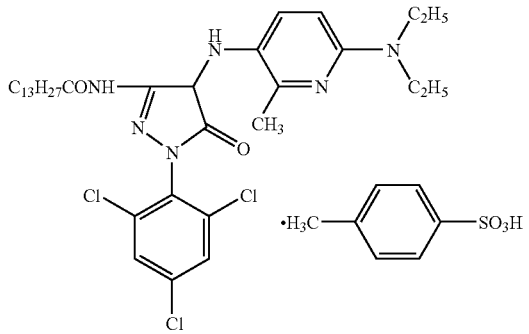

ML-24

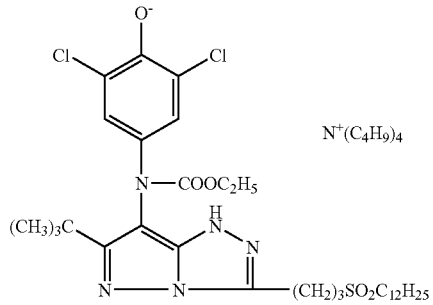

ML-25

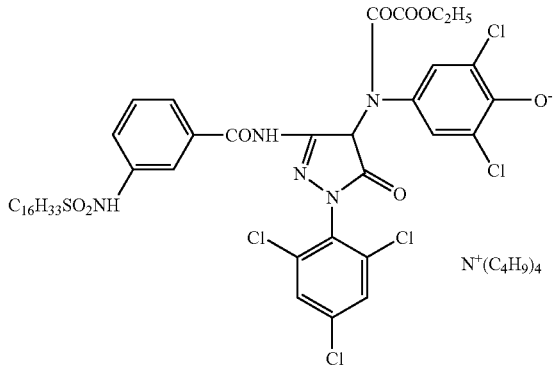

Leuco dyes represented by General Formula (1) can be synthesized referring to the methods described in JP-A No. 5-204087, Japanese Translated PCT Patent Publication Nos. 8-507885 and 10-502460, and JP-A No. 9-272809.

For example, after a yellow, magenta or cyan coupler represented by CP-$Z_4$ (CP is a coupler group and $Z_4$ is a hydrogen atom or a releasing group by coupling.) is coupling reacted with a developer represented by $H_2N$-D in the presence of an alkali and an oxidizing agent to synthesize a dye, said dye is reduced by means of contact hydrogen addition in the presence of a catalyst such as Pd/C, resulting in preparation of a leuco dye in which R of General Formula (1) is a hydrogen atom.

A leuco dye in which a blocking group is introduced as R can be prepared by the leuco dye prepared above further being reacted with a protecting reagent.

A protonated dye can be prepared by this dye being reacted with an appropriate acid (AH).

The addition amount of a yellow leuco dye or a cyan leuco dye among leuco dyes represented by General Formula (1) is generally 0.00001–0.05 mol/Ag mol, preferably 0.0005–0.02 mol/Ag mol and more preferably 0.001–0.01 mol/Ag mol. In this invention, the sum of maximum densities at the maximum absorption wavelength of a dye image formed by a yellow or cyan leuco dye is preferably set to be colored in a range of 0.01–0.50, more preferably 0.01–0.30 and specifically preferably 0.02–0.10.

The addition amount of a magenta leuco dye among leuco dyes represented by General Formula (1) is generally 0.000001–0.05 mol/Ag mol, preferably 0.00005–0.02 mol/Ag mol and more preferably 0.0001–0.01 mol/Ag mol. In this invention, the sum of maximum densities at the maximum absorption wavelength of a dye image formed by magenta leuco dyes is preferably set to be colored in a range of 0.001–0.50, more preferably 0.001–0.30 and specifically preferably 0.002–0.10.

Leuco dyes represented by General Formula (1) are preferably contained at least in one of a light-sensitive layer or light-insensitive layers on said light-sensitive layer side, and preferably at least in a light-sensitive layer.

Leuco dyes represented by General Formula (1) can be added in a light-sensitive layer or light-insensitive layers according to commonly known methods. That is, they may be added in a light-sensitive layer or light-insensitive layers by being dissolved in alcohols such as methanol and ethanol, ketones such as methyl ethyl ketone and acetone, or polar solvents such as dimethylsulfoxide and dimethylformamide. Further, they may be added by being formed into microparticles of not more than 1 μm, followed by being dispersed in water or organic solvents. Many techniques are disclosed with respect to microparticle dispersion techniques, and the dispersion can be performed according to these techniques.

Compounds represented by aforesaid General Formula (2) preferably utilized in this invention will now be explained. An electron withdrawing group represented by X is a substituent, Hammett's σp of which is positive. Specifically, listed are substituted alkyl groups (such as halogen-susbstituted alkyl), substituted alkenyl groups (such as cyanovinyl), substituted-and non-substituted alkynyl groups (such as trifluoroacetylenyl, cyanoacetylenyl and formylacetylenyl), substituted aryl groups (such as cyanophenyl), substituted and non-substituted heterocyclic groups (pyridyl, triazinyl and benzooxazolyl), a halogen atom, a cyano group, acyl groups (such as acetyl, trifluoroacetyl and formyl), thioacyl groups (such as thioformyl and thioacetyl), oxalyl groups (such as methyloxalyl), oxyoxalyl groups (such as ethoxalyl), —S-oxalyl groups (such as ethylthiooxalyl), oxamoyl groups (such as methyloxamoyl), oxycarbonyl groups (such as ethoxycarbonyl and carboxyl), —S-carbonyl groups (such as ethylthiocarbonyl), a carbamoyl group, a thiocarbamoyl group, a sulfonyl group, a sulfinyl group, oxysulfonyl groups (such as ethoxysulfonyl), —S-sulfonyl groups (such as ethylthiosulfonyl), a sulfamoyl group, oxysulfinyl groups (such as methoxysulfinyl), —S-sulfinyl groups (such as methylthiosulfinyl), a sulfinamoyl group, a phosphoryl group, a nitro group, imino groups (such as imino, N-methylimino, N-phenylimino, N-pyridylimino, N-cyanoimino and N-nitroimino), N-carbonylimino groups (such as. N-acetylimino, N-ethoxycarbonylimino, N-ethoxalylimino, N-formylimino, N-trifluoroacetylimino and N-carbamoylimino), N-sulfonylimino groups (such as N-methanesulfonylimino, N-trifluoromethanesulfonylimino, N-methoxysulfonylimino and N-sulfamoylimino), an ammonium group, a sulfonium group, a phosphonium group, a pyrilium group or an immonium group, and also listed are heterocyclic groups in which rings are formed by such as an ammonium group, a sulfonium group, a phosphonium group and an immonium group. The σp value is preferably not less than 0.2 and more preferably not less than 0.3.

W includes a hydrogen atom, alkyl groups (such as methyl, ethyl and trifluoromethyl), alkenyl groups (such as vinyl, halogen substituted vinyl and cyano vinyl), alkynyl groups (such as acetylenyl and cyanoacetylenyl), aryl groups (such as phenyl, chlorophenyl, nitrophenyl, cyanophenyl and pentafluorophenyl), a heterocyclic group (such as pyridyl, pyrimidyl, pyrazinyl, quinoxalinyl, triazinyl, succineimido, tetrazonyl, triazolyl, imidazolyl and benzooxazolyl), in addition to these, also include those explained in aforesaid X such as a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrilium group and an immonium group.

Preferable as W are also aryl groups and heterocyclic groups as described above, in addition to electron withdrawing groups having a positive Hammett's substituent constant σp.

X and W may form a ring structure by bonding to each other. Rings formed by X and W include a saturated or unsaturated carbon ring or heterocyclic ring, which may be provided with a condensed ring, and also a cyclic ketone. Heterocyclic rings are preferably those having at least one atom among N, O, and S and more preferably those containing one or two of said atoms.

$R_1$ includes a hydroxyl group or organic or inorganic salts of the hydroxyl group. Specific examples of alkyl groups, alkenyl groups, alkynyl groups, aryl groups and heterocyclic groups represented by $R_2$ include each example of alkyl groups, alkenyl groups, alkynyl groups, aryl groups and heterocyclic groups exemplified as W.

Further, in this invention, any of X, W and $R_2$ may contain a ballast group. A ballast group means a so-called ballast group in such as a photographic coupler, which makes the added compound have a bulky molecular weight not to migrate in a coated film of a light-sensitive material.

Further, in this invention, X, W and $R_2$ may contain a group enhancing adsorption to a silver salt. Groups enhancing adsorption to a silver salt include a thioamido group, an aliphatic mercapto group, an aromatic mercapto group, a heterocyclic mercapto group, and each group represented by 5- or 6-membered nitrogen-containing heterocyclic rings such as benzotriazole, triazole, tetrazole, indazole, benzimidazole, imidazole, benzothiazole, thiazole, benzoxazole, oxazole, thiadiazole, oxadiazole and triazine.

In this invention, it is preferred that at least one of X and W represents a cyano group, or X and W form a cyclic structure by bonding to each other.

Further, in this invention, preferable are compounds in which a thioether group (—S—) is contained in the substituents represented by X, W and $R_2$.

Further, preferable are those in which at least one of X and W is provided with an alkene group represented by following General Formula (2a).

$$—C(R_{201})=C(Y_{11})(Z_{11}) \qquad \text{General Formula (2a)}$$

wherein, $R_{201}$ represents a hydrogen atom or a substituent, $Y_{11}$ and $Z_{11}$ each represent a hydrogen atom or a substituent, however, at least one of $Y_{11}$ and $Z_{11}$ represents an electron withdrawing group.

Examples of electron withdrawing groups among the substituents represented by $Y_{11}$ and $Z_{11}$ include the aforesaid electron withdrawing groups listed as X and W, such as a cyano group and a formyl group.

X and W represented by above General Formula (2a) include, for example, the following groups.

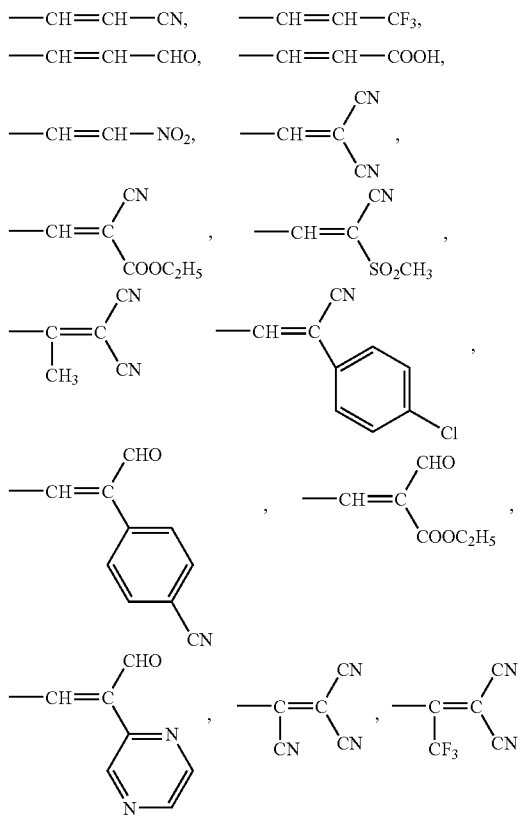

Further, preferable are those in which at least one of X and W is provided with alkyne groups described below.

$$—C≡C—R_{202}$$

$R_{202}$ represents a hydrogen atom or a substituent, and the substituent is preferably an electron withdrawing group such as those listed in the aforesaid X and W. X and W represented by the above General Formula include the following groups.

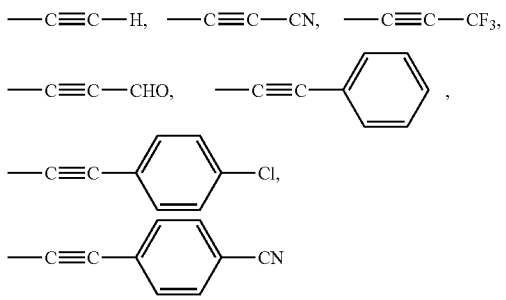

Further, at least one of X and W is preferably provided with an acyl group selected from a substituted alkylcarbonyl group, alkenylcarbonyl group and alkynylcarbonyl group, and X and W, for example, include the following groups.

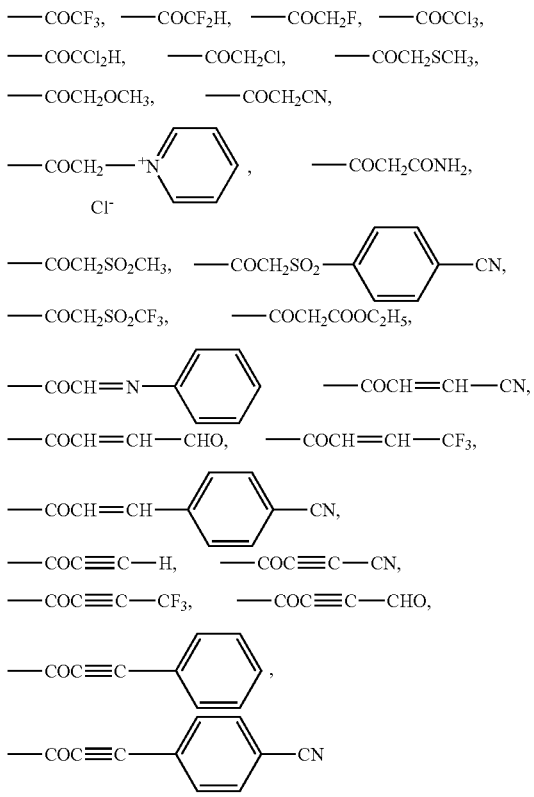

Further, at least one of X and W is preferably provided with an oxalyl group, and X and W provided with an oxalyl group include the following groups:

—$COCOCH_3$, —$COCOOC_2H_5$, —$COCONHCH_3$, —$COCOSC_2H_5$ and $COCOOC_2H_4SCH_3$.

Further, at least one of X and W is also preferably provided with an aryl group of a nitrogen containing hetrocyclic group substituted by an electron withdrawing group, and such X and W, for example, include the following groups.

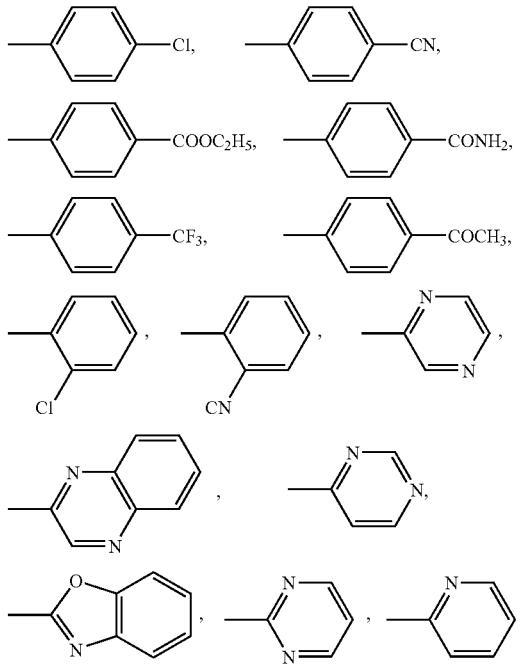

In this invention, alkene compounds represented by General Formula (2) include every isomers when they can take isomeric structures with respect to a double bond, where X, W, $R_1$ and $R_2$ substitute, and also include every isomers when they can take tautomeric structures such as a keto-enol form.

In the following, specific examples of compounds represented by General Formula (2) will be described, however, this invention is not limited thereto.

2-1

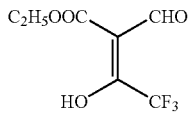

2-2

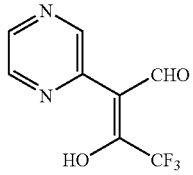

2-3

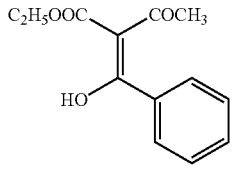

2-4

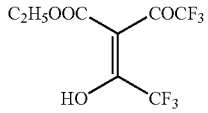

-continued
2-5
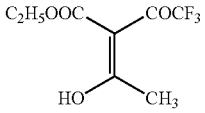
2-6
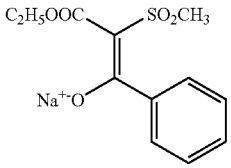
2-7
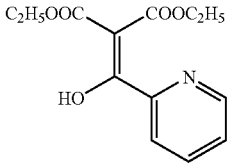
2-8
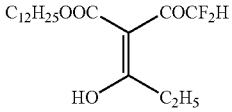
2-9
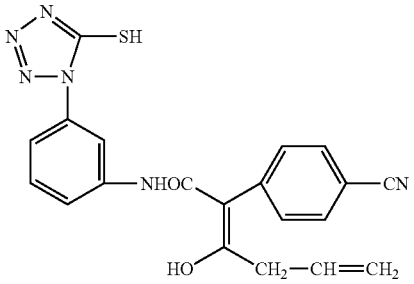
2-10
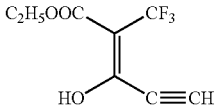
2-11
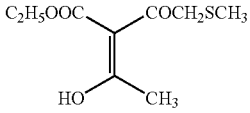
2-12
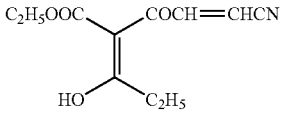
2-13
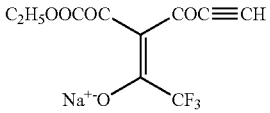
2-14
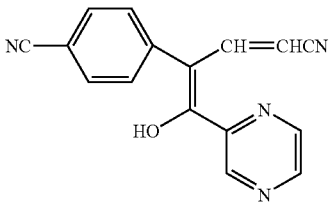
-continued
2-15
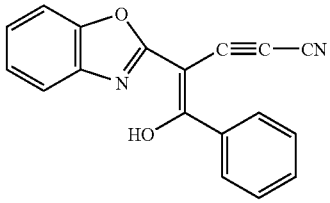
2-16
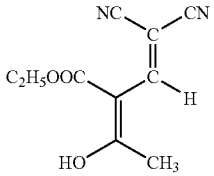
2-17
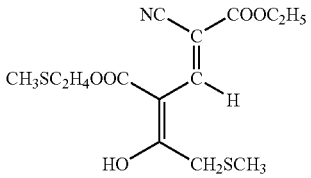
2-18
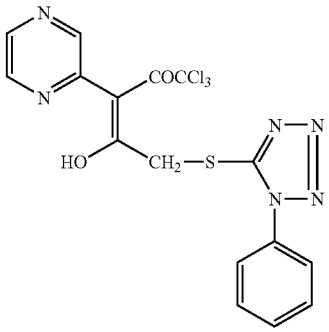
2-19
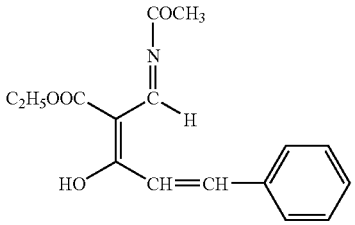
2-20
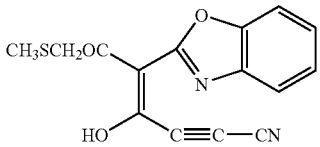
2-21
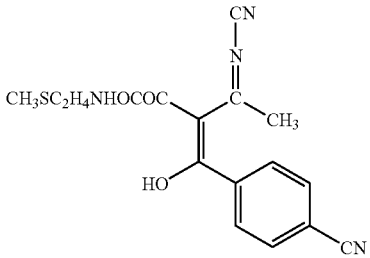

-continued
2-22
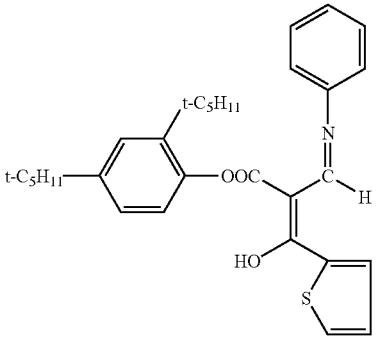
2-23
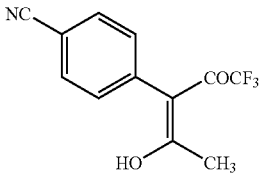
2-24
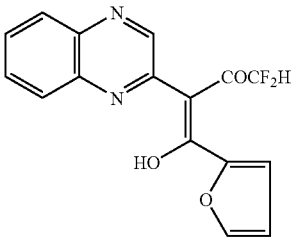
2-25
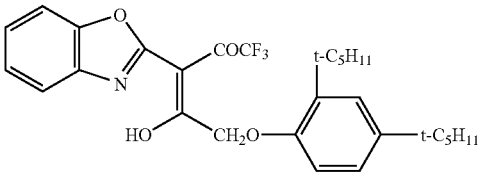
2-26
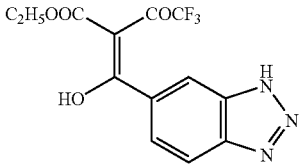
2-27
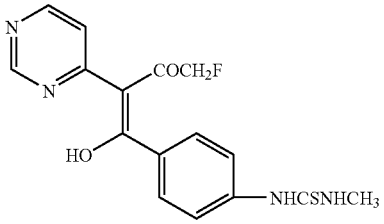
2-28
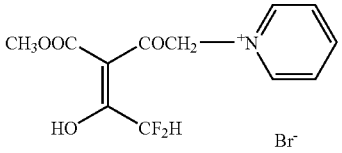
-continued
2-29
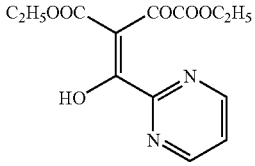
2-30
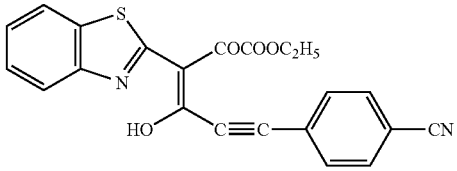
2-31
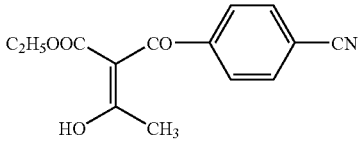
2-32
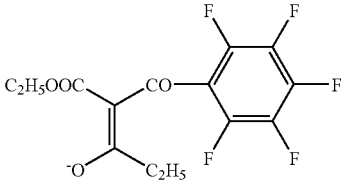
$(C_2H_5)N^+H$
2-33
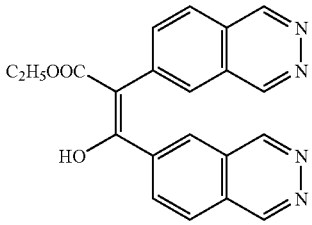
2-34
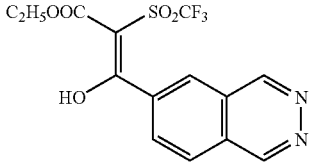
2-35
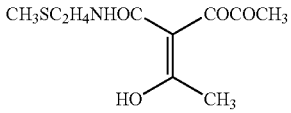
2-36
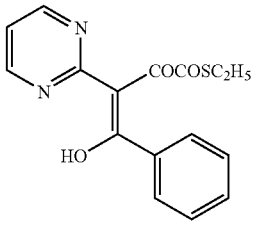

-continued
2-37
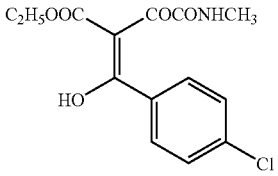
2-38
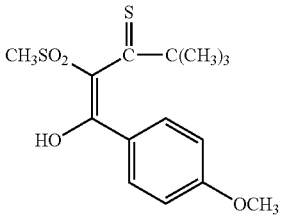
2-39
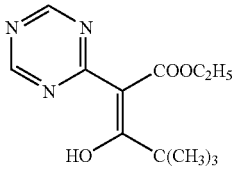
2-40
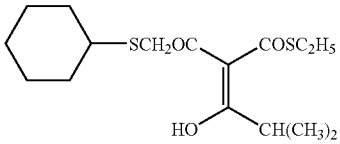
2-41
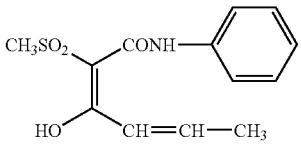
2-42
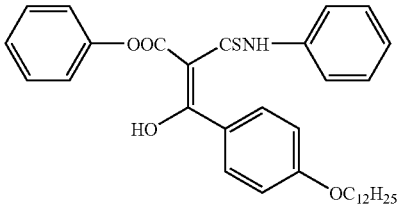
2-43
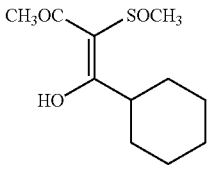
2-44
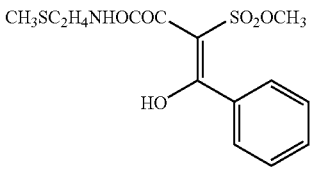
-continued
2-45
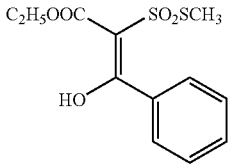
2-46
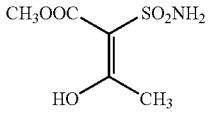
2-47
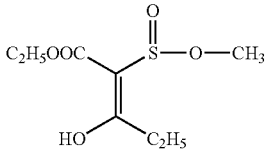
2-48
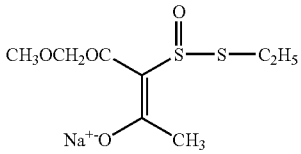
2-49
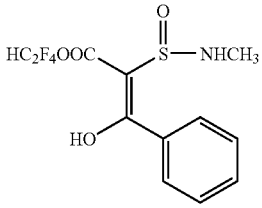
2-50
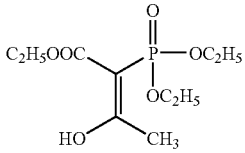
2-51
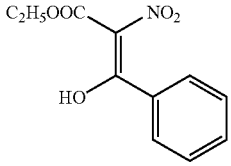
2-52
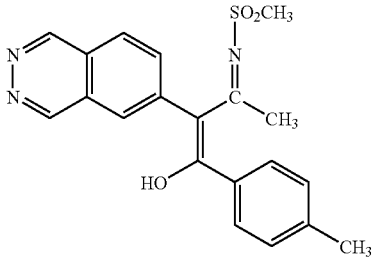

-continued
2-53
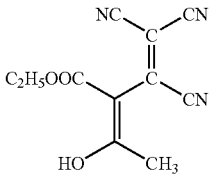
2-54
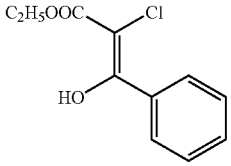
2-55
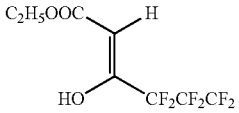
2-56
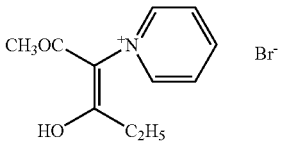
2-57
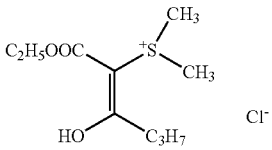
2-58
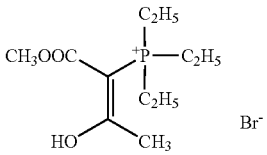
2-59
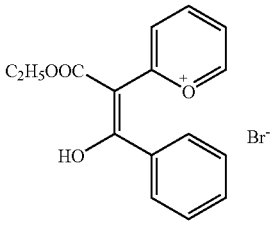
2-60
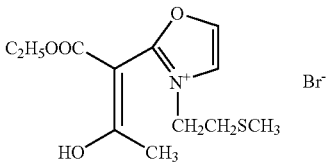
2-61
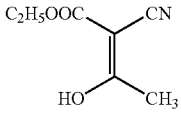
-continued
2-62
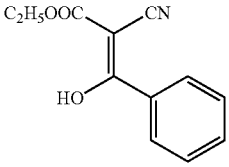
2-63
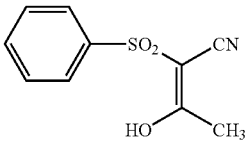
2-64
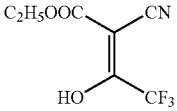
2-65
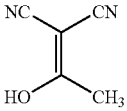
2-66
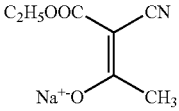
2-67
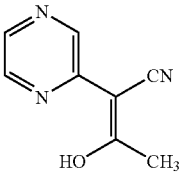
2-68
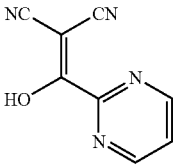
2-69
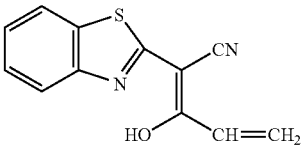
2-70
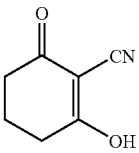
2-71
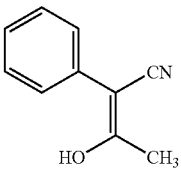

-continued
2-72
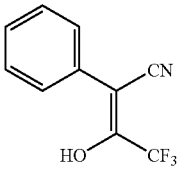
2-73
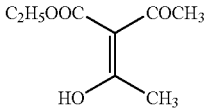
2-74
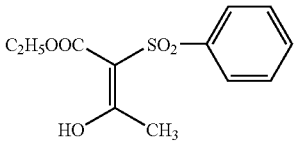
2-75
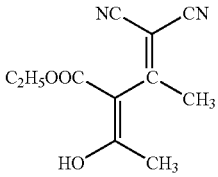
2-76
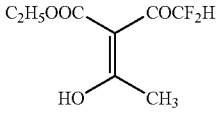
2-77
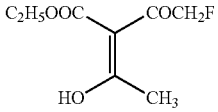
Next, in General Formula (2), described will be specific examples in this X and W form a cyclic structure by bonding to each other.
2-101
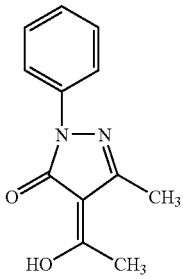
2-102
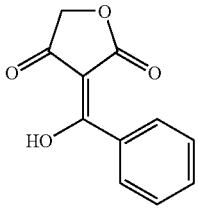
-continued
2-103
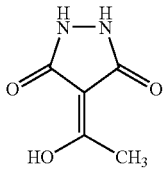
2-104
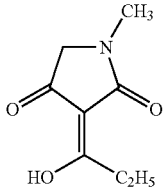
2-105
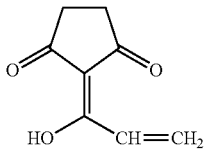
2-106
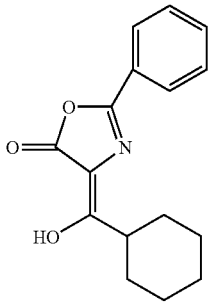
2-107
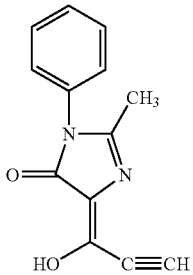
2-108
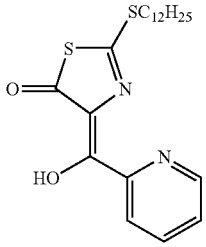
2-109
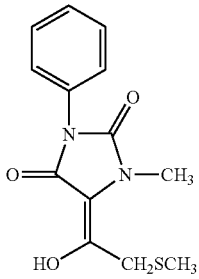

-continued
2-110
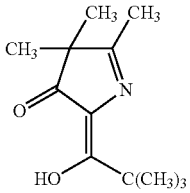
2-111
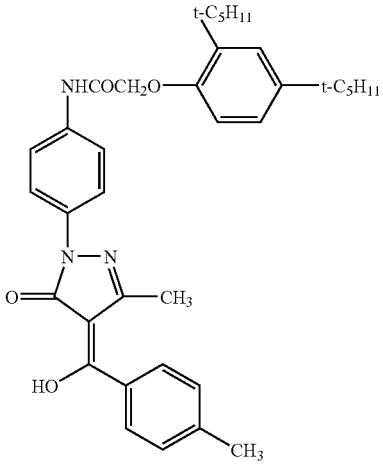
2-112
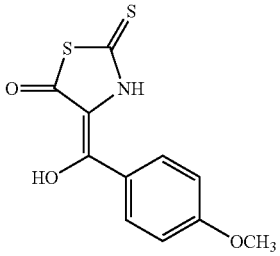
2-113
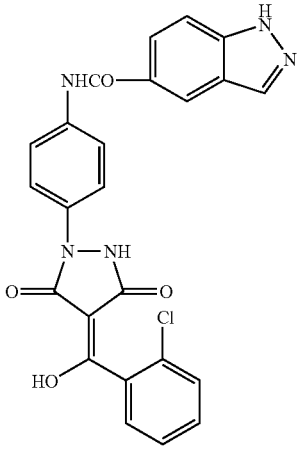
2-114
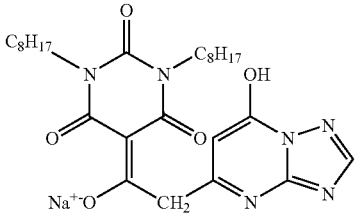
-continued
2-115
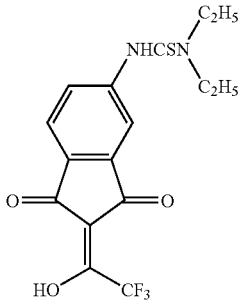
2-116
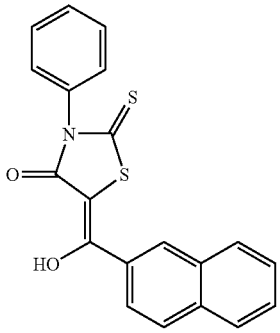
2-117
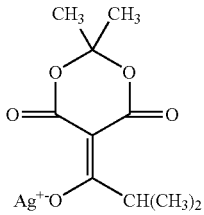
2-118
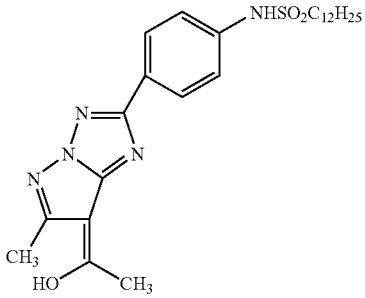
2-119
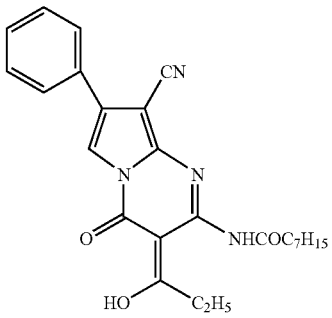

-continued
2-120
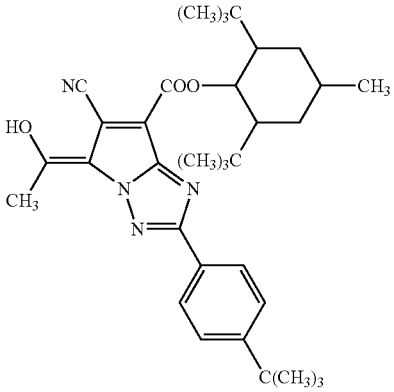
2-121
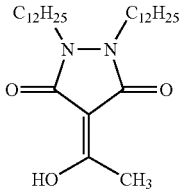
2-122
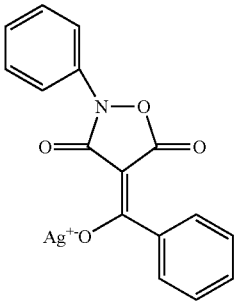
2-123
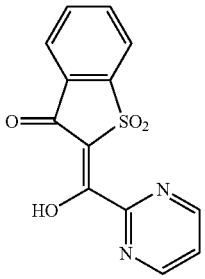
2-124
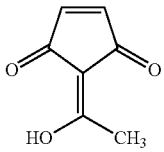
2-125
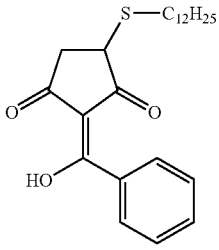
-continued
2-126
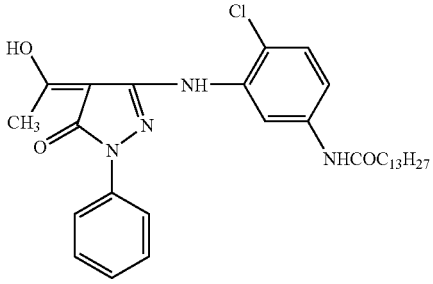
2-127
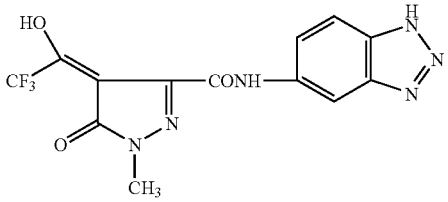
2-128
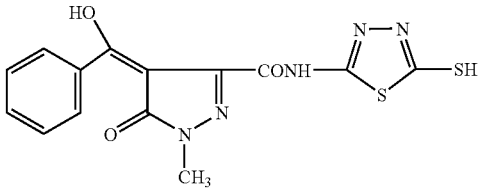
2-129
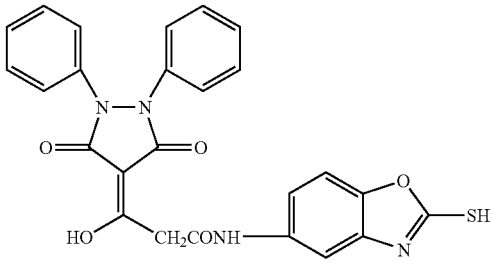
2-130
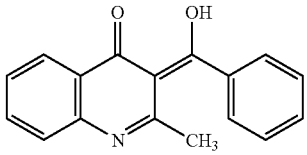
2-131
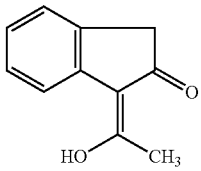
2-132
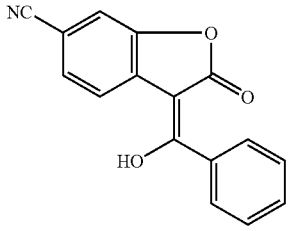

-continued 2-133

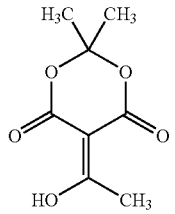

2-134

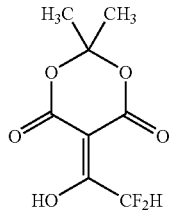

2-135

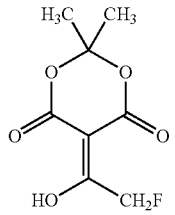

2-136

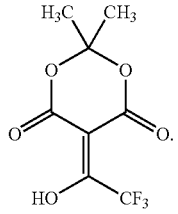

Compounds represented by General Formula (2) of this invention can be synthesized by various methods, and they can be synthesized by referring to, for example, a method described in Japanese Translated PCT Patent Publication No. 2000-515995.

Example compound (2)-5 can be synthesized, for example, by the following rout.

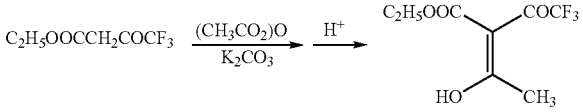

Other compounds represented by General Formula (2) can be synthesized in a similar manner.

The compound represented by General Formula (2) is incorporated at least in one of a light-sensitive layer and light-insensitive layers on said light-sensitive layer side, of a thermally developable light-sensitive material, and preferably at least in a light-sensitive layer. The addition amount of compounds represented by General Formula (2) is preferably $1\times10^{-8}$–1 mol/Ag mol, more preferably $1\times10^{-6}$–$1\times10^{-1}$ mol/Ag mol and most preferably $1\times10^{-4}$–$1\times10^{-2}$ mol/Ag mol.

The compound represented by General Formula (2) can be added in a light-sensitive layer or a light-insensitive layer according to commonly known methods. That is, they can be added in light-sensitive layer or light-insensitive layer coating solution by being dissolved in alcohols such as methanol and ethanol, ketones such as methyl ethyl ketone and acetone, and polar solvents such as dimethylsulfoxide and dimethylformamide. Further, they can be added also by being made into micro-particles of not more than 1 μm followed by being dispersed in water or in an organic solvent. As for microparticle dispersion techniques, many techniques have been disclosed and the compound can be dispersed according to these techniques.

Compounds represented by General Formula (3), preferably utilized in this invention, will now be explained.

Alkyl groups represented by $R_3$ include straight chain, branched and cyclic groups, and include each group of such as methyl, ethyl, n-propyl, i-propyl, n-butyl, t-butyl, n-pentyl, n-hexyl, cyclohexyl, 2-ethylhexyl, t-octyl, n-decyl, n-dodecyl and n-hexadecyl group.

Alkenyl groups represented by $R_3$ include, for example, each group of such as vinyl, allyl and crotyl group.

Alkynyl groups represented by $R_3$ include, for example, each group of such as ethynyl and 1-propynyl group.

Aryl groups represented by $R_3$ include, for example, each group of such as phenyl and naphtyl group.

Heterocyclic groups represented by $R_3$ include, for example, each group of such as pyridyl, pyrimidyl, pyradinyl, triazinyl, imidazolyl, benzoxazolyl, furyl, thienyl, tetrahydrofuryl, piperidinyl and pyrrolidyl group.

Each group of alkyl, alkenyl, alkynyl, aryl and heterocyclic may be further provided with a substituent, and the substituents include each group of such as alkyl, alkenyl, alkynyl, aryl, heterocyclic, halogen, hydroxyl, alkoxy, aryloxy, nitro, amino, acylamino, sulfonylamino, sulfonyl, carboxy, alkoxycarbonyl, aryloxycarbonyl, carbamoyl, sulfamoyl, cyano and sulfo group.

$X_1$ represents a substituent and specifically includes those listed as the substituents to each group of alkyl, alkenyl, alkynyl, aryl and heterocyclic group, represented by aforesaid $R_3$.

In the following, described are specific examples of compounds represented by General Formula (3), however, this invention is not limited thereto.

3-1

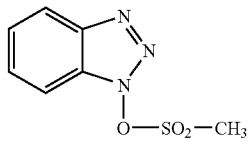

3-2

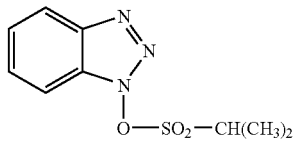

3-3

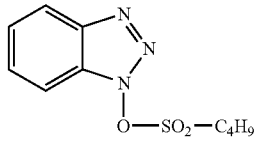

-continued
3-4
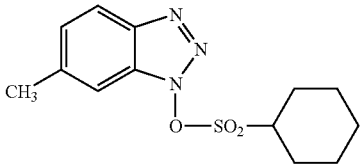
3-5
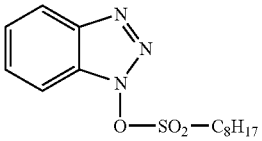
3-6
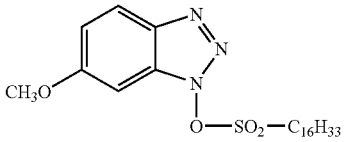
3-7
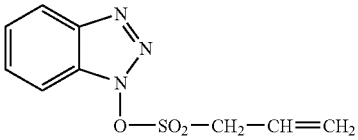
3-8
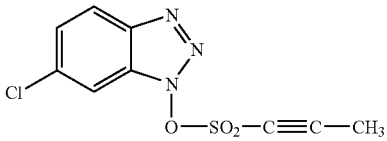
3-9
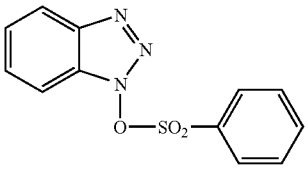
3-10
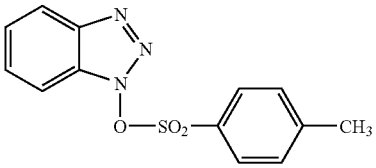
3-11
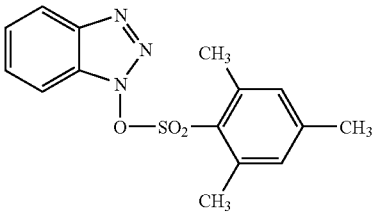
3-12
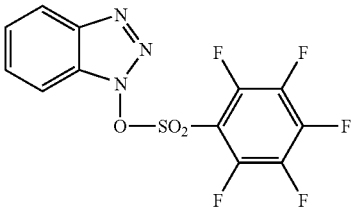
-continued
3-13
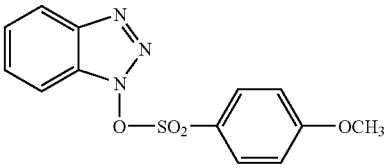
3-14
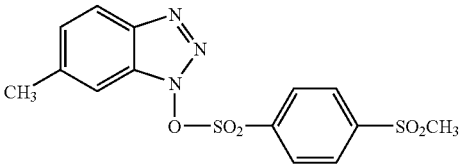
3-15
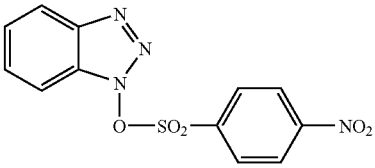
3-16
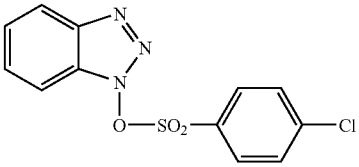
3-17
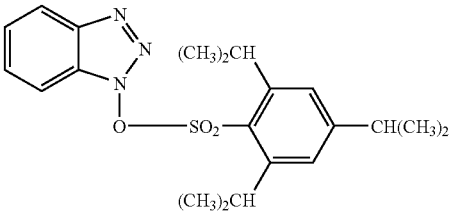
3-18
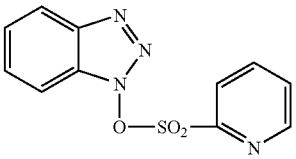
3-19
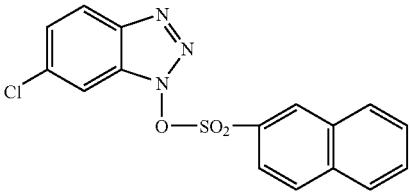
3-20
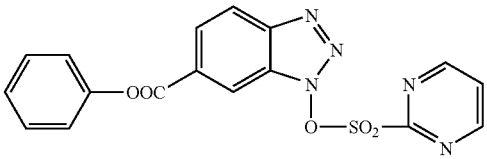

-continued 3-21

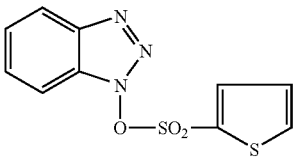

3-22

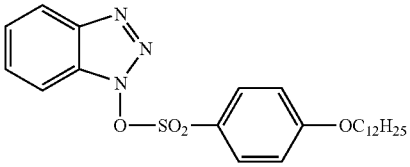

3-23

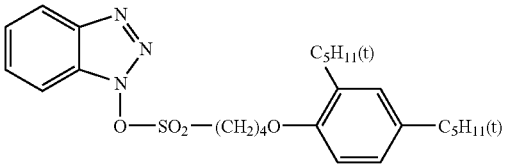

3-24

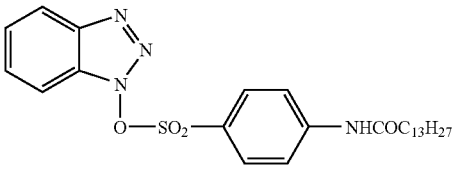

3-25

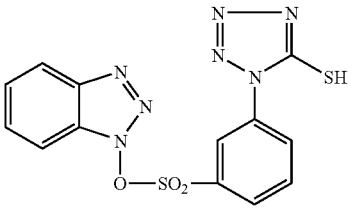

3-26

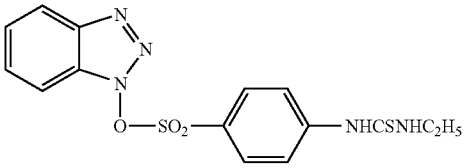

3-27

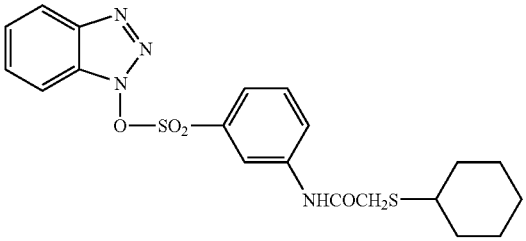

-continued 3-28

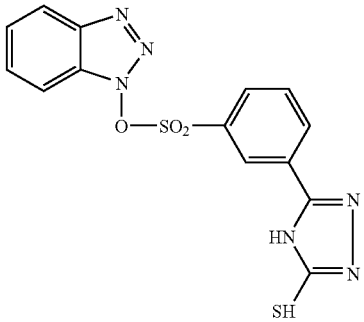

3-29

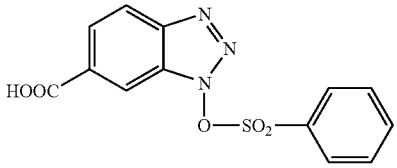

3-30

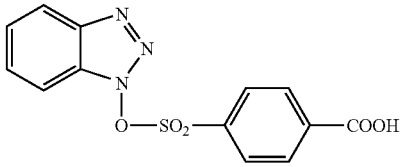

Compounds represented by General Formula (3) of this invention can be synthesized by the following method.

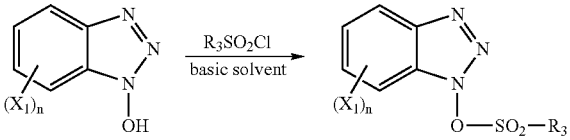

According to the above scheme, compounds represented by General Formula (3) can be synthesized by reacting a hydroxybenzotriazole derivative and a sulfonylchloride derivative in a solvent such as acetonitrile, acetone, tetrahydrofurane, ethyl acetate, toluene and N,N-dimethylformamide in the presence of a basic catalyst such as triethylamine, pyridine and potassium carbonate.

Next compounds represented by General Formula (4) will be explained.

Examples of nitrogen-containing heterocyclic rings formed by Q includes such as pyrrole, indole, imidazole, benzimidasole, pyrazole, carbazole, 1,2,3-triazole, 1,2,4-triazole, tetrazole, benzotriazole, indazole, indazole, purine, phenoxazine, phenothiazine, imidazolidine, pyrazolidine and thiazoline and more preferable are such as benzotriazole, 1,2,3-triazole, 1,2,4-triazole, indazole, benzimidazole, tetrazole and thiazoloine.

Nitrogen-containing heterocyclic rings formed by Q may be further provided with a substituent, and the substituents include the same substituents for $X_1$ of General Formula (3).

J represents —$SO_2$—, —CO—, —COO— or —CON($R_5$)—, wherein $R_5$ represents a hydrogen atom or a substituent, and the substituents include each group of alkyl, alkenyl, alkynyl, aryl and heterocyclic and specifically the groups listed in $R_3$ of General Formula (3).

In the following, specific examples of the compounds represented by General Formula (4) will be described, however, this invention is not limited thereto.
4-1
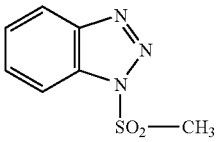
4-2
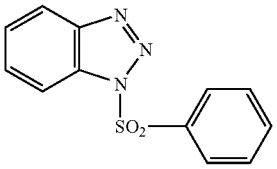
4-3
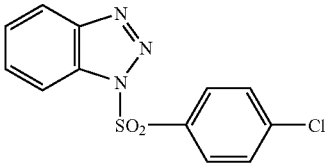
4-4
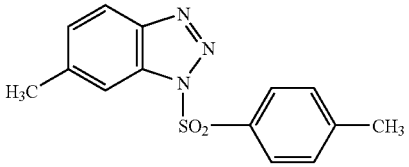
4-5
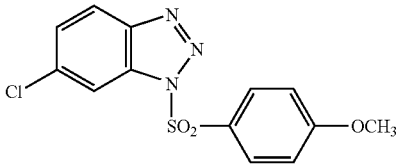
4-6
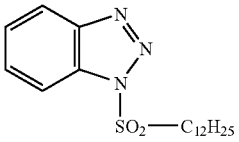
4-7
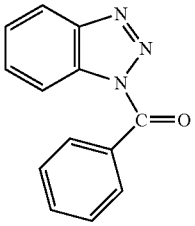
4-8
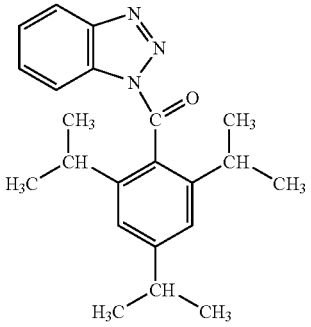
-continued
4-9
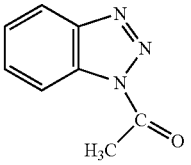
4-10
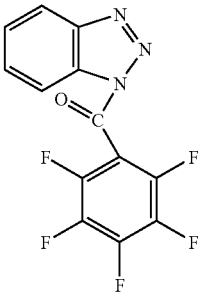
4-11
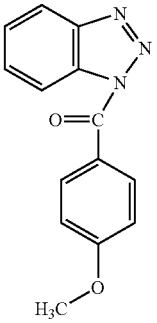
4-12
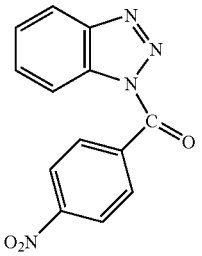
4-13
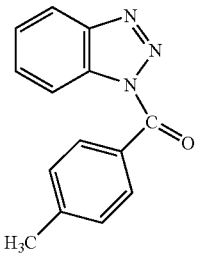
4-14
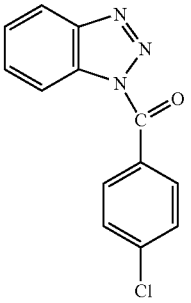

-continued
4-15
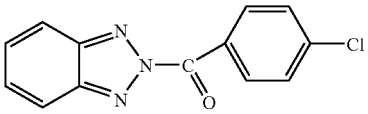
4-16
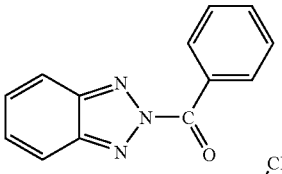
4-17
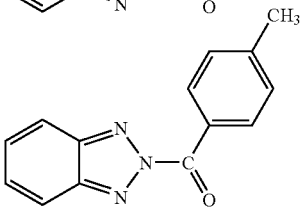
4-18
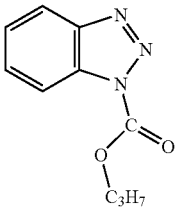
4-19
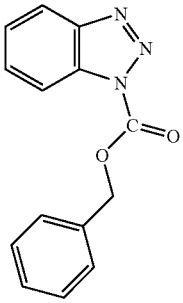
4-20
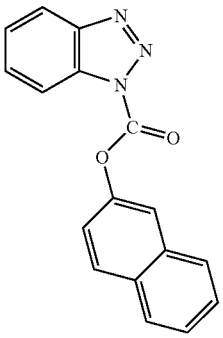
4-21
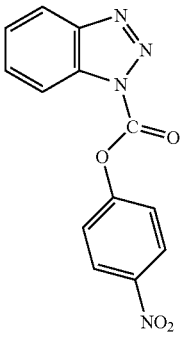
-continued
4-22
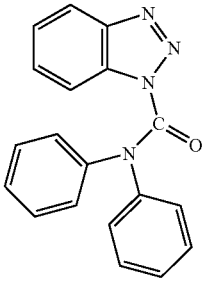
4-23
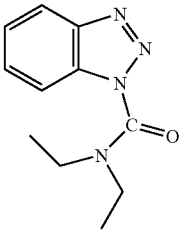
4-24
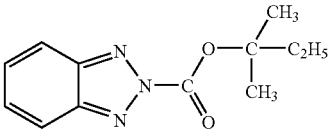
4-25
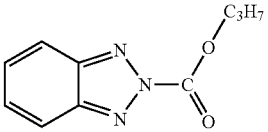
4-26
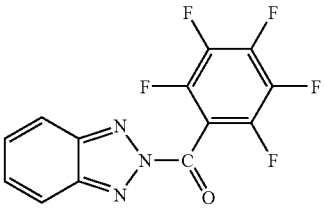
4-27
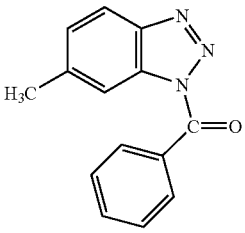
4-28
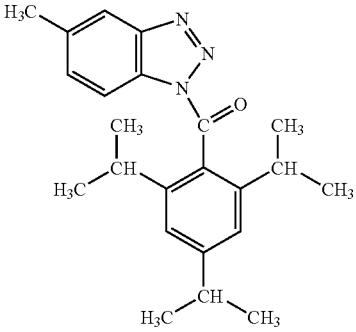

-continued
4-29
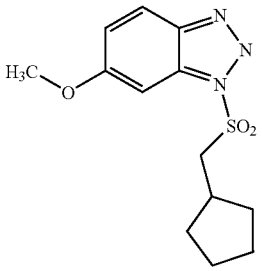
4-30
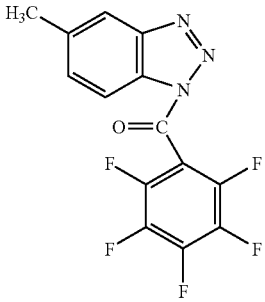
4-31
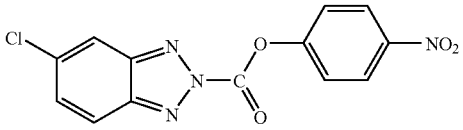
4-32
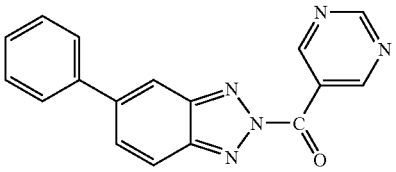
4-33
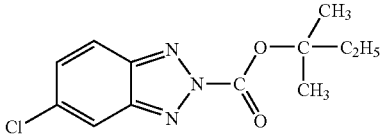
4-34
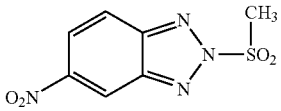
4-35
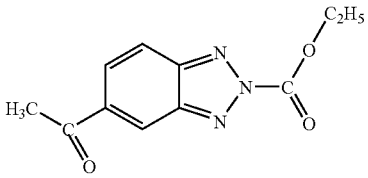
4-36
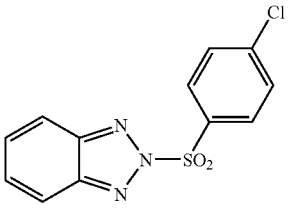
-continued
4-37
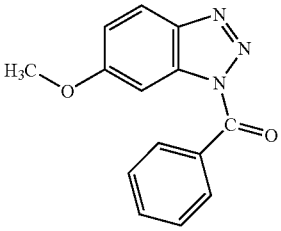
4-38
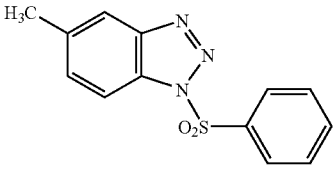
4-39
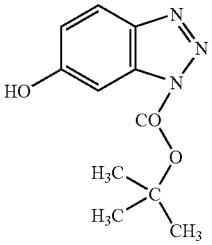
4-40
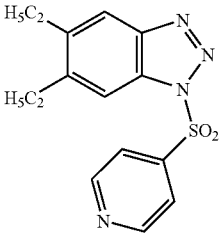
4-41
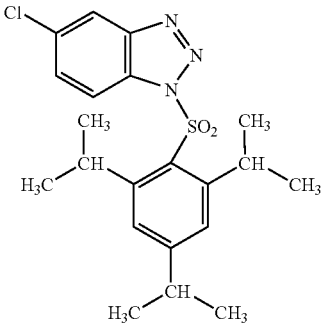
4-42
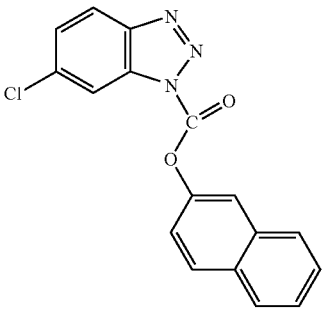

-continued
4-43
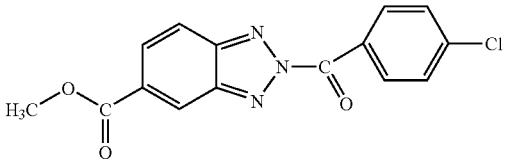
4-44
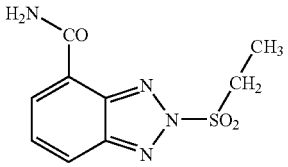
4-45
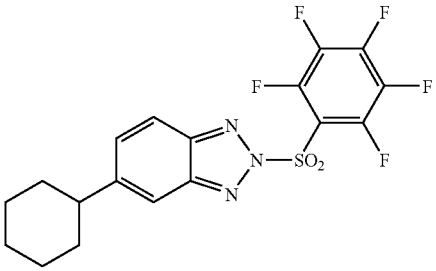
4-46
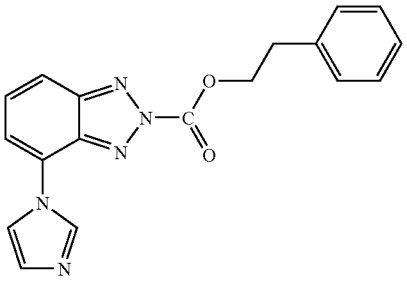
4-47
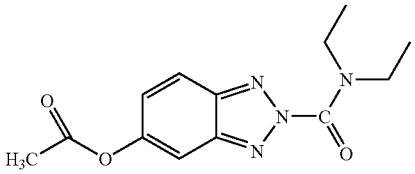
4-48
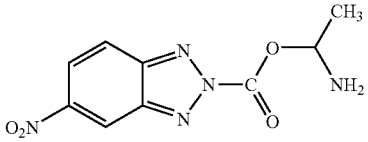
4-49
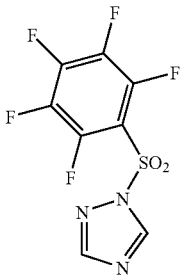
-continued
4-50
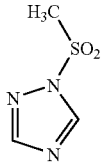
4-51
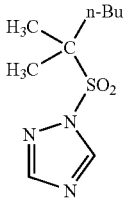
4-52
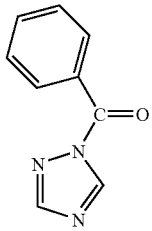
4-53
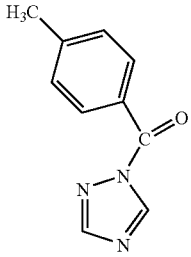
4-54
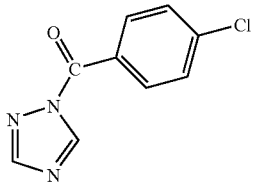
4-55
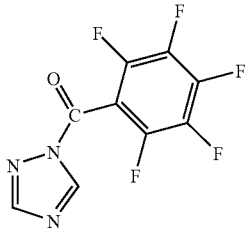
4-56
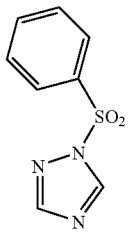

-continued
4-57
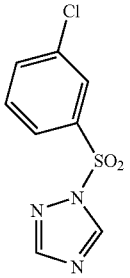
4-58
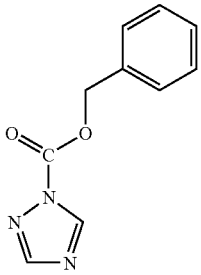
4-59
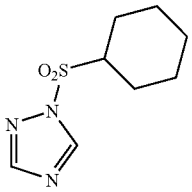
4-60
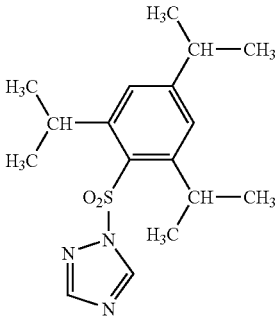
4-61
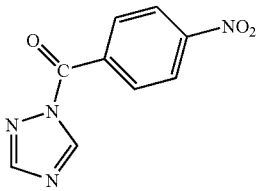
4-62
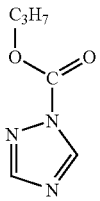
-continued
4-63
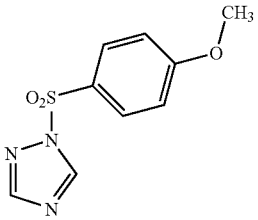
4-64
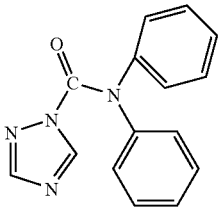
4-65
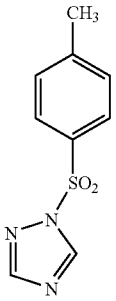
4-66
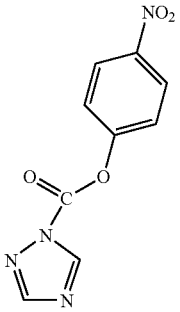
4-67
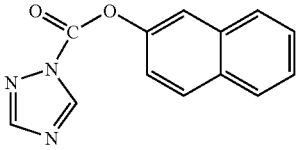
4-68
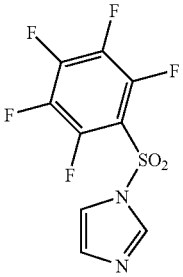

-continued
4-69
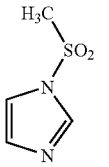
4-70
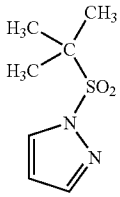
4-71
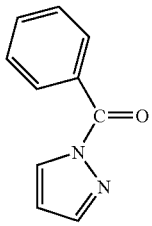
4-72
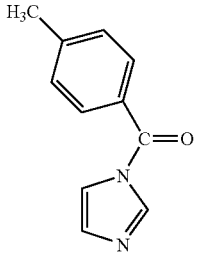
4-73
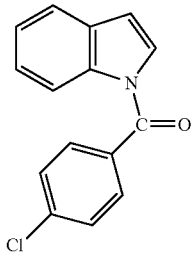
4-74
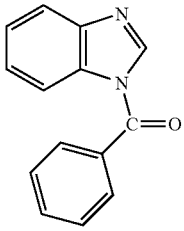
4-75
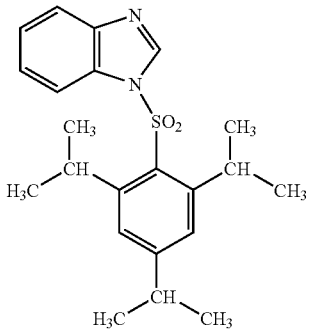
-continued
4-76
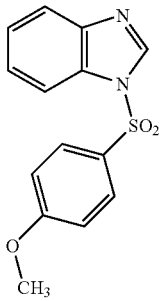
4-77
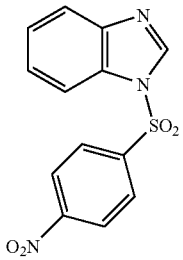
4-78
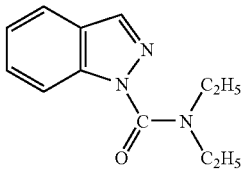
4-79
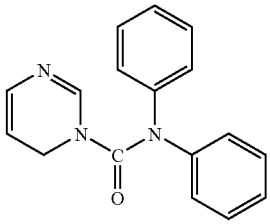
4-80
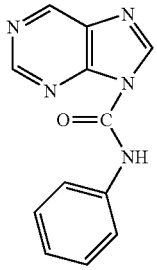
4-81
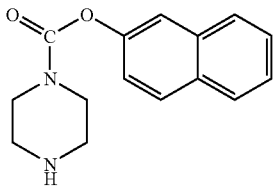
4-82
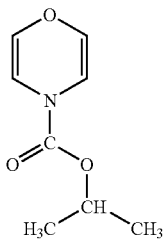

-continued
4-83
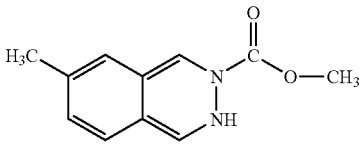
4-84
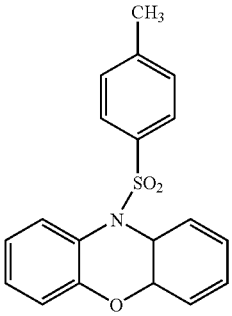
4-85
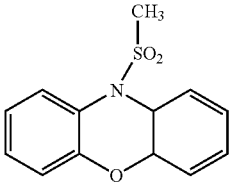
4-86
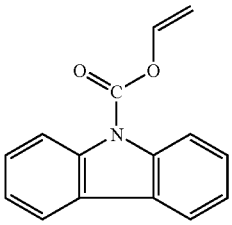
4-87
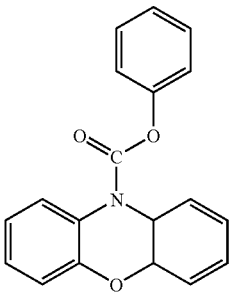
4-88
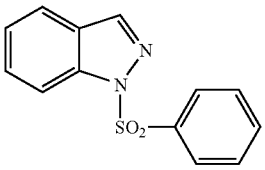
4-89
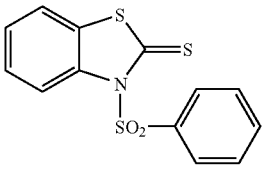
-continued
4-90
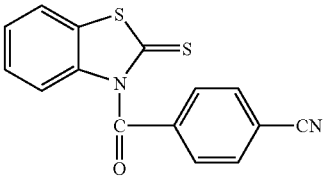
4-91
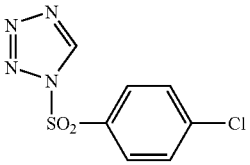
4-92
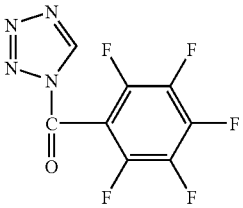
4-93
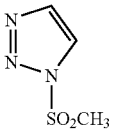
4-94
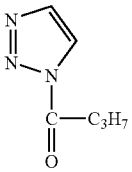
4-95
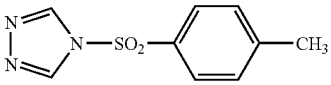
4-96
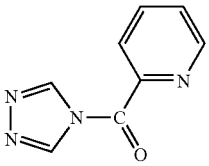
4-97
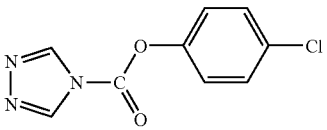
4-98
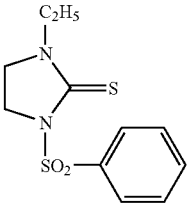

-continued 4-99

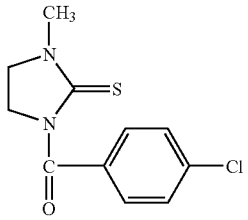

4-100

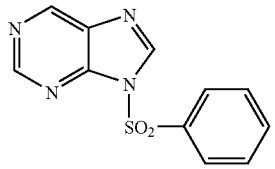

4-101

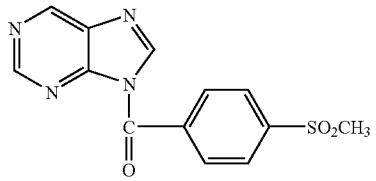

The compounds represented by General Formula (4) of this invention can be synthesized by the following method.

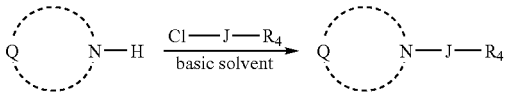

They can be synthesized also by the following method when J is —CON($R_5$).

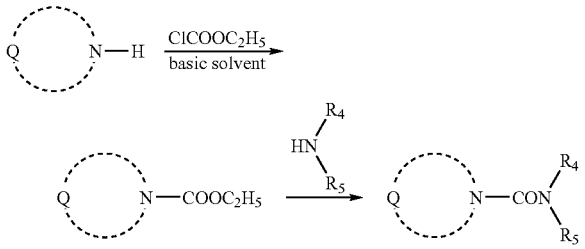

With respect to synthesis of the compounds represented by General Formula (4) of this invention, synthesis examples of JP-A No. 2000-330235 can also be referred to.

The compounds represented by General Formulas (3) and (4) are incorporated at least in one of a light-sensitive layer and the adjacent layers, and may be added by being dissolved in an organic solvent of alcohols such as methanol and ethanol, ketones such as methyl ethyl ketone and acetone, an aromatic type such as toluene and xylene or a non-aromatic type such as normal-hexane and decane, by being dispersed in water, or may be added directly as powder or tablets. The using amount is preferably $1\times10^{-8}$–1 mol/Ag mol, more preferably $1\times10^{-6}$–$1\times10^{-1}$ mol/Ag mol and most preferably $1\times10^{-4}$–$1\times10^{-2}$ mol/Ag mol.

In this invention, preferably utilized are bisphenol compounds represented by following General Formula (5) as a tone modifier of a silver image.

General Formula (5)

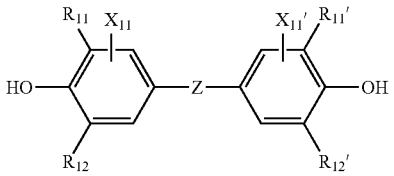

wherein, Z represents a —S— or —C($R_{13}$) ($R_{13'}$)— group. $R_{13}$ and $R_{13'}$ each represent a hydrogen atom or a substituent. $R_{11}$, $R_{12}$, $R_{11'}$ and $R_{12'}$ each represent a substituent. $X_{11}$ and $X_{11'}$ each represent a hydrogen atom or a substituent. The substituents reprented by $R_{13}$ and $R_{13'}$ include alkyl groups (each group of such as methyl, ethyl, propyl, isopropyl, cyclopropyl, butyl, isobutyl, sec-butyl, t-butyl, cyclohexyl, 1-methyl-cyclohexyl and dodecyl), alkenyl groups (each group of such as vinyl, propenyl, butenyl, pentenyl, isohexenyl, cyclohexenyl, butenylidene and isopentylidene), alkynyl groups (each group of such as ethynyl and propylidene), aryl groups (each group of such as phenyl and naphtyl), heterocyclic groups (each group of such as furyl, thienyl, pyridyl, pyrimidyl, triazyl, quinolyl and tetrahydrofuranyl), as well as each group of such as a halogen, hydroxyl, alkoxy, aryloxy, acyloxy, sulfonyloxy, nitro, amino, acylamino, sulfonylamino, sulfonyl, carboxy, alkoxycarbonyl, aryloxycarbonyl, carbamoyl, sulfamoyl, cyano and sulfo.

$R_{13}$ and $R_{13'}$ are preferably a hydrogen atom or an alkyl group.

$R_{11}$, $R_{12}$, $R_{11'}$ and $R_{12'}$ each represent a substituent, which includes the substituents listed in the explanation of above $R_{13}$ and $R_{13'}$.

$R_{11}$, $R_{12}$, $R_{11'}$ and $R_{12'}$ are preferably alkyl groups, alkenyl groups, alkynyl groups or heterocyclic groups and more preferably alkyl groups.

Substituents on the alkyl groups include the substituents listed in the explanation of above $R_{13}$ and $R_{13'}$.

$R_{11}$, $R_{12}$, $R_{11'}$ and $R_{12'}$ are more preferably tertiary alkyl groups such as t-butyl, t-amino, t-octyl and 1-methyl-cyclohexyl.

$X_{11}$ and $X_{11'}$ each represent a hydrogen atom or a substituent, and the substituents include the substituents listed in the explanation of above $R_{13}$ and $R_{13'}$.

In the following, described are specific examples of bisphenol compounds represented by General Formula (5).

5-1

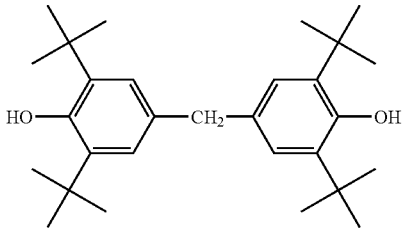

-continued 5-2

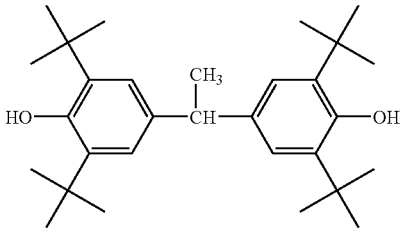

5-3

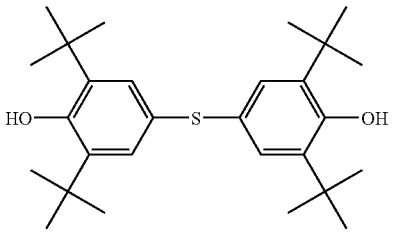

5-4

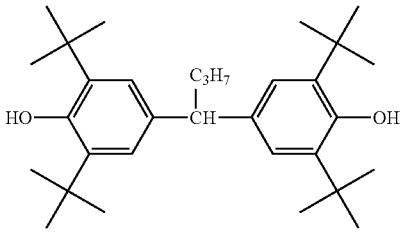

5-5

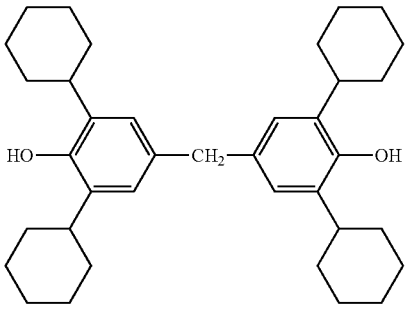

5-6

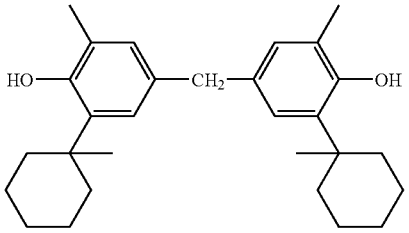

5-7

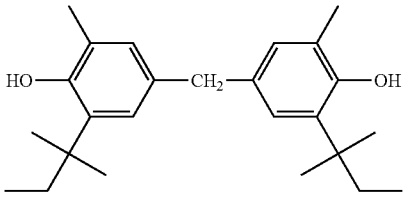

-continued 5-8

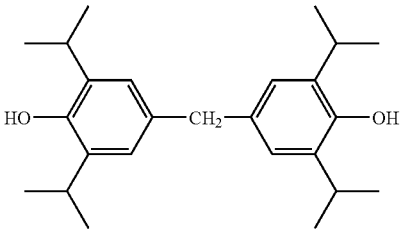

5-9

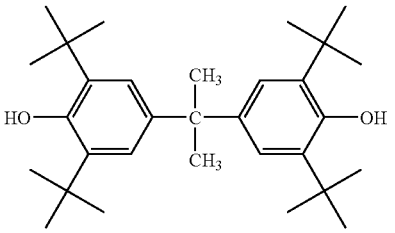

5-10

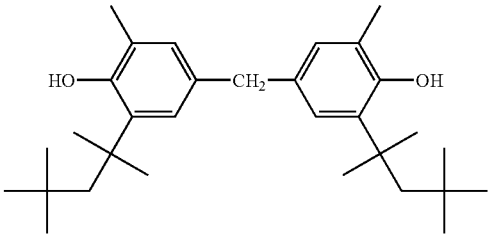

Compounds represented by General Formula (5) may be incorporated in at least one of a light-sensitive layer or light-insensitive layers on said light-sensitive layer side, of a thermally developable light-sensitive material, and preferably at least in a light-sensitive layer.

Addition of compounds represented by General Formula (5) can be performed by a similar method to that of leuco dyes represented by General Formula (1).

The addition amount ratio to a reducing agent of compounds represented by General Formula (5) ["compound represented by General Formula (5)"/"reducing agent" (a mole ratio)] is preferably in a range of 0.0001–0.2 and more preferably 0.001–0.1.

Next, explained will be compounds represented by General Formula (6) utilized in this invention to increase the sensitivity.

In the formula, the electron withdrawing groups represented by Y include the specific examples of electron withdrawing groups represented by X of General Formula (2). Z, include the specific examples of groups represented by W of General Formula (2). Y and $Z_1$ may form a cyclic structure by bonding to each other, in the same manner as X and W of General Formula (2).

$R_6$ includes a halogen atom, oxy groups (such as hydroxyl, aryloxy, heterocyclic oxy, acyloxy, alkoxy, alkenyloxy, alkynyloxy, alkoxycarbonyloxy and aminocarbonyloxy), thio groups (such as mercapto, arylthio, heterocyclic thio, alkylthio, alkenylthio, alkynylthio, acylthio, alkoxycarbonylthio and aminocarbonylthio), organic or inorganic salts of a hydroxyl group and a mercapto group, amino groups (such as amino, alkylamino, arylamino, acylamino, oxycarbonylamino, ureido and sulfonamide) and heterocyclic groups (5- or 6-membered nitrogen-containing heterocyclic rings).

The heterocyclic rings are 5- or 6-membered nitrogen-containing heterocyclic rings, preferably 5- or 6-membered nitrogen-containing heterocyclic aromatic rings, more preferably those which bond via a nitrogen atom in the ring, and are preferably represented by such as pyrrole, diazole, triazole and tetrazole, and specifically preferably such as imidazole and benzotriazole.

$R_6$ preferably includes a hydroxyl group, a mercapto group, a halogen atom, organic or inorganic salts of a hydroxyl or mercapto group, and heterocyclic residual groups. $R_6$ more preferably includes a hydroxyl group, organic or inorganic salts of a hydroxyl group, and heterocyclic residual groups, and most preferably a hydroxyl group and organic or inorganic salts of a hydroxyl group.

Further, in this invention, Y, $Z_1$ and $R_6$ each may contain a ballast group or an adsorption enhancing group to a silver salt. Specific examples of these groups may include the ballast groups and adsorption enhancing groups listed in X, W and $R_2$ of General Formula (2).

In this invention, alkene compounds represented by General Formula (6) are every isomer when Y, $Z_1$, $R_6$ and H can take an isomeric structure with respect to the substituting double bond, and are also every isomer when they can take a tautomeric structure such as keto-enol.

Specific examples of the compounds represented by General Formula (6) will be described below, however, this invention is not limited thereto.

6-1

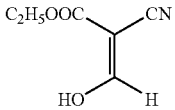

6-2

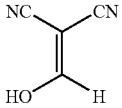

6-3

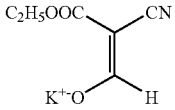

6-4

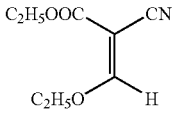

6-5

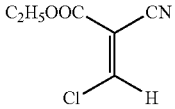

6-6

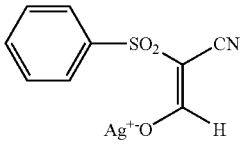

6-7

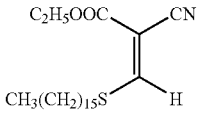

-continued 6-8

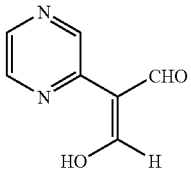

6-9

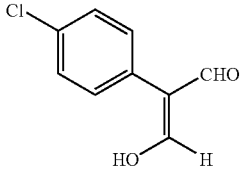

6-10

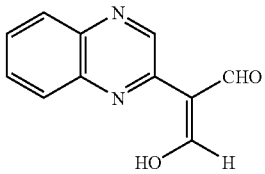

6-11

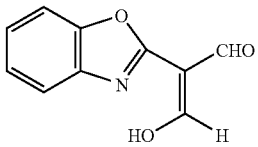

6-12

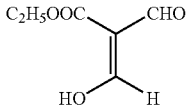

6-13

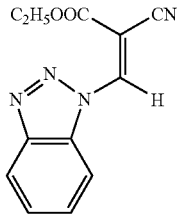

6-14

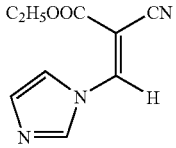

6-15

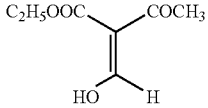

6-16

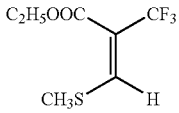

6-17

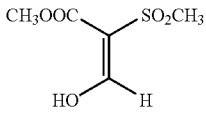

-continued
6-18
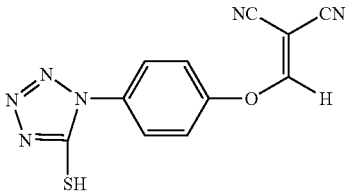
6-19
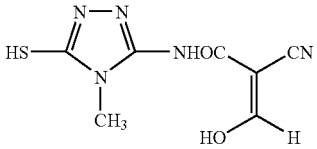
6-20
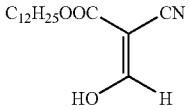
6-21
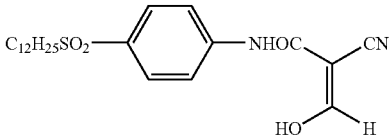
6-22
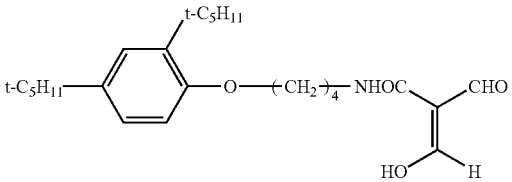
6-23
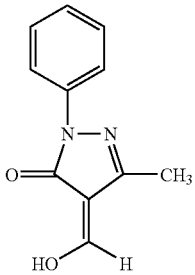
6-24
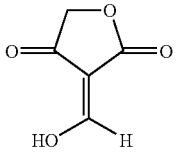
6-25
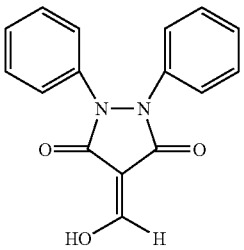
-continued
6-26
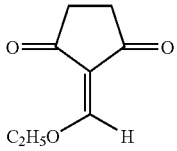
6-27
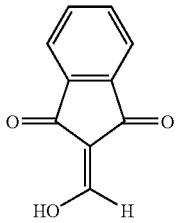
6-28
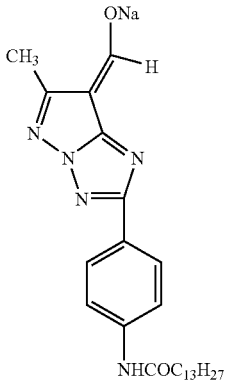
6-29
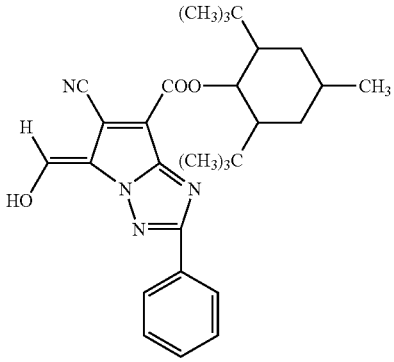
6-30
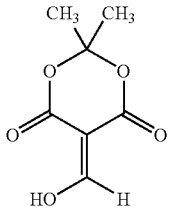
6-31
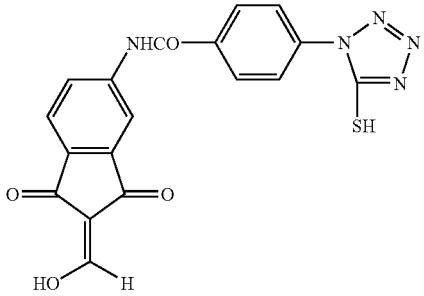

-continued
6-32
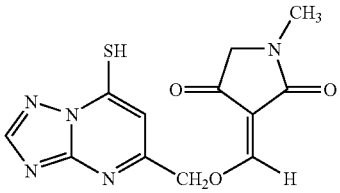
6-33
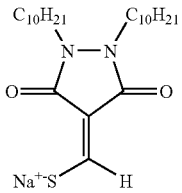
6-34
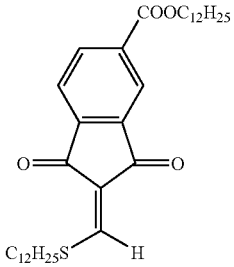
6-35
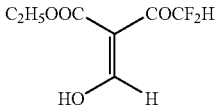
6-36
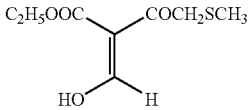
6-37
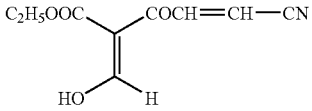
6-38
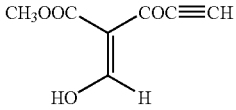
6-39
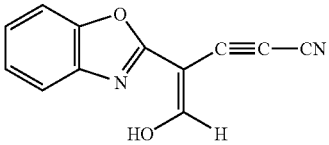
6-40
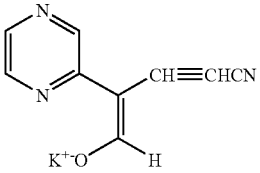
-continued
6-41
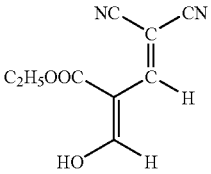
6-42
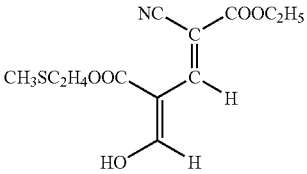
6-43
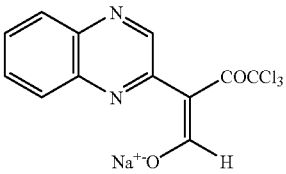
6-44
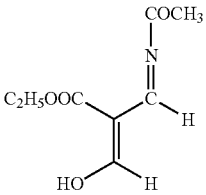
6-45
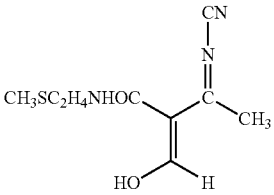
6-46
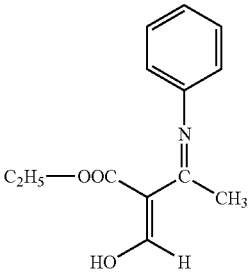
6-47
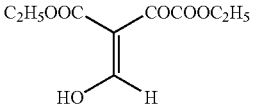
6-48
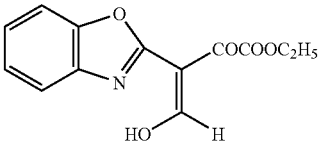

-continued 6-49

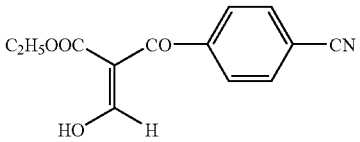

6-50

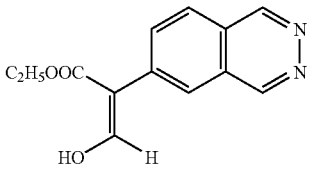

6-51

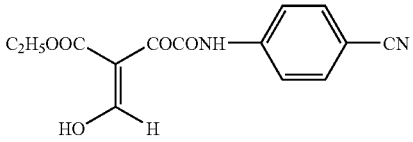

6-52

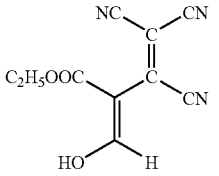

6-53

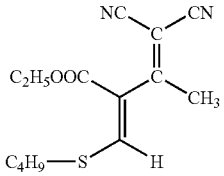

6-54

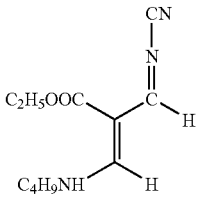

6-55

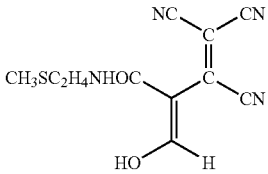

6-56

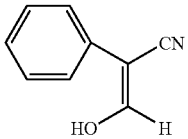

6-57

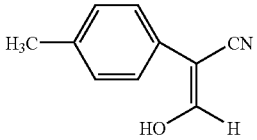

-continued 6-58

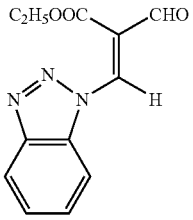

Compounds represented by General Formula (6) can be synthesized by various methods, and can be synthesized, for example, referring to the synthesis methods described in U.S. Pat. Nos. 5,545,515, 5,635,339 and JP-A 11-119373.

Exemplary compounds (6)-12, for example, can be synthesized according to the following rout.

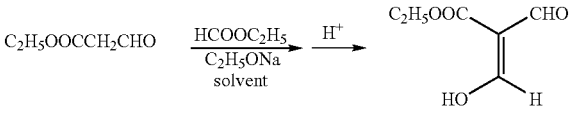

Other compounds represented by General Formula (6) can be synthesized in a similar manner.

The compound represented by General Formula (6) is incorporated at least in one of a light-sensitive layer or light-insensitive layers on said light-sensitive layer side, of a thermally developable light-sensitive material, and preferably at least in a light-sensitive layer. The addition amount of compounds represented by General Formula (6) is preferably $1\times10^{-8}$–1 mol/Ag mol, more preferably $1\times10^{-6}$–$1\times10^{-1}$ mol/Ag mol and most preferably $1\times10^{-4}$–$1\times10^{-2}$ mol/Ag mol.

The compound represented by General Formula (6) can be added in a light-sensitive layer or a light-insensitive layer according to the same methods as for compounds represented by General Formula (2). That is, they can be added in light-sensitive layer or light-insensitive layer coating solution by being dissolved in alcohols such as methanol and ethanol, ketones such as methyl ethyl ketone and acetone, and polar solvents such as dimethylsulfoxide and dimethylformamide. Further, they can be added also by being made into micro-particles of not more than 1 μm followed by being dispersed in water or an organic solvent. As for micro-particle dispersion techniques, many techniques have been disclosed and the compound can be dispersed according to these techniques.

Hydrazine compounds preferably utilized in this invention will now be explained.

Hydrazine compounds are those having a —NHNH— group, and typical preferable hydrazine compounds include those represented by following General Formula (10).

T-NHNH—CO—V General Formula (10)

In General Formula (10), T represents an alkyl group, an aryl group or a heterocyclic group, each of which may be substituted, and V represents a hydrogen atom or a blocking group.

Alkyl groups represented by T include straight chain, branched or cyclic alkyl groups such as methyl, ethyl, propyl, isopropyl and cyclohexyl, which may be substituted by various substituents such as aryl, heterocyclic, acyl and cyano, specifically including such as a trityl group and a benzyl group.

Aryl groups represented by T contain a benzene ring or a naphthalene ring which may be substituted by various substituents, and preferable substituents include straight chain, branched alkyl groups (preferably having a carbon number of 1–20, such as methyl, ethyl, propyl, isopropy, dodecyl and trifluoromethyl), alkoxy groups (preferably having a carbon number of 1–20, such as methoxy, ethoxy, propoxy, isopropoxy and dodecyloxy), aliphatic acylamino groups (being preferably provided with an alkyl group having a carbon number of 1–21, such as an acetylamino group and a heptylamino group), an arylacylamino group, a nitro group, a cyano group and sulfonyl group, in addition to these, included are those to which a substituted or non-substituted aromatic ring as described above is bonded via connecting group such as —CONH—, —O—, —$SO_2$NH—, —NHCONH— and —$CH_2$CH═N—. Heterocyclic groups represented by T include each group of such as pyridyl, phenyl, thienyl, pyrimidyl, pyrazinyl, quinazolynyl, and their substituents include those listed in the aforesaid aryl groups.

T is preferably a phenyl group, a trityl group or a heterocyclic group, which may be provided with the substituents described above. V represents a hydrogen atom or a blocking group, and the blocking groups include for example each group of such as alkyl, aryl, heterocyclic, carbamoyl, oxycarbonyl, oxy and amino, which may be substituted by those listed as the substituents of the aforesaid T.

Specific examples of blocking groups other than a hydrogen atom represented by V include each group of such as methyl, methoxymethyl, methylthio, trifluoromethyl, phenyl, naphtyl, pyridyl, thienyl, furyl,.ethoxy, t-butoxy, N-methylcarbamoyl, ethoxycarbonyl, aniline, butylamino and octylamino.

Hydrazine compounds can be synthesized referring to descriptions of such as U.S. Pat. Nos. 4,269,926 and 5,545,515, Japanese Translated PCT Patent Publication No. 10-512061, JP-A Nos. 9-152700, 9-152701, 9-152703 and 9-152704.

To incorporate hydrazine compounds in a light-sensitive layer or a light-insensitive layer, they can be incorporated by adding the hydrazine compounds in coating solutions of said layers by being dissolved in alcohols. such as methanol and ethanol, ketones such as methyl ethyl ketone and acetone, and polar solvents such as dimethylsulfoxide and dimethylformamide. Further, they can be added also by being made into micro-particles of not more than 1 μm followed by being dispersed in water or an organic solvent. As for micro-particle dispersion techniques, many techniques have been disclosed and the compound can be dispersed according to these techniques. The addition amount may be $1\times10^{-8}$–1 mol/Ag mol, preferably $1\times10^{-6}$–$1\times10^{-1}$ mol/Ag mol and more preferably $1\times10^{-4}$–$1\times10^{-2}$ mol/Ag mol.

Hydrazine compounds preferably utilized in this invention include, for example, those described in U.S. Pat. No. 5,545,515, Japanese Translated PCT Patent Publication No.10-512061 and JP-A No. 2002-268176.

Specific examples of hydrazine compounds will be shown below.

10-1

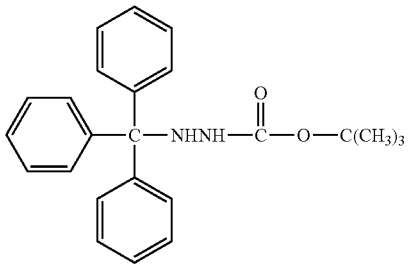

10-2

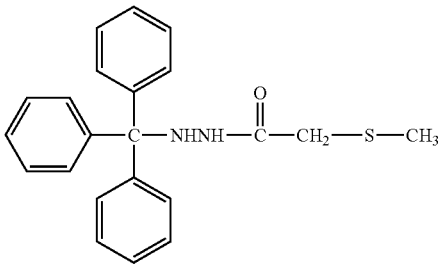

10-3

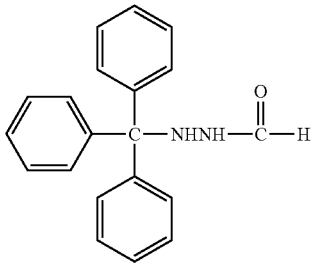

10-4

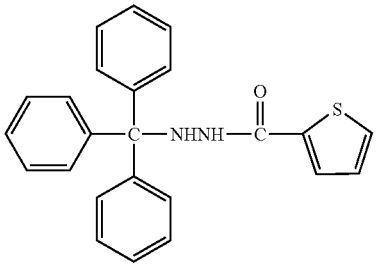

10-5

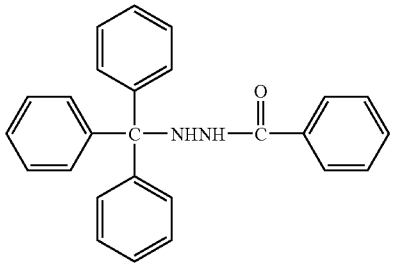

10-6

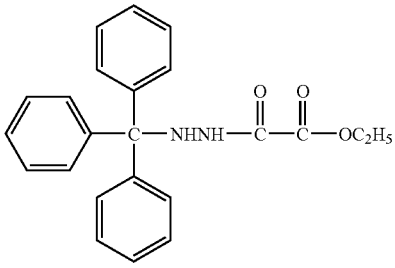

-continued
10-7
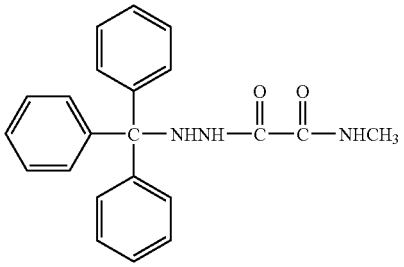
10-8
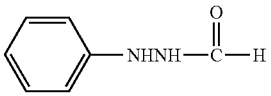
10-9
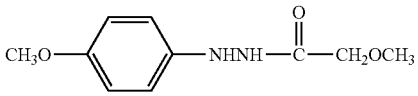
10-10
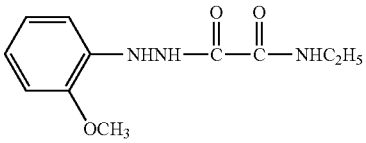
10-11
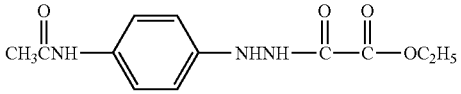
10-12
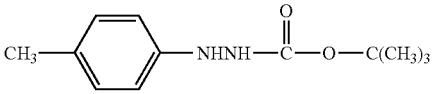
10-13
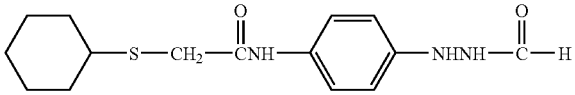
10-14
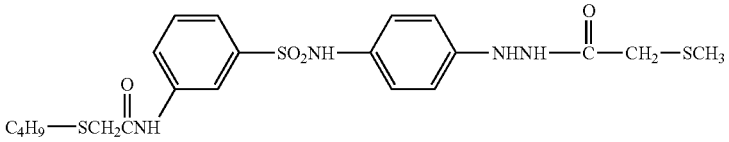
10-15
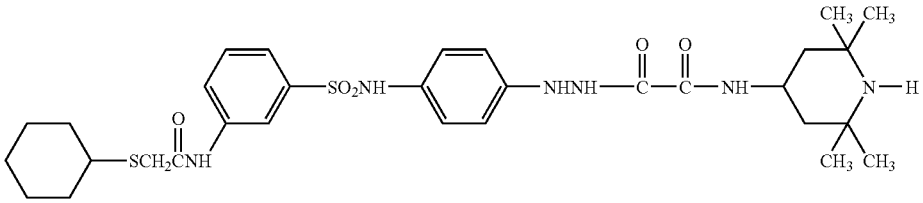
10-16
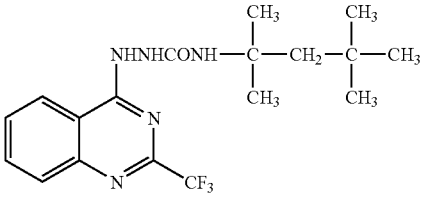
10-17
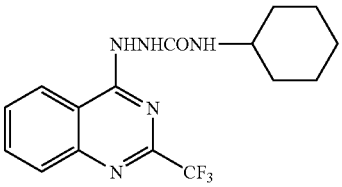
10-18
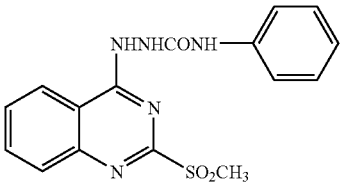
10-19
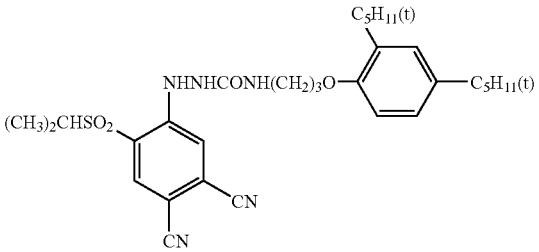

-continued
10-20
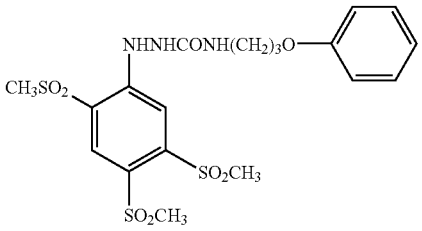
10-21
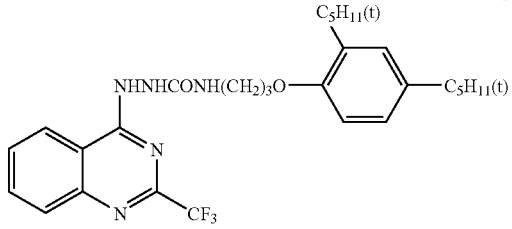
10-22
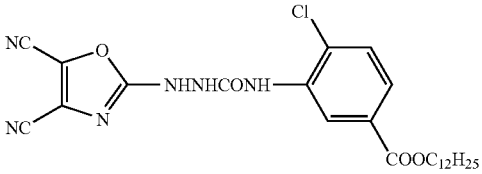
10-23
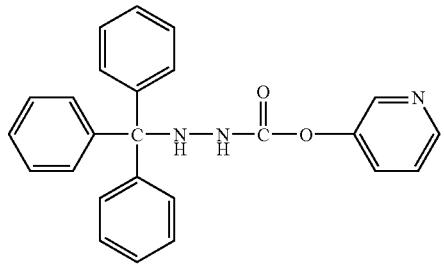
10-24
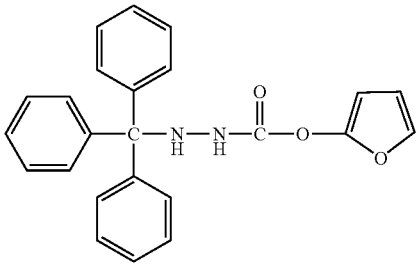
10-25
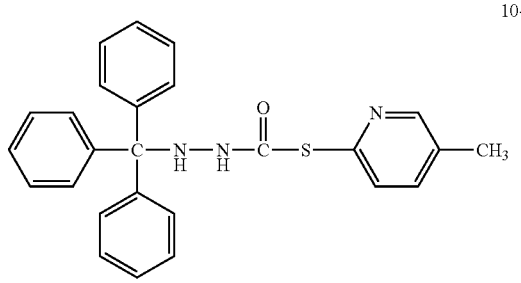
10-26
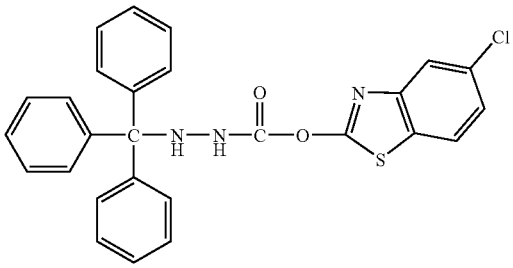
10-27
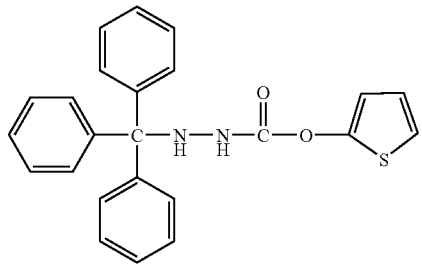
10-28
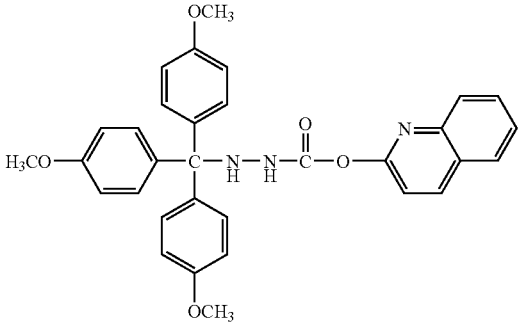
10-29
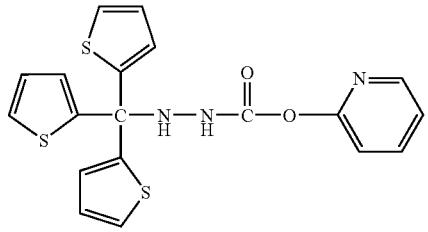

-continued
10-30
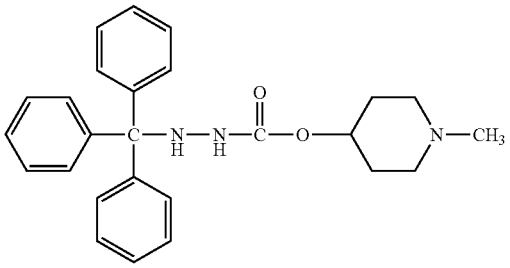
10-31
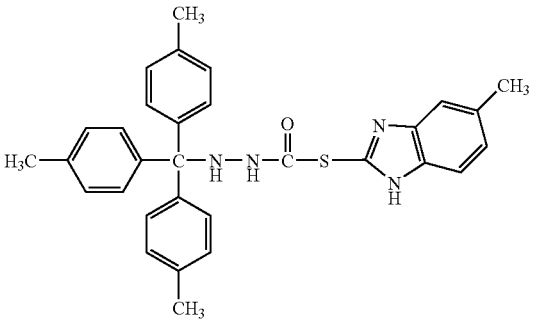
10-32
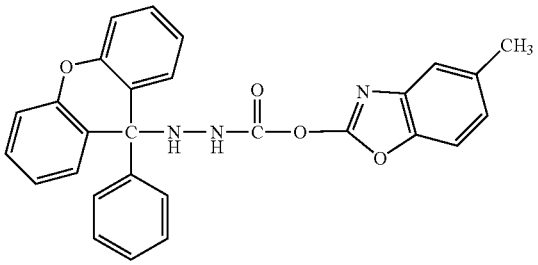
10-33
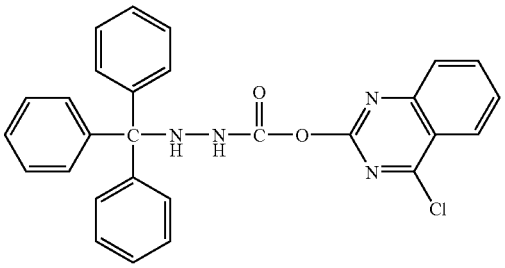
10-34
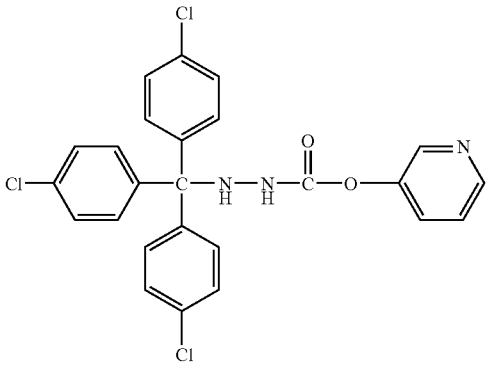
10-35
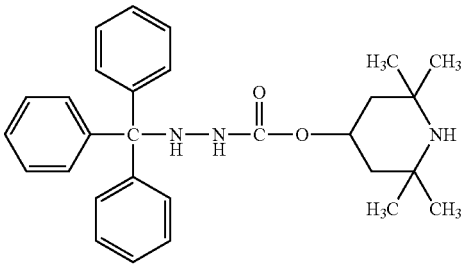
10-36
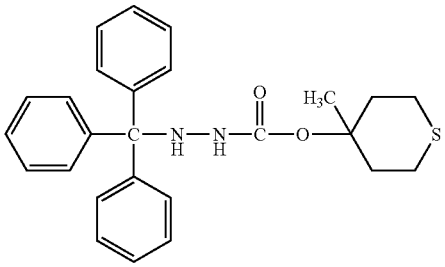
10-37
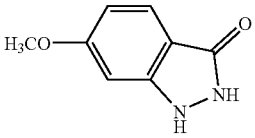
10-38
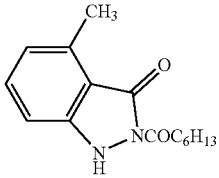
10-39
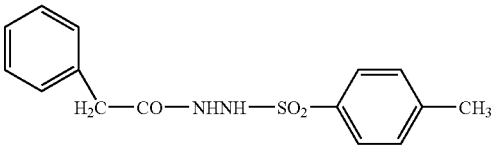

-continued 10-40

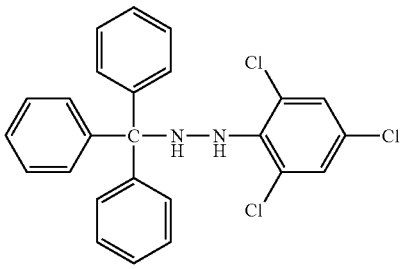

Fluorine type surfactants are generally utilized to improve an antistatic property, and specific examples of the compounds represented by General Formulas (7) and (8) include the following.

| | | | |
|---|---|---|---|
| 7-1 | $LiO_3S(CF_2)SO_3Li$ | 7-2 | $LiO_3S(CF_2)SO_3Li$ |
| 7-3 | $LiO_3S(CF_2)_3SO_3Li$ | 7-4 | $LiO_3S(CF_2)_4SO_3Li$ |
| 7-5 | $HO_3S(CF_2)SO_3H$ | 7-6 | $HO_3S(CF_2)_2SO_3H$ |
| 7-7 | $HO_3S(CF_2)_3SO_3H$ | 7-8 | $HO_3S(CF_2)_4SO_3H$ |
| 7-9 | $HO_3S(CF_2)_5SO_3H$ | 7-10 | $HO_3S(CF_2)_6SO_3H$ |
| 7-11 | $HO_3S(CF_2)_8SO_3H$ | 7-12 | $NaO_3S(CF_2)_4SO_3Na$ |
| 7-13 | $KO_3S(CF_2)SO_3K$ | 7-14 | $KO_3S(CF_2)_3SO_3K$ |
| 7-15 | $KO_3S(CF_2)_6SO_3K$ | 7-16 | $H_4NO_3S(CF_2)SO_3NH_4$ |
| 7-17 | $H_4NO_3S(CF_2)_2SO_3NH_4$ | 7-18 | $H_4NO_3S(CF_2)_4SO_3NH_4$ |
| 7-19 | $H_4NO_3S(CF_2)_6SO_3NH_4$ | 7-20 | $H_4NO_3S(CF_2)_8SO_3NH_4$ |
| 7-21 | $(C_2H_5)_3HNO_3S(CF_2)SO_3NH(C_2H_5)_3$ | | |
| 7-22 | $(C_2H_5)_3HNO_3S(CF_2)_3SO_3NH(C_2H_5)_3$ | | |
| 7-23 | $(C_2H_5)_3HNO_3S(CF_2)_6SO_3NH(C_2H_5)_3$ | | |
| 7-24 | $HO_3S(CF_2)_3SO_3H_3N\text{-}(CH_2CH_2O)_{70}CH_2CH_2NH_3O_3S\text{-}(CF_2)_3\text{-}SO_3H$ | | |
| 7-25 | $(C_4H_9)_4NO_3S(CF_2)_3SO_3N(C_4H_9)_4$ | | |
| 7-26 | $NaO_3S(CF_2)_3SO_3Na$ | | |
| 8-1 | $Ba[O_3S(CF_2)SO_3]$ | | |
| 8-2 | $Ba[O_3S(CF_2)_3SO_3]$ | | |
| 8-3 | $Ba[O_3S(CF_2)_5SO_3]$ | | |
| 8-4 | $Ca[O_3S(CF_2)SO_3]$ | | |
| 8-5 | $Ca[O_3S(CF_2)_2SO_3]$ | | |
| 8-6 | $Ca[O_3S(CF_2)_4SO_3]$ | | |
| 8-7 | $Ca[O_3S(CF_2)_6SO_3]$ | | |
| 8-8 | $Ca[O_3S(CF_2)_8SO_3]$ | | |
| 8-9 | $Mg[O_3S(CF_2)SO_3]$ | | |
| 8-10 | $Mg[O_3S(CF_2)_3SO_3]$ | | |
| 8-11 | $Mg[O_3S(CF_2)_5SO_3]$ | | |
| 8-12 | $Mg[O_3S(CF_2)_7SO_3]$ | | |
| 8-13 | $Mg[O_3S(CF_2)_8SO_3]$ | | |

Fluorine compounds represented by General Formulas (7) and (8) may be utilized alone or in combinations of two or more types. Fluorine compounds utilized in this invention may be incorporated in any layer of a thermally developable light-sensitive material. For this purpose, the compound is added into a coating solution of said layer. The layer composition includes, for example, a light-sensitive layer, an intermediate layer, a front surface protective layer, a back-coating layer or a back surface protective layer, and the compound is specifically preferably utilized in a back surface protective layer or a front surface protective layer.

The using amount of fluorine compounds represented by General Formulas (7) and (8) is preferably in a range of 1–500 mg and more preferably 1–300 mg per $m^2$, of the thermally developable light-sensitive material.

Fluorine compounds represented by General Formulas (7) and (8) may be added in a coating solution by being dissolved in water or an organic solvent, or as a micro-particle solid dispersion, in addition, a solution or micro-particle solid dispersion of a fluorine compound of this invention may be sprayed after coating of the coating solution.

The coating solvents employed are preferably water, alcohols (such as methanol, ethanol, i-propanol and butanol), ketones (such as acetone, methyl ethyl ketone and cyclohexanpone), esters (such as methyl, ethyl, propyl and butyl esters of acetic acid, formic acid, oxalic acid, maleic acid and succinic acid), a hydrocarbon type (such as hexane and cyclohexane), a halogenated hydrocarbon type (such as methylene chloride, chloroform and carbon tetrachloride), an aromatic hydrocarbon type (such as benzene, toluene, xylene, benzylalcohol, benzoic acid and anisole), an amide type (such as dimethylformamide, dimethylacetoamide and N-methylpyrrolidone), an ether type (such as diethylether, dioxane and tetrahydrofuran), an ether alcohol type (such as diacetone alcohol and propyleneglycol monomethylether), glycerine and dimethylsulfoxide. Among these, preferable are methanol, ethanol, i-propanol, acetone, methyl ethyl ketone, cyclohexanone, toluene, xylene, diacetone alcohol and propyleneglycol monomethylether.

Fluorine compounds of this invention can be utilized in combination with other surfactants such as various surfactants described, for example, in JP-A No. 2000-214554, unless not disturbing the effects of this invention.

Specific examples of polyhalomethane compounds preferably utilized in this invention include the compounds of following General Formula (11)

General Formula (11)

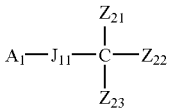

wherein, $A_1$ represents an alkyl group, an alkenyl group, an alkynyl group, an aryl group or a heterocyclic group. $Z_{21}$, $Z_{22}$ and $Z_{23}$ each represent a hydrogen atom, a halogen atom, an acyl group, an alkoxycarbonyl group, an aryloxycarbonyl group, a sulfonyl group or an aryl group, and at least one of them is a halogen atom. $J_{11}$ is a group containing —C(═O)—, —SO— or —$SO_2$—, wherein —C(═O)—, —SO— or —$SO_2$— directly bonds to the C of —C($Z_{21}$)($Z_{22}$)($Z_{23}$).

Alkyl groups, alkenyl groups and alkynyl groups represented by $A_1$ include the groups listed in the explanation of W of General Formula (2.).

Aryl groups may be monocyclic or condenced cyclic, preferably aryl groups comprising one or two rings having a carbon number of 6–30, more preferably a phenyl group or a naphtyl group and most preferably a phenyl group.

Heterocyclic groups represented by $A_1$ are 3–10-membered saturated or unsaturated heterocyclic groups including at least one of N, O and S atoms, and these may be monocyclic or form a condensed ring with another ring. Heterocyclic groups are preferably 5- or 6-membered unsaturated heterocyclic groups which may be provided with a condensed ring, more preferably 5- or 6-membered unsaturated aromatic heterocyclic groups which may be provided with a nitrogen-containing condensed ring and most preferably 5- or 6-membered unsaturated aromatic heterocyclic groups which may be provided with a condensed ring containing 1–4 nitrogen atoms.

Heterocyclic rings in such heterocyclic groups are preferably imidazole, pyrazole, pyridine, pyrimidine, pyrazine, pyridazine, triazole, triazine, indole, indazole, purine, thiadiazole, oxadiazole, quinoline, phthalazine, naphtyridine, quinoxaline, quinazoline, cinnoline, pteridine, acrydine, phenanthoroline, phenazine, tetrazole, thiazole, oxazole, benzoimidazole, benzooxazole, benzothiazole, indolenine and tetrazaindene, more preferably imidazole, pyridine, pyrimidine, pyrazine, pyridazine, triazole, triazine, thiadiazole, oxadiazole, quinoline, phthalazine, naphtyridine, quinoxaline, quinazoline, cinnoline, tetrazole, thiazole, oxazole, benzoimidazole, benzooxazole, benzothiazole and tetrazaindene, furthermore preferably imidazole, pyridine, pyrimidine, pyrazine, pyridazine, triazole, triazine, thiadiazole, quinoline, phthalazine, naphtyridine, quinoxaline, quinazoline, cinnoline, tetrazole, thiazole, benzoimidazole and benzothiazole, and most preferably pyridine, thiazole, quinoline and benzothiazole.

Alkyl groups, alkenyl groups, alkynyl groups, aryl groups and heterocyclic groups represented by $A_1$ may be provided with a substituent other than -$J_{11}$-C($Z_{21}$)($Z_{22}$)($Z_{23}$), and said substituents are preferably an alkyl group, an alkenyl group, an alkynyl group, an aryl group, an alkoxy group, an aryloxy group, an acyloxy group, an acylamino group, an alkoxycarbonyl group, an aryloxycarbonyl group, a sulfonylamino, a sulfamoyl group, a carbamoyl group, a sulfonyl group, an ureido group, a phosphoric acid amido group, a halogen atom, a cyano group, a sulfo group, a carboxyl group, a nitro group and a heterocyclic group, more preferably an alkyl group, an aryl group, an alkoxy group, an aryloxy group, an acyl group, an acylamino group, an alkoxycarbonylamino group, an aryloxycarbonylamino group, a sulfonylamino, a sulfamoyl group, a carbamoyl group, an ureido group, a phosphoric acid amido group, a halogen atom, a cyano group, a nitro group and a heterocyclic group, furthermore preferably an alkyl group, an aryl group, an alkoxy group, an aryloxy group, an acyl group, an acylamino group, a sulfonylamino, a sulfamoyl group, a carbamoyl group, a halogen atom, a cyano group, a nitro group and a heterocyclic group and most preferably an alkyl group, an aryl group and a halogen atom.

$Z_{21}$, $Z_{22}$ and $Z_{23}$ are preferably a halogen atom, a haloalkyl group, an acyl group, an alkoxycarbonyl group, an aryloxycarbonyl group, a carbamoyl group, a sulfamoyl group, a sulfonyl group or a heterocyclic group, more preferably a halogen atom, a haloalkyl group, an acyl group, an alkoxycarbonyl group, an aryloxycarbonyl group or a sulfonyl group and most preferably a halogen atom. Among halogen atom, preferable is a chlorine, bromine or iodine atom, more preferable is a chlorine or bromine atom and most preferable is a bromine atom.

$J_{11}$ represents groups containing —C(═O)—, —SO— or —$SO_2$—, preferably —$SO_2$— or —C(═O)— and most preferably —$SO_2$—.

Specific examples of these compounds will be listed below.

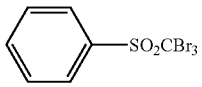

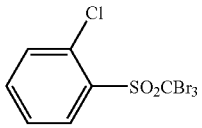

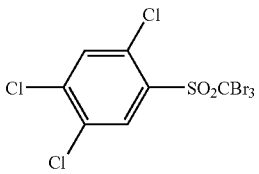

11-1

11-2

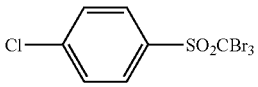

11-3

11-4

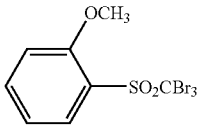

11-5

4-6

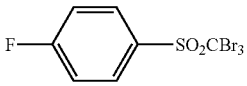

-continued
11-7
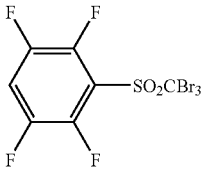
11-8
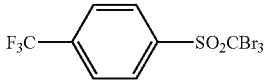
11-9
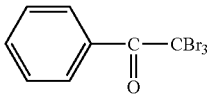
11-10
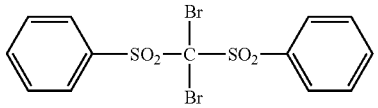
11-11
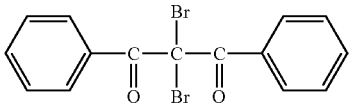
11-12
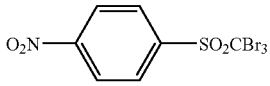
11-13
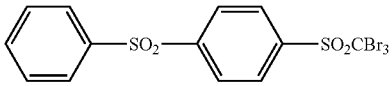
11-14
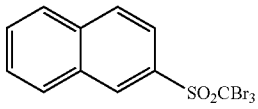
11-15
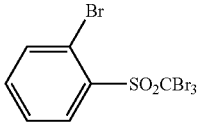
11-16
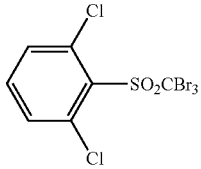
11-17
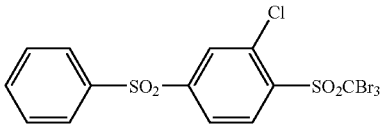
11-18
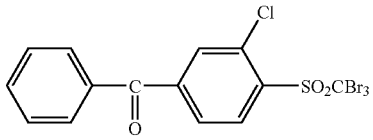
11-19
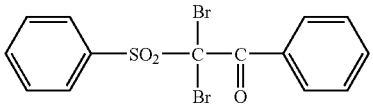
11-20
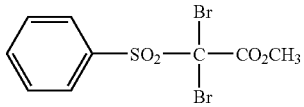
11-21
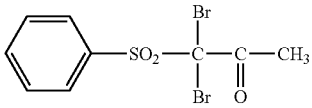
11-22
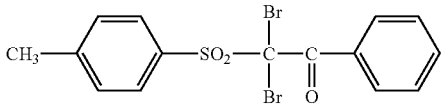
11-23
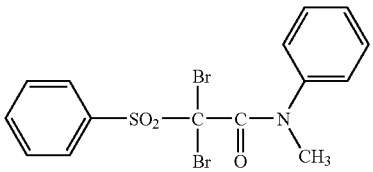
11-24
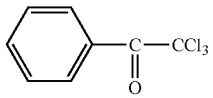
11-25
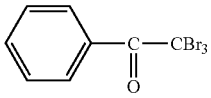
11-26
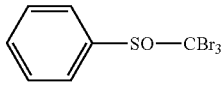
11-27
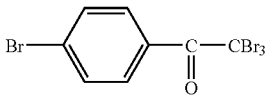
11-28
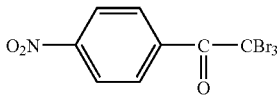

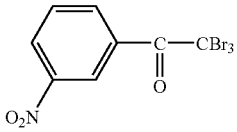
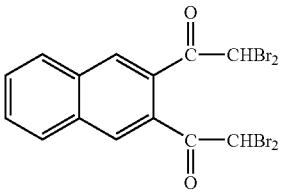
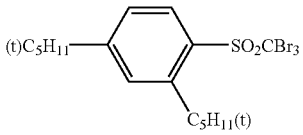
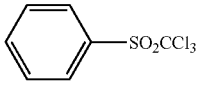
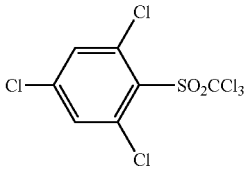
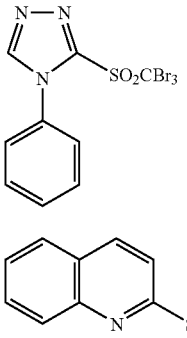
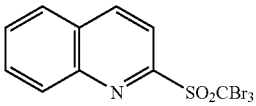
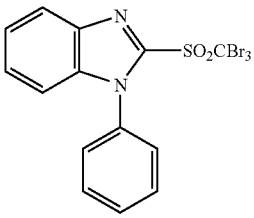
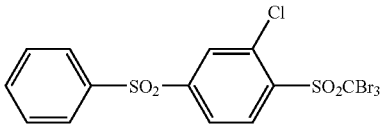
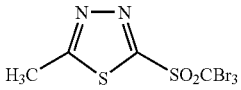
-continued
11-29
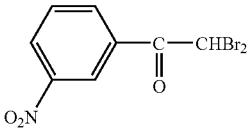
11-30
11-31
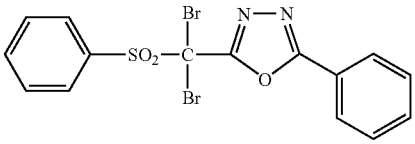
11-32
11-33
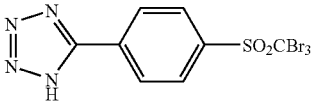
11-34
11-35
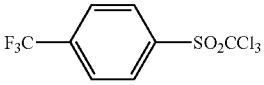
11-36
11-37
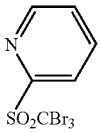
11-38
11-39
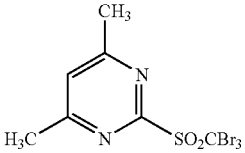
11-40
11-41
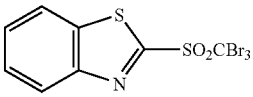
11-42
11-43
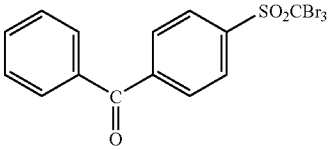
11-44
11-45
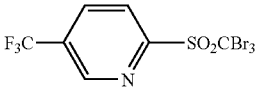
11-46
11-47
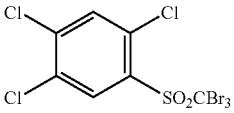
11-48

-continued
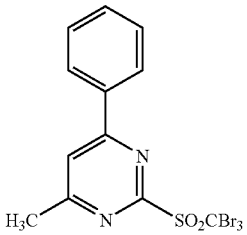
11-49
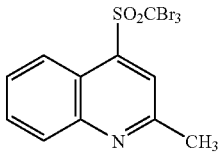
11-50
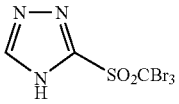
11-51
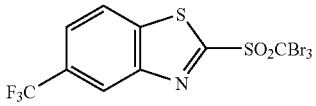
11-52
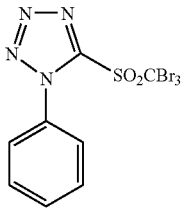
11-53
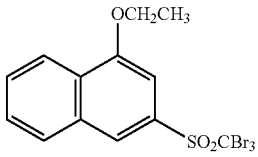
11-54
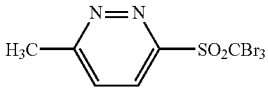
11-55
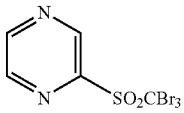
11-56
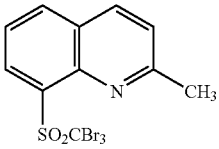
11-57
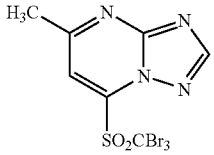
11-58
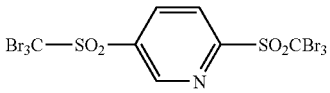
11-59
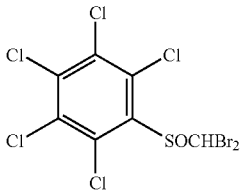
11-60
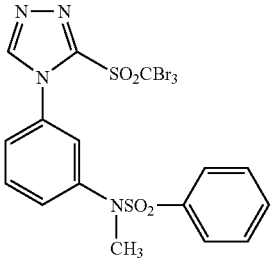
11-61
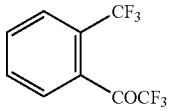
11-62
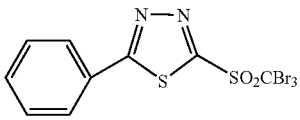
11-63
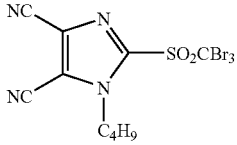
11-64

-continued 11-65

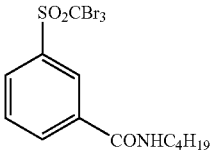

11-66

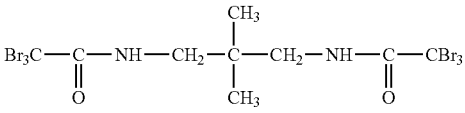

11-67

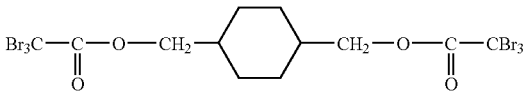

11-68

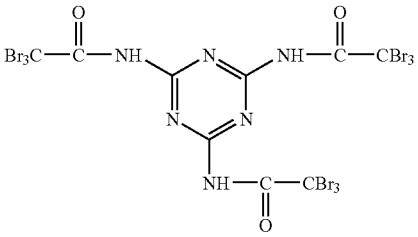

11-69

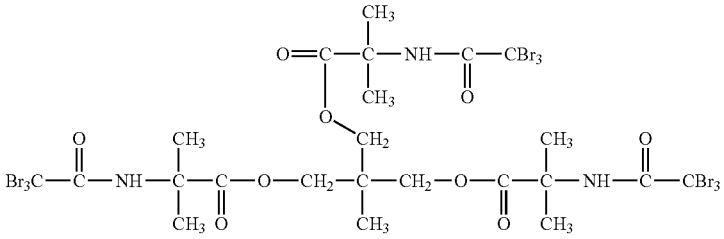

11-70

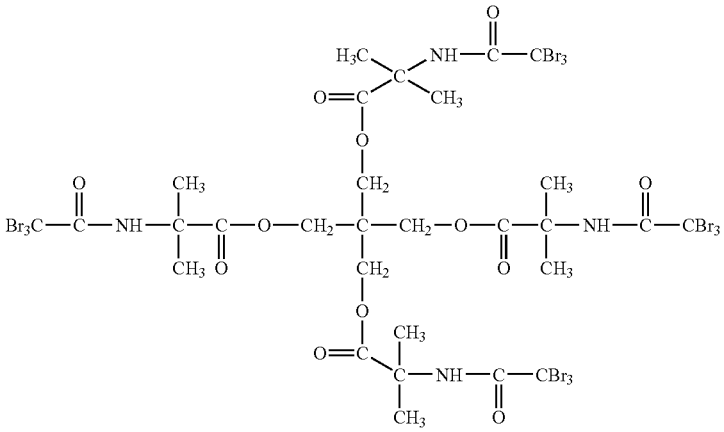

Polyhalomethane compounds are incorporated in at least one of a light-sensitive layer or the adjacent layers, and preferably at least in a light-sensitive layer.

The polyhalomethane compounds may be added by being dissolved in an organic solvent of alcohols such as methanol and ethanol, ketones such as methyl ethyl ketone and acetone, an aromatic type such as toluene and xylene, and a non-aromatic type such as hexane and decane, by being dispersed in water, or directly as powder or tablets.

The using amount is $1\times10^{-8}$–1 mol/Ag mol, preferably $1\times10^{-6}$–$1\times10^{-1}$ mol/Ag mol and most preferably $1\times10^{-4}$–$1\times10^{-1}$ mol/Ag mol. The desirable improvement effect of image lasting quality is barely achieved when the amount is less than this range, while the image may result in low contrast or the coated film may become weak, which are not preferable, when the amount is over this range.

In this invention, phthalazine compounds are preferably incorporated. Phthalazine compounds means phthalazine and compounds prepared by introducing various substituents in a phthalazine ring. In this invention, preferable phthalazine compounds are compounds in which the following substituents are introduced in a phthalazine ring.

Substituents: a halogen atom, a cyano group, a hydroxyl group; and alkyl groups, alkenyl groups, alkynyl groups, alkoxy groups, aromatic groups and heterocyclic groups, each of which may be provided with a substituent. Each carbon number of these alkyl groups, alkenyl group, alkynyl groups and alkoxy groups is preferably 1–60 and specifically preferably 1–40. Preferable effect for anti-fogging, tone and storage stability cannot be obtained when the carbon number exceeds 60. The above substituents can be introduced at 1–8-position except 2- and 3-position of a phthalazine ring.

Specific examples of phthalazine compounds utilized in this invention will be described below, however, this invention is not limited thereto.

f1: phthalazine f2: 6-aminophthalazine f3: 5-methylphthalazine f4: 6-chlorophthalazine
f5: 6-i-propylphthalazine
f6: 6-(4,6-di-t-amylphenyl)phthalazine
f7: 6-phenylphthalazine
f8: 6-mthoxyphthalazine
f9: 1,4-dimethylphthalazine
f10: 5,6-dimethoxyphthalazine
f11: 6-i-butylphthalazine The phthalazine compounds may be added by being dissolved in an organic solvent of alcohols such as methanol and ethanol, ketones such as methyl ethyl ketone and acetone, an aromatic type such as toluene and xylene, and a non-aromatic type such as hexane and decane, or by being dispersed in water, or may be added directly as powder or tablets. The using amount is $1\times10^{-8}$–1 mol/Ag mol, preferably $1\times10^{-6}$–$1\times10^{-1}$ mol/Ag mol and most preferably $1\times10^{-4}$–$1\times10^{-1}$ mol/Ag mol. The improvement effect of image lasting quality is barely achieved when the amount is less than this range, while the image may result in low contrast or the coated film may become weak, which are not preferable, when the amount is over this range.

Next, light-sensitive silver halide grains, spectral sensitizing dyes, organic silver salts, reducing agents, binders, cross-linking agents and other raw materials will be explained successively.

Light-sensitive silver halide grains contained in a light-sensitive layer of a thermally developable light-sensitive material can be prepared in advance by commonly known methods in the field of photographic techniques such as a single-jet or double-jet method, and can be incorporated in a composition utilized in this invention, for example, after having been prepared in advance by either of an ammonia emulsion methode, an neutralizing method or an acid method. In this case, to provide sufficient contact of light-sensitive silver halide grains with organic silver salts, employed can be each means such as a means to utilize a polymer other than gelatin such as polyvinyl acetal described in U.S. Pat. Nos. 3,706,564, 3,706,565, 3,713,833, 3,748,143 and British Patent No. 1,362,970, a means to enzymatic decompose the gelatin of a light-sensitive silver halide emulsion as described in British Patent No. 1,354,186, or a means to omit the use of a protective polymer by preparing a light-sensitive silver halide emulsion in the presence of a surfactant as described in U.S. Pat. No. 4,076,539.

A light-sensitive silver halide grains preferably have a small particle size to depress milky-whitening after image formation and to obtain excellent image quality. The mean particle diameter is not more than 0.1 μm, preferably 0.01–0.1 μm and most preferably 0.02–0.08 μm. The shape of a silver halide grain is not specifically limited, and utilized can be grains of so-called normal crystals such as cubic or octahedral and abnormal crystals such as spherical, rod-like or tabular grains. Further, a halogen composition can be any of silver chloride, silver chloro-bromide, silver iodo-bromide chloride, silver bromide, silver bromo-iodide and silver iodide.

The amount of light-sensitive silver halide grains is preferably not more than 50 weight %, more preferably in a range of 25–0.1 weight % and most preferably in a range of 15–0.1 weight %, in the total weight of silver halide and organic silver salts. As light-sensitive silver halide grains, a part of organic silver salts may be converted into silver halide by using the component of the silver halide composition, and the various conditions such as a reaction temperature, a reaction time duration and a reaction pressure of this process can be appropriately set to minimize the energy consumption, and generally the reaction temperature is −23–74° C., the reaction time is 0.1 seconds to 72 hours, and the reaction pressure is preferably set to an atmospheric pressure.

Light-sensitive silver halide emulsions prepared by the various methods described above can be chemically sensitized, for example, by a sulfur-containing compound, a gold compound, a platinum compound, a palladium compound, a silver compound, a tin compound, a chromium compound or combinations thereof. The methods and procedures are described, for example, in U.S. Pat. No. 4,036,650, British Patent No. 1,518,850, JP-A Nos. 51-22430, 51-78319 and 51-81124.

Further, an amide compound having a low molecular weight may be incorporated to achieve the sensitivity increase when a part of organic silver salts is converted into light-sensitive silver halide by the silver halide comprising components, as described in U.S. Pat. No. 3,980,482.

Further, metals belonging to the 6–10th group of the periodic table, for example, ions of metals such as Rh, Ru, Re, Ir, Os and Fe, complex compounds or complex ions thereof can be incorporated in these light-sensitive silver halide grains, to improve the reciprocity law failure of illumination intensity or to control the contrast. Specifically preferable is to incorporate ions or complex ions of metals belonging to the 6–10th group of the periodic table. Preferable as the above metals are W, Fe, Co, Ni, Cu, Ru, Rh, Pd, Re, Os, Ir, Pt and Au, more preferable are metals selected from Rh, Re, Ru, Ir and Os, in the case of a thermally developable light-sensitive material of this invention.

These metals can be introduced in silver halide as a complex form. In this invention, transition metal complexes are preferably 6-dentate complexes represented by following General Formula (12).

$$[ML_6]^m \qquad \text{General Formula (12)}$$

In General Formula (12), M represents a transition metal selected from elements of 6–10th group of the periodic table, L represents a cross-linking ligand and m represents 0, 1-, 2- or 3-. Specific examples of the ligand represented by L include each ligand of halogen compounds (fluorides, chlorides, bromides and iodides), cyanide compounds, cyanate, thiocyanate, selenocyanate, tellurocyanate, azide and aquo; nitrosyl and thionitrosyl; and preferably aquo, nitrosyl and thionitrosyl. In the case of an aquo ligand being present, it preferably occupies one or two of the ligands. Plural L's may be of the same or different. Specifically preferable examples of M are iridium (Ir), rhodium (Rh), ruthenium (Ru), rhenium (Re) and osmium (Os).

Specific examples of sodium salts of transition metal coordinated complexes will be described below. They are comprised of three sodium atoms in the case of being trivalent and two sodium atoms in the case of being bivalent, although sodium atoms are not indicated.

1: $(RhCl_6)^{3-}$
2: $(RuCl_6)^{3-}$
3: $(ReCl_6)^{3-}$
4: $(RuBr_6)^{3-}$
5: $(OsCl_6)^{3-}$
6: $(CrCl_6)^{3-}$
7: $(Ru(NO)Cl_5)^{2-}$
8: $(RuBr_4(H_2O)^{2-}$
9: $(Ru(NO)(H_2O)Cl_4)^{-}$
10: $(RhCl_5(H_2O))^{2-}$
11: $(Re(NO)Cl_5)^{2-}$
12: $(Re(NO)CN_5)^{2-}$
13: $(Re(NO)CLCN_4)^{2-}$

14: $(Rh(NO)_2Cl_4)^-$
15: $(Rh(NO)(H_2O)Cl_4)^-$
16: $(Ru(NO)CN_5)^{2-}$
17: $(Fe(CN)_6)^{3-}$
18: $(Rh(NS)Cl_5)^{2-}$
19: $(Os(NO)Cl_5)^{2-}$
20: $(Cr(NO)Cl_5)^{2-}$
21: $(Re\ (NO)Cl_5)^-$
22: $(Os(NS)\ Cl_4(TeCN)^{2-}$
23: $(Ru(NS)Cl_5)^{2-}$
24: $(Re(NS)Cl_4(SeCN))^{2-}$
25: $(Os(NS)Cl(SCN)_4)^{2-}$
26: $(Ir(NO)Cl_5)^{2-}$
27: $(IrCl_6)^{3-}$
28: $(IrCl_6)^{2-}$

These metal ions or complex ions may be utilized alone or in combination of two or more same or different types of metals. Further, potassium salts, lithium salts and cesium salts may be arbitrary selected other than sodium salts. The content of these metal ions or complex ions is generally $1\times10^{-9}$–$1\times10^{-2}$ and preferably $1\times10^{-8}$–$1\times10^{-4}$ mol per mol of silver halide. Compounds, which provide these metal ions or complex ions, are preferably incorporated into silver halide grains by being added during the silver halide grain formation, and may be added during any preparation stage of the silver halide grains, that is, before or after nucleation, growth, physical ripening, or before and after chemical sensitization. However, they are preferably added at the stage of nucleation, growth or physical ripening, more preferably at the stage of nucleation or growth and most preferably at the stage of nucleation. The addition may be carried out several times so as to result in uniform content in the interior of a silver halide grain, or distribution formation in the interior of the grain, as described in such as JP-A 63-29603, 2-306236, 3-167545, 4-76534, 6-110146 and 5-273683. These metal compounds can be added by being dissolved in water or suitable organic solvents (for example, alcohols, ethers, glycols, ketones, esters or amides). There are methods in which, for example, an aqueous metal compound powder solution or an aqueous solution in which the metal compound is dissolved along with NaCl and KCl is added to a water-soluble silver salt solution or a water-soluble halide solution during the precipitation of silver halide grains; metal compounds are added as the third solution at the time of double-jet precipitation of a silver salt solution and a halide solution followed by preparation of silver halide grains by means of triple-jet precipitation; a necessary amount of a solution of a metal compound is charged into the reaction vessel during grain precipitation; or other silver halide grains, in which metal ions or complex ions have been doped in advance, are added and dissolved at the time of silver halide preparation. Specifically, a preferred method is one in which an aqueous metal compound powder solution or an aqueous solution in which a metal compound is dissolved along with NaCl and KCl is added into a water-soluble halide solution. When the metal compound is added on the surface of silver halide grains, a necessary amount of an aqueous solution of the metal compound may also be charged into a vessel, immediately after the precipitation of the silver halide grains, during or at the end of physical ripening, or during chemical ripening.

Light-sensitive silver halide grains can be appropriately sensitized by a spectral sensitizing dye, and utilized as spectral sensitizing dyes can be sensitizing dyes described, for example, in JP-A Nos. 63-159841, 60-140335, 63-231437, 63-259651, 63-304242 and 63-15245, U.S. Pat. Nos. 4,639,414, 4,740,455, 4,741,966, 4,751,175 and 4,835,096.

Spectral sensitizing dyes useful for this invention are described, for example, in RD 17643, p.23, item IV-A (1978, December) and RD 1831, p.437, item X (1978, August), or in the literatures referred therein. Sensitizing dyes having a spectral sensitivity suitable to various scanner light sources may be advantageously selected. Preferably utilized are the compounds described, for example, in JP-A Nos. 9-34078, 9-54409 and 9-80679.

Organic silver salts contained in a thermally developable light-sensitive material are reducible silver sources, and the organic silver salts as silver ion supplying sources for silver image formation are preferably silver salts of organic acids and hetero organic acids and more preferably among them are silver salts of long chain (having a carbon number of 10–30 and preferably of 15–25) aliphatic carboxylic acids and silver salts of nitrogen-containig heterocyclic compounds. Also preferable are organic or inorganic complexes, ligands of which have a total stability constant against silver ion of 4.0–10.0, as described in Research Disclosure (RD) 17029 and 29963. Examples of these suitable silver salts include the following:

Silver salts of organic acids, for example, silver salts of such as gallic acid, oxalic acid, behenic acid, stearic acid, arachidic acid, palmitic acid and lauric acid. Carboxyalkylthiourea salts of silver, for example, silver salts of such as 1-(3-carboxypropyl)thiourea and 1-(3-carboxypropyl)-3,3-dimethylthiourea. Silver salts or complexes of polymer reaction products of aldehydes and hydroxy-substituted acids, for example, silver salts or complexes of reaction products of aldehydes (such as formaldeyde, acetoaldehyde and butyl aldehyde) and hydroxy-substituted acids (such as salicylic acid, benzoic acid and 3,5-dihydroxy benzoic acid). Silver salts or complexes of thions, for example, silver salts or complexes of such as 3-(2-carboxyethyl)-4-hydroxymethyl-4-thiazoline-2-thion and 3-carboxymethyl-4-thiazoline-2-thion. Complexes or salts of a nitrogen acid selected from imidazole, pyrazole, urazole, 1,2,4-thiazole, 1H-tetrazole, 3-amino-5-benzylthio-1,2,4-triazole and benzbtriazole, with silver. Silver salts of such as saccharin and 5-chlorosaricylaldoxim, and silver salts of mercaptides.

Among these, specifically preferable silver salts include those of long chain aliphatic carboxylic acids, such as silver behenate, silver arachidinate and silver stearate.

In this invention, it has been proved that excellent effects of the objective of this invention are exhibited by not less than 47 weight % of the organic silver salts being comprised of silver behenate.

Organic silver salts can be obtained by mixing a water-soluble silver compound and a compound which forms a complex with silver, and preferably utilized are a normal precipitation method, a reverse precipitation method, a double-jet method and a controlled double-jet method such as described in JP-A No. 9-127643. For example, after preparing an organic acid alkali metal salt soap (such as sodium behenate and sodium arachdinate) by adding an alkali metal salt (such as sodium hydroxide and potassium hydroxide) to an organic acid, crystals of an organic silver salt are prepared by mixing said soap and such as silver nitrate by means of a controlled double-jet method. At that time, silver halide grains may coexist.

In this invention, it has been proved that excellent effects are exhibited with respect to the objective of this invention by preparing the organic silver salt after forming a potassium salt of organic acid using potassium hydroxide.

A compound, which functions as a crystal growth inhibitor or a dispersant for silver aliphatic carboxylate grains, preferably coexists in a manufacturing process of said silver carboxylate grains. Specifically, it includes monohydric alcohols having a carbon number of not more than 10, preferably secondary alcohols, tertiary alcohols, glycols such as ethyleneglycol and propyleneglycol, polyethers such as polyethylene glycol, and glycerin. The addition amount is preferably 10–200 weight % based on the silver carboxylate.

On the other hand, also preferable are branched aliphatic carboxylic acids such as isoheptanic acid, isodecanoic acid, isotridecanoic acid, isomyristic acid, isopalmitic acid, isostearic acid, isoarachdic acid, isobehenic acid and isohexacosanoic acid, including each isomer. The addition amount is preferably 0.5–10 mol % of the silver aliphatic carboxylate.

Alcohols having a carbon number of not more than 10, preferably secondary alcohols and tertiary alcohols, make the grains to be monodispersed and have a smaller particle diameter by increasing the solubility of sodium aliphatic carboxylates in the precipitation process to decrease the viscosity resulting in increased stirring efficiency. Branched aliphatic carboxylic acids and aliphatic unsatulated carboxylic acids exhibit steric hindrance higher than that of straight chain aliphatic carboxylic acids as the primary component at the time of crystallization of the silver aliphatic carboxylates, which gives larger distortion of the crystal lattice not to form large crystals resulting in formation of smaller grains.

The above organic silver salts can be utilized in various shapes, however, preferable are tabular organic silver salt grains, specifically of tabular grains having an aspect ratio of not less than 3. Tabular grains having an aspect ratio of not less than 3 means grains in which a so-called aspect ratio (being abbreviated as AR) represented by the following equation is not less than 3.

$$AR = \text{particle diameter } (\mu m)/\text{thickness } (\mu m)$$

The aspect ratio of tabular organic silver salt grains is preferably 3–20 and more preferably 3–10.

Methods to prepare the organic silver salt grains having the above shape are not specifically limited, however, it is effective to maintain a favorable mixing state at the time of formation of organic acid alkali metal soaps and/or addition of silver nitrate to said soaps, and to optimize the ratio of silver nitrate to be reacted with the soaps.

Tabular organic silver grains are preferably dispersed and ground by a media homogenizer or a high-pressure homogenizer after having been pre-dispersed appropriately together with such as a binder and a surfactant. For the pre-dispersion, utilized can be a general stirrer of an anchor type or a propeller type, a high-speed rotational centrifugal ejection type stirrer (Dissolva) and a high-speed rotational shear type stirrer (Homomixer).

Further, as the above media homogenizer, utilized can be rotational mills such as a ball mill, a planetary ball mill, and a vibration ball mill, media stirring mills such as a bead mill, an attritor and other basket mills; and as high-pressure homogenizers, utilized can be various types such as one in which the solution is collided against walls or plugs, one in which the solution is divided into plural portions and collided to each other at high speed, and one in which the solution is passed through a narrow orifice.

The binder, at the time of the above dispersion, is preferably added at a concentration of 0.1–10.0% based on the weight of the organic silver salts, and the solution temperature is preferably lower than 45° C. throughout the pre-dispersion to main-dispersion. Further, as operating conditions of the main-dispersion, for example, preferable conditions include 29.42–98.06 MPa and an operation of two or more times when a high-pressure homogenizer is employed as a dispersing means. Further, preferable conditions include a circumferential speed of 6–13 m/sec when a media homogenizer is employed as a dispersing means.

Further, a preferred embodiment of photo-thermal photographic materials of this invention comprised of a coated light-sensitive emulsion containing organic silver salts and light-sensitive silver halide, wherein the ratio of organic silver salt grains having a projection area of less than 0.025 $\mu m^2$ occupies not less than 70% of the total organic silver salt grains and the ratio of organic silver salt grains having a projection area of not less than 0.2 $\mu m^2$ is not more than 10% of the total organic silver salt grains, when the cross section of said material perpendicular to the support surface is observed through an electron microscope.

Organic silver salt grains (or are called as particles) are preferably monodispersed grains, and the preferable monodispersibility is 1–30%. By utilizing monodispersed grains of this range, images having high density are obtained. The monodispersibility referred herein is defined by the following equation.

$$\text{Monodispersibility} = (\text{standard deviation of grain diameter}/\text{mean grain diameter}) \times 100$$

The mean grain diameter (equivalent circular diameter) of the aforesaid organic silver salt is preferably 0.01–0.2 μm and more preferably 0.02–0.15 μm. Herein, a mean grain diameter (equivalent circular diameter) means a diameter of a circle having an area same as individual grain images observed through an electron microscope.

To prevent haze of photothermal photographic materials, the total amount of silver halides and organic silver salts is preferably 0.5–2.2 $g/m^2$ based on the converted silver amount. Preferable images can be obtained for medical applications by setting the silver amount in this range.

Reducing agents incorporated in thermally developable light-sensitive materials are those reduce organic silver salts to form silver images. Examples of reducing agents, are described, for example, in U.S. Pat. Nos. 3,770,448, 3,773,512 and 3,593,863, Research Disclosure (hereinafter, being abbreviated as RD) 17029 and 29963, JP-A Nos. 11-119372 and 2002-62616, however, reducing agents preferably utilized in this invention include the compounds represented by following General Formula (13).

General Formula (13)

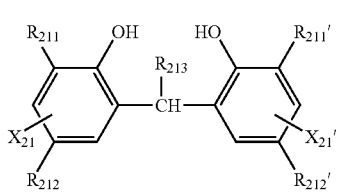

wherein, $R_{211}$, $R_{211'}$, $R_{212}$ and $R_{212'}$ each represent a substituent. $R_{213}$ represents a hydrogen atom or a substituent, $X_{21}$ and $X_{21'}$ represent a hydrogen atom or a substituent.

In more detail, substituents represented by $R_{211}$, $R_{211'}$, $R_{212}$ and $R_{212'}$ include the substituents listed as $R_{13}$ and $R_{13'}$ of aforesaid General Formula (5). $R_{211}$, $R_{211'}$, $R_{212}$ and $R_{212'}$ are preferably an alkyl group, an alkenyl group or an alkynyl group. $R_{212}$ represents a hydrogen atom or substituents, and the substituents include the substituents listed in the explanation of $R_{13}$ and $R_{13'}$ of aforesaid General Formula (5). $R_{213}$ is preferably a hydrogen atom, an alkyl group, an alkenyl group or an alkynyl group.

$X_{21}$ and $X_{21'}$ represent a hydrogen atom or substituents, and the substituents include the substituents listed in the explanation of $R_{13}$ and $R_{13'}$ of aforesaid General Formula (5).

Specific examples of these compounds are listed below.

13-1

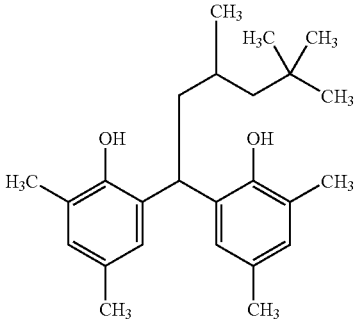

13-2

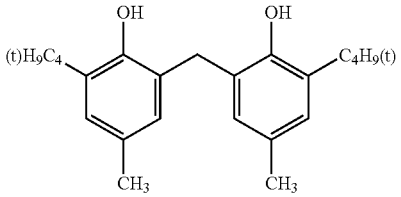

13-3

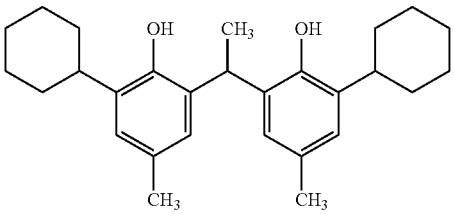

13-4

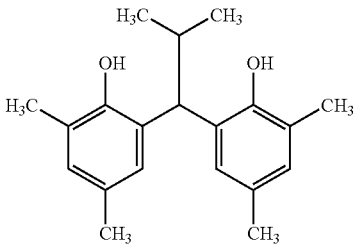

-continued 13-5

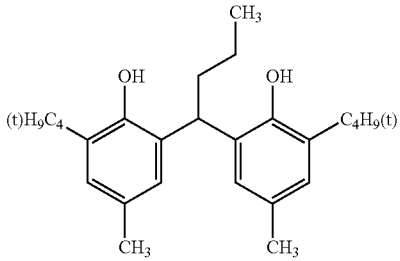

13-6

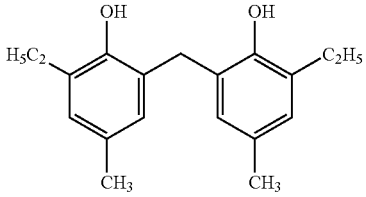

13-7

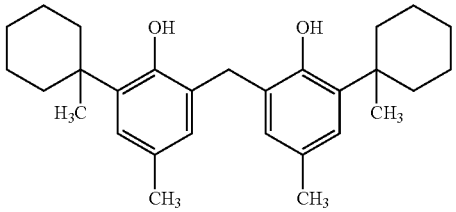

13-8

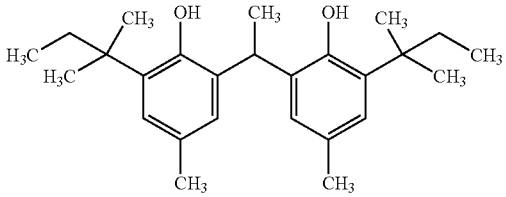

13-9

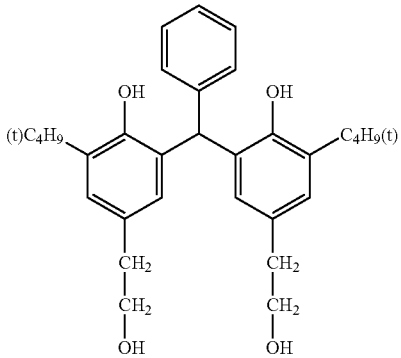

13-10

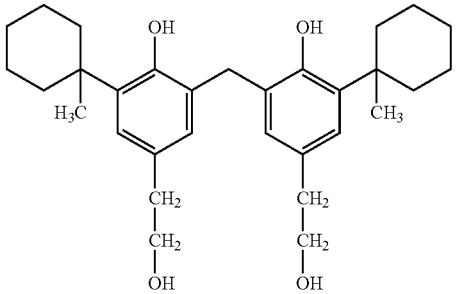

-continued
13-11
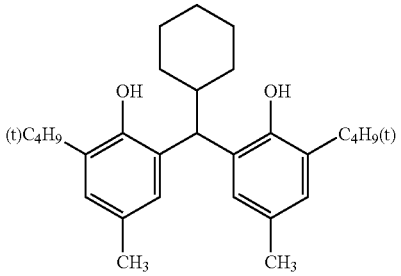
13-12
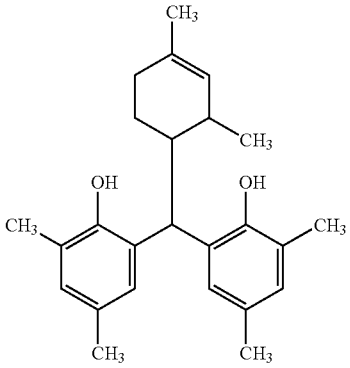
13-13
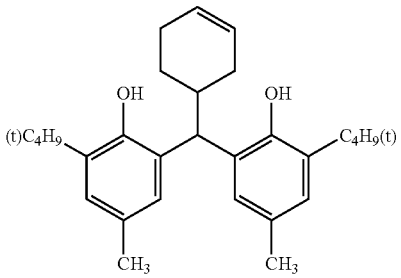
13-14
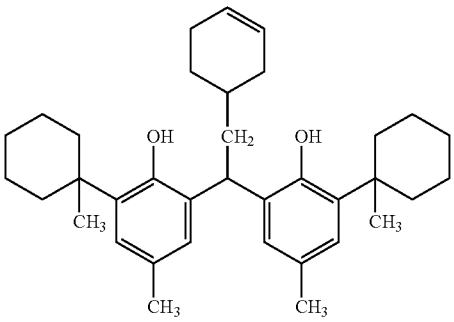
13-15
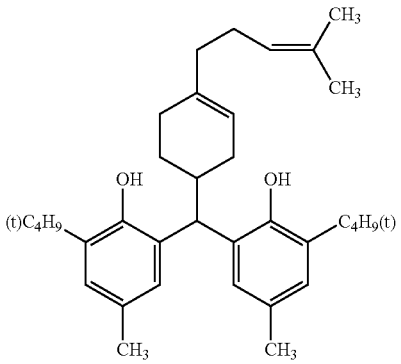
-continued
13-16
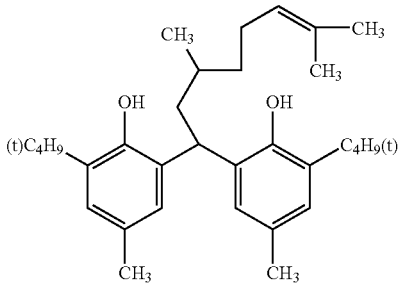
13-17
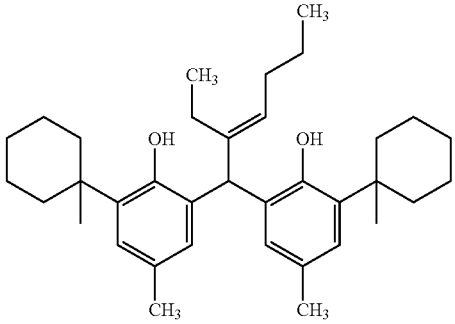
13-18
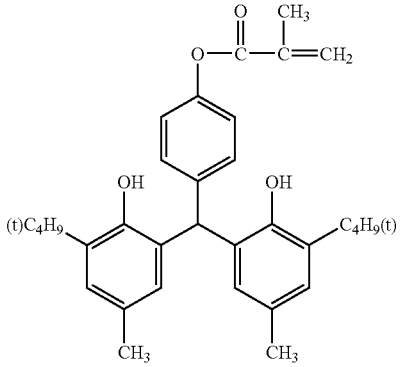
13-19
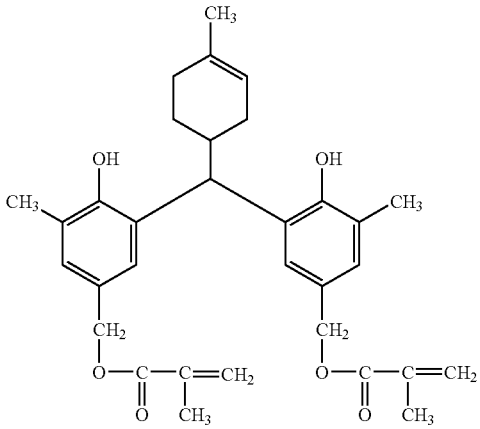

-continued 13-20

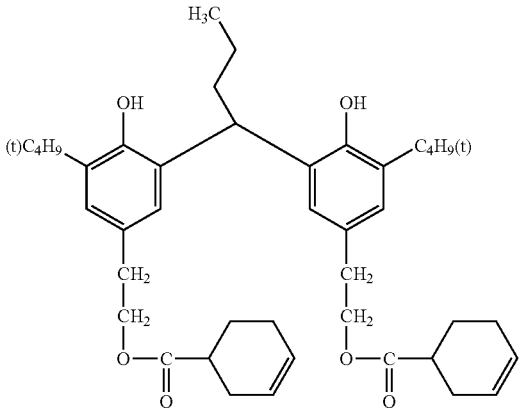

13-21

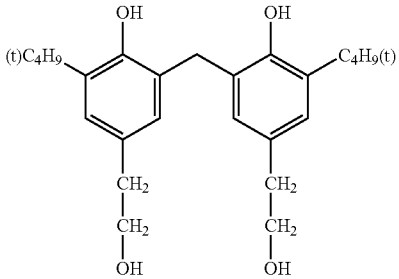

13-22

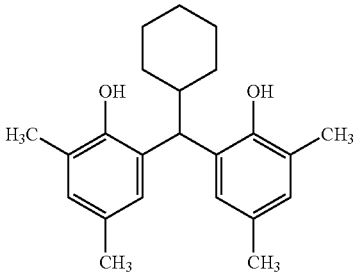

13-23

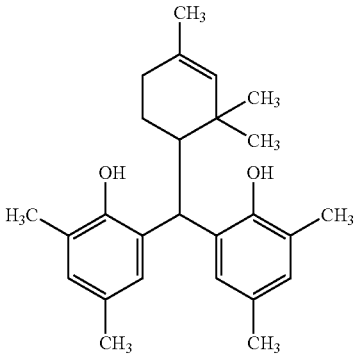

Reducing agents can be incorporated in a light-sensitive layer coating or the adjacent layers, by being dispersed in water or dissolved in an organic solvent to be contained in these coating solutions. Organic solvents can be arbitrary selected from alcohols such as methanol and ethanol, ketones such as acetone and methyl ethyl ketone, and aromatic series such as toluene and xylene.

The using amount of the reducing agent is appropriately in a range of $1\times10^{-2}$–10 mol and preferably $1\times10^{-2}$–1.5 mol, per mol of silver.

As polymer binders of a light-sensitive layer, adjacent layers thereof and other light-insensitive layers of thermally developable light-sensitive materials, generally utilized are colorless transparent or translucent polymer binders. The polymer binders include such as polyvinyl butyral, polyacrylamide, polystyrene, polyvinyl acetate derivatives, polyurethane, polyacrylic acid derivatives, polymethacrylic acid derivatives, styrene-butadiene copolymer, acrylonitrile-butadiene copolymer, vinyl chloride-vinyl acetate copolymer and styrene-butadiene-acryl copolymer.

Binders utilized in this invention are preferably those having a low equilibrium water content ratio of the coated layer after being dried, and include, for example, cellulose acetate, cellulose acetate butyrate and polyacetal of an organic solvent type. Among these, polyacetal means a polymer, which is obtained by preparing polyvinyl alcohol by saponification of polyvinyl acetate and said polyvinyl alcohol being reacted with an aldehyde compound, and preferably polybutyral being acetalized with butyl aldehyde and polyacetal being acetalized with acetoaldehyde (polyacetal in a narrow sense). Polyacetal preferable in this invention has a saponification degree of polyvinyl acetate of 60–99.9%, and the acetalization degree is theoretically possible between 1–100%, however, practically preferably 20–95%. When the acetalization degree is low, the hydroxyl group becomes many resulting in weak characteristics against moisture with respect to photographic capability, while the acetalization degree is high, reaction temperature and time duration becomes sever resulting in deteriorated cost performance and productivity.

As binders of this invention, preferably utilized are polyvinyl acetate derivatives, polyacrylic acid derivatives, polymethacrylic acid derivatives and copolymers of styrene and butadiene.

Polyvinyl acetate derivatives mean polymers (including copolymers) provided with a monomer unit of vinyl acetate or a derivative thereof, polyacrylic acid derivatives mean polymers (including copolymers) provided with a monomer unit of acrylic acid or acrylic acid ester, and polymethacrylic acid derivatives means polymers (including copolymers) provided with a monomer unit of methacrylic acid or methacrylic acid ester.

In this invention, at least each 70 weight % of the total binders contained in each of a light-sensitive layer and the adjacent layers is preferably a polyvinyl acetate derivative, a polyacrylic acid derivative, a polymethacrylic acid derivative or a copolymer of styrene and butadiene.

Copolymer components of polyvinyl acetate derivatives or poly(meth)acrylic acid derivatives are preferably straight chain, branched or cyclic alkyl esters of acrylic acid and methacrylic acid, which may be provided with substituents, and the copolymerization ratio is preferably 0–50 mol % in the case of polyvinyl acetate derivatives and 80–99.9 mol % in the case of poly(meth)acrylic acid derivatives. The average polymerization degree is preferably 100–3000 and specifically preferably 200–2000, based on a number average polymerization degree.

Water-based coating binders include styrene-butadiene copolymer, copolymers of styrene and acrylic acid alkyl esters or methacrylic acid alkyl esters and acrylic acid alkyl esters-methacrylic acid alkyl esters copolymers. These copolymers are preferably dispersed in a water-based dispersion medium as micro-particles having an mean particle diameter in a range of 1 nm to a few μm. Water-based dispersion type polymers, which are widely utilized as a binder for water-based coating, are specifically preferably hydrophobic with respect to improving water resistance. The polymerization degree can be appropriately selected in a range of approximately 10–10,000, however, is preferably 100–6,000 with respect to coating properties and productivity at the time of synthesis.

A thermally developable light-sensitive materials of this invention is characterized in that the polymer binder at least in one of a light-sensitive layer and the adjacent layers is coated by incorporating at least one type of compounds, which are provided with an isocyanato group, an alkoxysilane group, a vinyl sulfone group or a carbodiimide group.

H8: m-i-propenyl-α,α-dimethylbenzylisocyanato
H9: phenylaminopropyl trimethoxysilane
H10: p-methylphenylpropyl trimethoxysilane
H11: dimethylaminopropyl trimethoxysilane
H12: diethoxyaminopropyl trimethoxysilane
H13: 1,2-bis(vinylsulfonylacetoamide)ethane
H14: 1,2-bis(vinylsulfoneamide)ethane
H15: 1,3-bis(vinylsulfoneamide)-2-hydroxypropane
H16: 1,3-bis(vinylsulfonyl)-2-propanol

H17

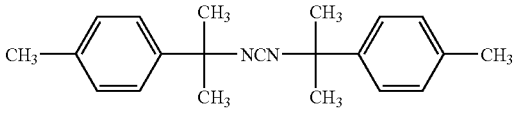

H18

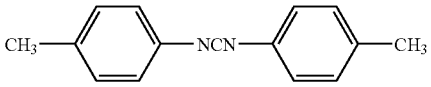

H19

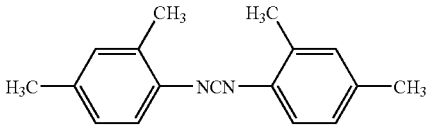

H20

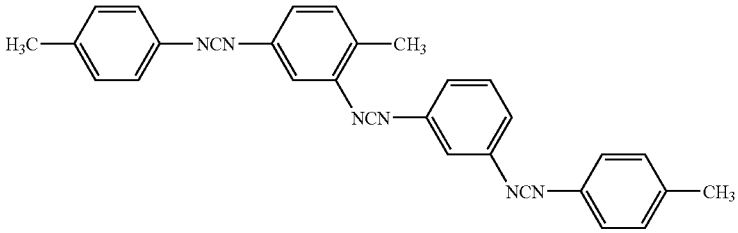

H21

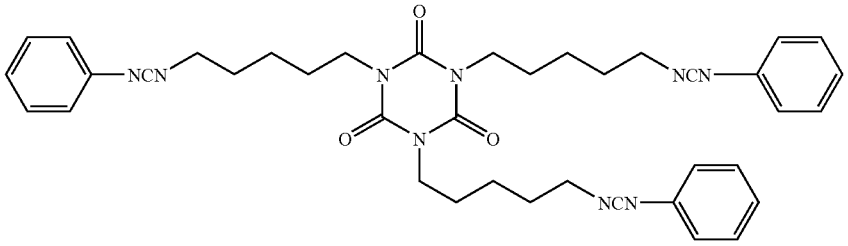

The binder can maintain adhesion with an upper layer or an under layer and provide abrasion resistant film strength, even when being utilized alone, however, further enhance the film adhesion and film strength by utilizing a cross-linking agent provided with each functional group described above.

Preferable cross-linking agents are those provided with an alkoxysilane group, an isocyanato group, an epoxy group, a vinyl sulfone group or a carbodiimide group. Specifically preferable cross-linking agents include those provided with at least two isocyanato groups, carbodiimide cross-linking agents provided with at least two carbodiimide groups, alkoxysilane cross-linking agents provided with at least two alkoxy groups and viny sulfone cross-linking agents provided with at least two vinyl sulfone groups. Preferred examples of the cross-linking agents will be described below.

H1: hexamethylene diisocyanato
H2: trimer of hexamethylene diisocyanato
H3: tolylenediisocyanato
H4: phenylenedidisocyanato
H5: xylenediisocyanato
H6: 1,3-bis(isocyanatomethyl)cyclohexanone
H7: tetramethylene xylenediisocyanato Vinylsulfonyl compounds represented by above H13–H16 are also preferably utilized for the purpose of antifogging as described in JP-A No. 6-208192.

In addition, carbodiimide compounds utilized in this invention are preferably polyfunctional carbodiimide compounds represented by General Formula (CI).

$$R_{221}\text{-}J_1\text{-}N{=}C{=}N\text{-}J_2\text{-}(L_1)_n\text{-}(J_3\text{-}N{=}C{=}N\text{-}J_4\text{-}R_{222})_V \qquad \text{General Formula (CI)}$$

wherein, $R_{221}$ and $R_{222}$ each represent an aryl group or an alkyl group, $J_1$ and $J_4$ each represent a bivalent connecting group, $J_2$ and $J_3$ each represent an aryl group or an alkyl group, $L_1$ represents a (v+1)-valent alkyl group, alkenyl group, aryl group, heterocyclic group or a group in which these groups bond by a connecting group, v represent an integer of at least 1, and n represents 0 or 1.

The details of aforesaid each substituent are described in Japanese Patent Application No. 2002-1345, section Nos. [0188]–[0190]. Specific examples of carbodiimide compounds utilized in this invention will be described below, however, this invention is not limited thereto.

C1-1
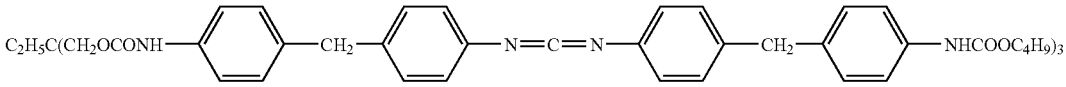
C1-2
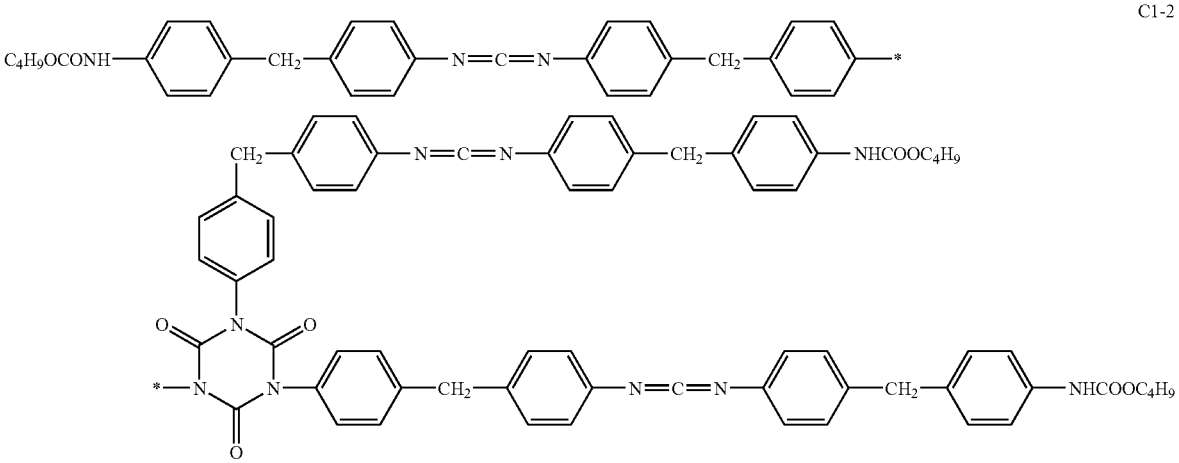
C1-3
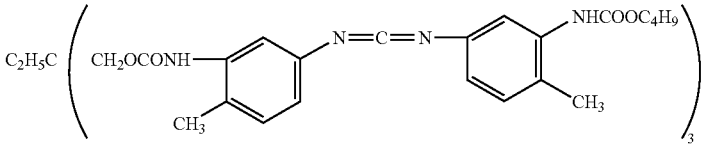
C1-4
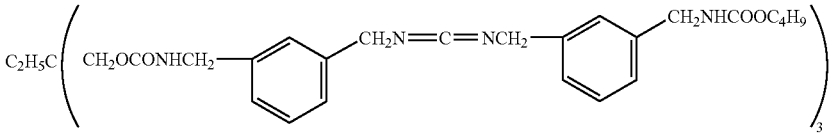
C1-5
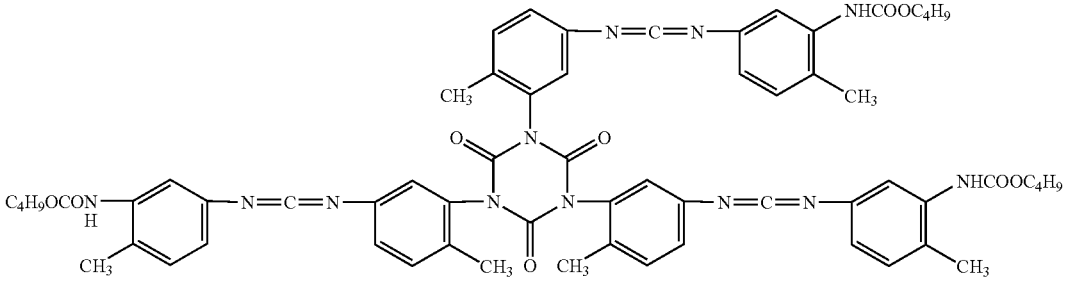
C1-6
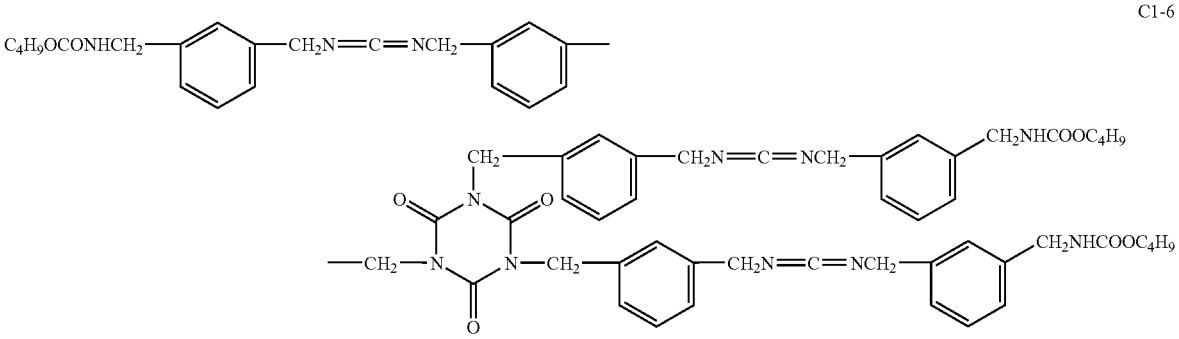
C1-7
$C_2H_5C[CH_2OCONH(CH_2)_6N{=}C{=}N(CH_2)_6NHCOOC_4H_9]_3$ -continued
C1-8
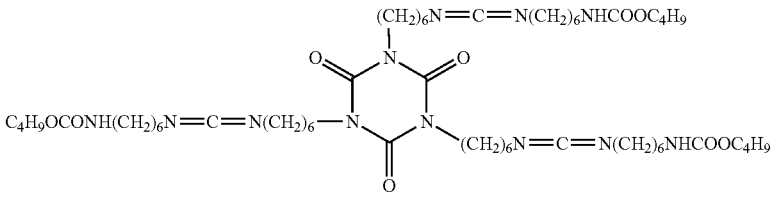
C1-9
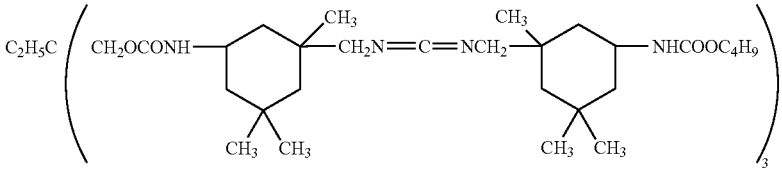
C1-10
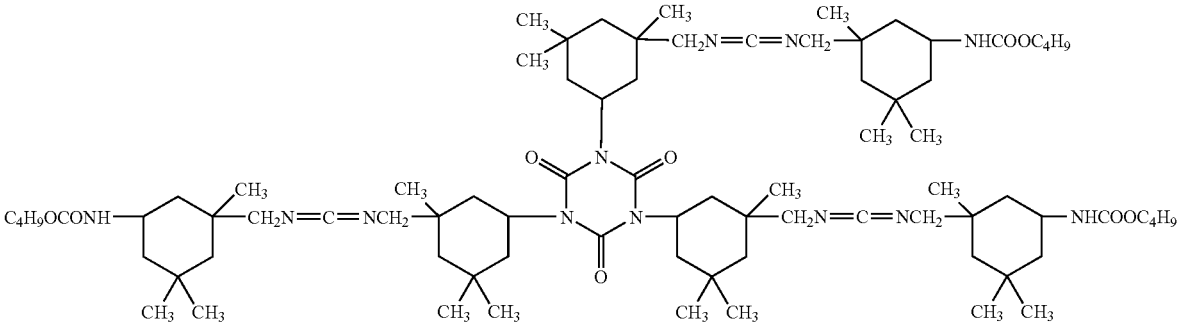
C1-11
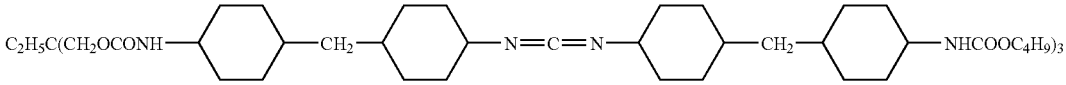
C1-12
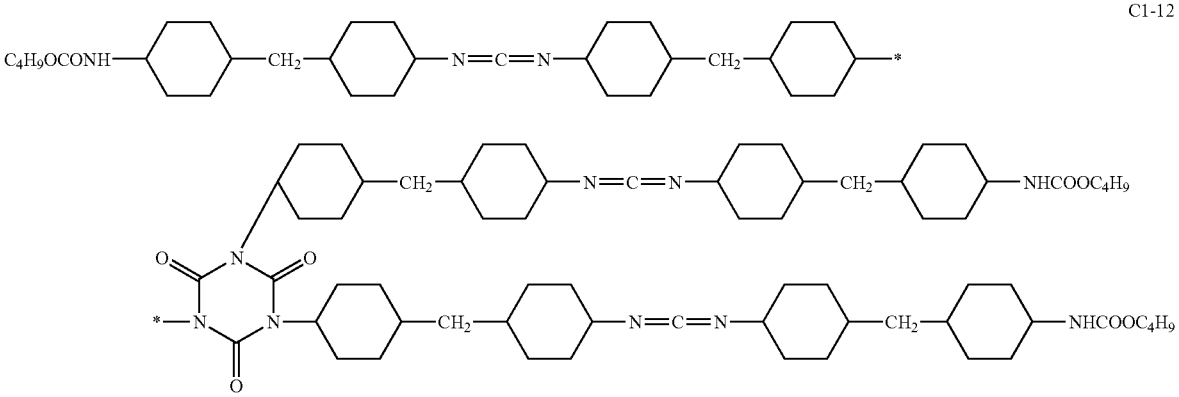
C1-13
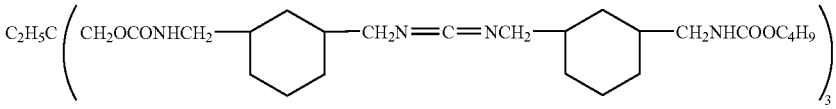
C1-14
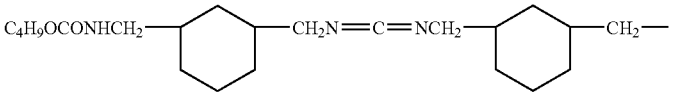

-continued

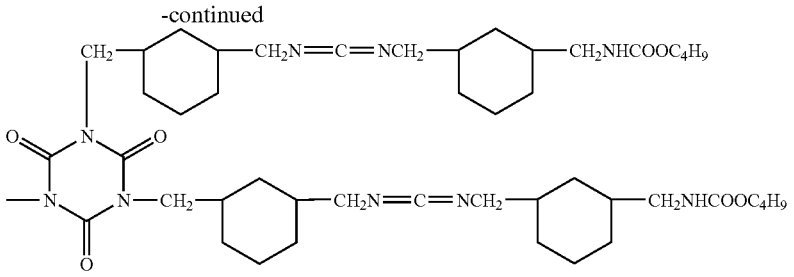

C1-15

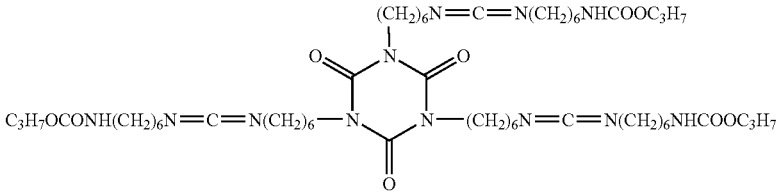

C1-16

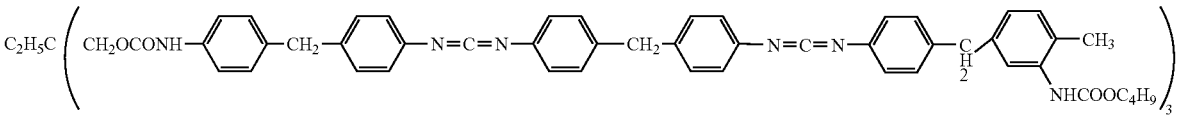

C1-17

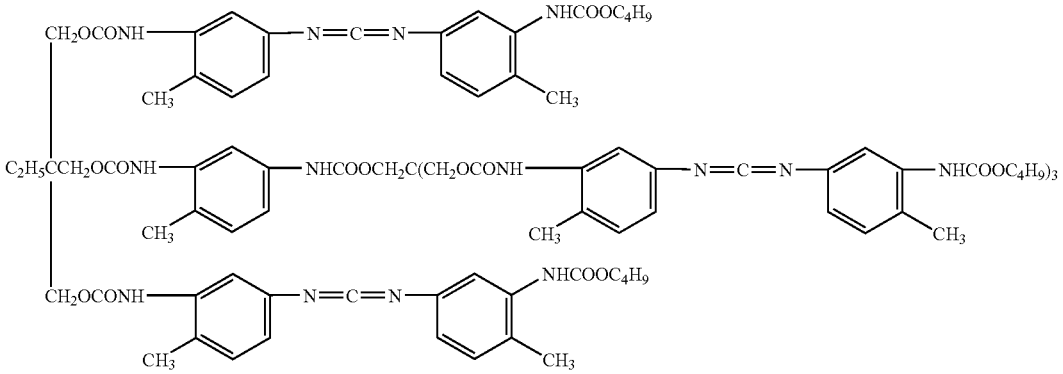

C1-18

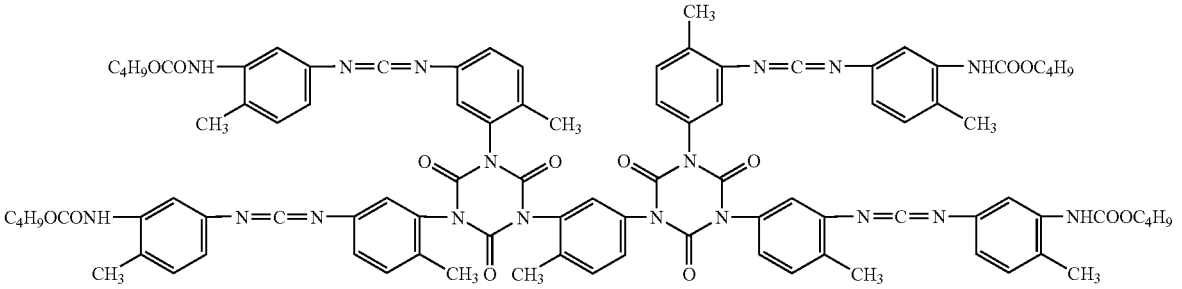

Cross-linking agents described above may be added into a coating solution by being dissolved in water, alcohols, ketones or non-polar organic solvents, or as solids as they are. The addition amount is preferably an amount equivalent to the groups to be cross-linked, however, may be either increased up to 10 times or decreased down to one tenth. Cross-linking does not proceed when it is too little, while it is not preferred that photographic characteristics may be deteriorated when it is too much.

Thermally developable light-sensitive materials may comprise an embodiment provided with a light-sensitive layer on one side of the support or on the both sides of the support. In the case of a light-sensitive layer being provided on one side of the support, included is an embodiment having a BC layer (back side layer) and appropriately also such as a protective layer thereof, on the opposite side of the light-sensitive layer. The adjacent layers of a light-sensitive layer are, for example, an anti-halation layer (AH layer) under the light-sensitive layer and a protective layer over the light-sensitive layer.

Thermally developable light-sensitive materials may be appropriately provided with an AH layer for prevention of halation and/or a BC layer for prevention of the halation, of said light-sensitive material, and dyes utilized in said AH layer and BC layer are those absorb an image exposure light, and preferably thermally discoloring dyes described in U.S. Pat. No. 5,384,237. The using amount is limited into the range not to affect image hindrance to a thermally developable light sensitive material in the case of dyes being not thermally discoloring, however, a necessary and sufficient amount can be incorporated in the case of dyes being thermally discoloring.

Thermally developable materials may be provided with a protective layer. A protective layer preferably contains a matting agent. Either of organic and inorganic matting agents can be utilized, and, as inorganic matting agents, can be utilized those comprising such as silica described in Swiss Patent No. 330,158, polystyrene or polymethacrylate described in Swiss Patent No. 330,158, polyacrylonitrile described in U.S. Pat. No. 3,079,257 and polycarbonate described in U.S. Pat. No. 3,022,169.

The shape of the matting agent may be any of regular and irregular, however, preferably regular and more preferably spherical. The size of a matting agent is represented by a diameter of an equivalent volume sphere of the matting agent. When the particle diameter of a matting agent is represented by a diameter of an equivalent volume sphere, the matting agent of this invention preferably has a mean particle diameter of 0.5–10 μm and more preferably 1.0–8.0 μm. Further, the coefficient of variation of a particle diameter distribution is preferably not more than 50%, more preferably not more than 40% and specifically preferably not more than 20%. The addition method of the matting agent may be one in which it is coated by having been dispersed in a coating solution in advance, or one in which the matting agent is sprayed before the finish of the drying after a coating solution having been coated.

As a support of a thermally developable light-sensitive material, utilized can be supports such as paper, synthetic paper, non-woven paper, metal foil and plastic film, and arbitrary utilized can be complex sheets comprising combinations thereof.

As exposure methods of a thermally developable light-sensitive material, those commonly known may be employed. As exposure methods, for example, exposure can be carried out by a laser according to each method described in-JP-A Nos. 9-304869 and 2000-10230.

As developing apparatuses for a thermally developable light-sensitive material, those commonly known may be employed. For example, utilized can be apparatuses described in JP-A Nos. 2001-242608, 2000-292902 and 2000-292893, and Japanese Patent Application No. 2003-119579.

EXAMPLES

In the following, examples of this invention will be explained, however, the embodiments of this invention are not limited thereto. Herein, "%" in the examples represents "weight %", when it is not otherwise mentioned.

Example 1

[Preparation of Support with Under-Coating]

After corona discharge treatment at 12 W/m$^2$·min was performed on the both surface of a polyethylene terephthalate (PET) support having a thickness of 175 μm, following under-coating layer coating solution a-1 was coated on the one surface and dried so as to make a dry layer thickness of 0.6 μm to provide under-coating layer A-1, further following under-coating layer coating solution was coated on the opposite surface and dried to make a dry layer thickness of 0.6 μm to provide under-coating layer B-1.

(Under-Coating Layer Coating Solution a-1)

The solution is prepared by diluting a copolymer latex solution (solid content of 30%) comprising butylacrylate/t-butylacrylate/styrene/2-hydroxyethylacrylate (30/20/25/25%), by 15 times.

(Under-Coating Layer Coating Solution b-1)

The solution is prepared by diluting a copolymer latex solution (solid content of 30%) comprising butylacrylate/styrene/glycidyl acrylate (40/20/40%), by 15 times.

Successively, after corona discharge treatment at 12 W/m2 min was performed on the surfaces of undercoating layer A-1 and under-coating layer B-1, following under-coating upper layer coating solution a-2 was coated on under-coating layer A-1 and dried to provide under-coating upper layer A-2, and following under-coating upper layer solution b-2 was coated on under-coating layer B-1 and dried to provide under-coating upper layer B-2 having an antistatic function. Every figure of each material represents a coating amount per m$^2$.

(Under-Coating Upper Layer Coating Solution a-2)

| | |
|---|---|
| Styrene/butadiene (½ weight ratio) copolymer | 0.4 g |
| Silica particles (mean particle diameter of 3 μm) | 0.05 g |
| (Under-Coating Upper Layer Coating Solution b-2) | |
| Styrene/butadiene (½ weight ratio) copolymer | 0.4 g |
| Tin oxide micro-particles (mean particle diameter of 16 nm) | 0.023 g |

[Preparation of Light-Sensitive Layer Coating Solution]

<Preparation of Silver Halide Grain Emulsion A>

After 7.5 g of inert gelatin and 10 mg of potassium bromide were dissolved in 900 ml of water and the solution was adjusted to a temperature of 28° C. and a pH of 3.0, 370 ml of an aqueous solution containing 74 g of silver nitrate and 370 ml of an aqueous solution containing an equivalent mol to silver nitrate of potassium bromide and potassium iodide at a mol ratio of 98/2 were added by means of a controlled double jet-method in 10 minutes while keeping the pAg at 7.7. In synchronous with the addition of silver nitrate, added was $10^{-6}$ mol/Ag mol of a hexachloroiridium salt (compound of General Formula (12): example compound 28). Thereafter, 0.3 g of 4-hydroxy-6-methyl-1,3,3a,7-tetrazaindene (stabilizer) was added and the pH was adjusted to 5 by sodium hydroxide resulting in preparation of cubic silver bromo-iodide grains having a mean grain size of 0.036 μm, a coefficient of variation of a projected diameter area of 8% and a [100] surface ratio of 87%. A gelatin coagulant was applied to this emulsion to perform flocculation, and the emulsion was made up to 160 ml with water after desalting treatment.

(Preparation of Water Dispersed Organic Silver Salt)

Behenic acid of 11.4 g, 83.8 g of arachidic acid and 54.9 g of stearic acid were dissolved in 3980 ml of pure water at 80° C. Next, after 540.2 ml of sodium hydroxide solution of 1.5 mol/L were added and 6.9 ml of concentrated nitric acid were added while high speed stirring, the solution was cooled to 55° C. resulting in preparation of a sodium organic acid solution. Aforesaid silver halide grain emulsion A (containing 0.038 mol of silver) and 420 ml of pure water were added to this sodium organic acid solution followed by 5 minutes stirring while keeping the temperature at 55° C. Next, 760.6 ml of silver nitrate solution of 1 mol/L were added in 2 minutes, being stirred for further 20 minutes, and water-soluble salts were removed by filtration. Thereafter, the filtrate was subjected to washing and filtration repeatedly until the electric conductivity became 2 μS/cm, and finally dried after having been centrifugally dehydrated.

Organic silver salts were prepared, also in the same manner to the above preparation of water-dispersed organic silver salts except potassium hydroxide being used instead of sodium hydroxide. As described in Tables 2 and 5, a method utilizing sodium hydroxide is called a NaOH method and a method using potassium hydroxide is called a KOH method.

On the other hand, organic silver salts were similarly prepared by varying the charging amount ratio of behenic acid, arachidic acid and stearic acid so that each weight % of silver salts of behenic acid, arachidic acid and stearic acid was the value described in Table 1.

The following each layer was successively formed on under-coating upper layer A-2 of the support provided with the aforesaid under-coating layers resulting in a preparation of a thermally developable light-sensitive material. Herein, each drying was performed at 45° C. for 1 minute. Further, the every material amount in each coating composition represents a coated amount per $m^2$.

(AH Layer Coating Composition)

| | |
|---|---|
| PVB-1 (binder) | 0.8 g |
| C1 (dye) | $1.2 \times 10^{-5}$ mol |

(Light-Sensitive Layer Coating Composition)

To form a light-sensitive layer, a coating solution of the following composition was prepared, which was coated and dried so as to make the following coated amounts (per $m^2$). The aforesaid water-dispersed solution of organic silver salts of the amount equivalent to a silver amount of 1.36 g/$m^2$ was mixed with a polymer binder.

PVB-1 (binder) 5.0 g

A compound represented by General Formula (2), (3) or (4): described in Table 2 $3\times10^{-5}$ mol A leuco dye represented by General Formula (1)

| | |
|---|---|
| Cyan leuco dye | $2 \times 10^{-5}$ mol |
| Yellow leuco dye | $3 \times 10^{-5}$ mol |
| Magenta leuco dye | $1 \times 10^{-5}$ mol |

A compound represented by General Formula (11): 11–38 $2\times10^{-4}$ mol

| | |
|---|---|
| A1 (spectral sensitizing dye) | $1 \times 10^{-6}$ mol |
| A2 (spectral sensitizing dye) | $1 \times 10^{-6}$ mol |
| B-1 (anti-fogging agent) | 10 mg |
| Isothiazolone (anti-fogging agent) | 1.2 mg |
| Reducing agent (example compound 13–21) | 2 mmol |
| Reducing agent (example compound 13–22) | 2 mmol |
| Phthalazine | $2 \times 10^{-4}$ mol |
| 2-(p-toluenesulfonyloxy) benzoic acid | 0.3 g |
| Potassium p-toluenethiosulfonate | 0.03 g |
| 2-mercapto-5-methylbenzimidazole | 2 mg |
| D1 | 2 mg |

(Light-Sensitive Layer Protective Layer)

A coating solution of the following composition was coated and dried so as to make the following coating amount (per m2) on the light-sensitive layer resulting in formation of a light-sensitive layer protective layer.

| | |
|---|---|
| Cellulose acetate butyrate | 2.0 g |
| 4-methyl phthalate | 0.7 g |
| Tetrachloro phthalate | 0.2 g |
| Tetrachloro phthalate anhydride | 0.5 g |
| Silica matting agent (mean particle diameter of 5 μm) | 0.5 g |
| 1,3-bis (vinylsulfonyl)-2-propanol (H16, anti-fogging agent) | 50 mg |
| Benzotriazole | 30 mg |

Antistatic agent: the type and addition amount (mg) being described in Table 3

Herein, polyacetal as a binder and methyl ethyl ketone (MEK) as an organic solvent were utilized. As the polyacetal, after polyvinyl acetate having a polymerization degree of 500 was saponificated to 98%, 86% of the residual hydroxyl groups were butylated, and the resulting product is called as PVA-1.

<Coating of BC Layer Side>

On the back surface side, each coating solution for a BC layer and the protective layer thereof were successively coated and dried on under-coating upper layer B-2 so as to make the following coating amount (per $m^2$) resulting in formation of a BC layer and the protective layer.

(BC Layer Composition)

| | |
|---|---|
| PVB-1 (binder) | 1.8 g |
| C1 (dye) | $1.2 \times 10^{-5}$ mol |

(BC Layer Protective Layer Coating Solution)

| | |
|---|---|
| Cellulose acetate butyrate | 1.1 g |
| Matting agent (polymethylmethacrylate: mean particle diameter of 5 μm) | 0.12 g |

Antistatic agent: the types and addition amounts (mg) being described in Table 3

F-E0

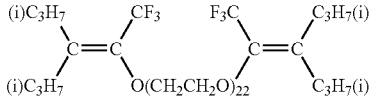

F-S $C_8F_{17}SO_3Li$

F-DS1(7-3)

$LiO_3S—(CF_2)_3—SO_3Li$

F-DS2(7-4)

$LiO_3S—(CF_2)_4—SO_3Li$

F-DS3(7-26)

$NaO_3S—(CF_2)_3—SO_3Na$

TABLE 1

| Type of organic silver salt | Organic silver salt ratio (weight %) Silver behenate | Silver arachidate | Silver stearate |
|---|---|---|---|
| SB-1 | 44 | 34 | 22 |
| SB-2 | 54 | 28 | 18 |
| SB-3 | 60 | 24 | 16 |
| SB-4 | 75 | 15 | 10 |
| SB-5 | 85 | 10 | 5 |

TABLE 2

| Thermally developable light-sensitive material No. | Leuco dye of general formula (1) Cyan leuco dye | Yellow leuco dye | Magenta leuco dye | Compound of general formula (2) | Compound of general formula (3) | Compound of general formula (4) | Type of organic silver salt | Preparation method of organic silver salts | Types of light-sensitive layer, BC layer and protective layer |
|---|---|---|---|---|---|---|---|---|---|
| 1 | CL-1 | — | — | — | — | — | SB-1 | NaOH method | A |
| 2 | CL-2 | — | — | 2-133 | — | — | SB-2 | NaOH method | A |
| 3 | CL-4 | — | — | 2-61 | — | — | SB-2 | NaOH method | B |
| 4 | CL-6 | — | — | 2-76 | — | — | SB-2 | NaOH method | B |
| 5 | CL-7 | — | — | 2-73 | — | — | SB-2 | KOH method | B |
| 6 | — | YL-1 | — | 2-133 | — | — | SB-2 | KOH method | B |
| 7 | — | YL-3 | — | — | 3-10 | — | SB-2 | KOH method | C |
| 8 | — | YL-13 | — | — | — | 4-2 | SB-3 | KOH method | C |
| 9 | CL-20 | YL-6 | — | 2-102 | — | 4-55 | SB-4 | KOH method | B |
| 10 | CL-27 | YL-17 | ML-2 | 2-101 | 3-11 | — | SB-5 | KOH method | B |
| 11 | CL-10 | YL-6 | ML-4 | 2-31 | — | 4-3 | SB-5 | KOH method | D |

TABLE 3

| Type of light-sensitive layer, BC-layer and protective layer | Antistatic agent | Light-sensitive layer protective layer | BC-layer protective layer |
|---|---|---|---|
| A | F-EO | 20 | 200 |
| | F-S | 8 | 80 |
| B | F-EO | 20 | 250 |
| | F-DS1 (7–3) | 3 | 30 |
| C | F-EO | 20 | 250 |
| | F-DS2 (7–4) | 3 | 30 |
| D | F-EO | 20 | 250 |
| | F-DS3 (7–26) | 3 | 30 |

In this example, cross-linking agent H2 was employed. The cross-linking agent was added in an AH layer, a light-sensitive layer, a protective layer and a BC layer. It was added at $2.8\times10^{-4}$ mol/m$^2$ in a light-sensitive layer, $0.8\times10^{-4}$ mol/m$^2$ in a protective Layer, $0.9\times10^{-4}$ mol/m$^2$ in a AH layer and $2.8\times10^{-6}$ mol/m$^2$ in a BC layer. Thus, thermally developable light-sensitive materials 1–11 were prepared.

[Evaluation of Photographic Capabilities]

Three pieces of the above thermally developable light-sensitive materials were prepared, one piece of the sample was exposed with a sensitometer for a semiconductor laser of 810 nm after having been kept under environment of 25° C. and 48% RH for 3 days, followed by being heated at 127° C. for 12.5 seconds to obtain an immediate sample (the treatment is referred to as immediate process). Sensitivity and fog as photographic capabilities of the immediate sample were measured by a densitometer. The sensitivity was evaluated as a reciprocal ratio of an exposure amount to give a density higher than the fog density by 0.3, and represented as a relative value when the sensitivity of thermally developable light-sensitive material 1 is 100.

Another piece of the sample was exposed with a laser exposure sensitometer in the same manner as the above sample, and after the developed sample was kept on a viewing box of 10,000 lux for 24 hours, the maximum density decrease (Δmax) was measured as one of indications of light fastness as well as the tone was observed simultaneously. Δmax was represented by the decreased value, by measuring the maximum densities of the immediate sample and the light fastness test sample by use of a densitometer. Further, the tone was evaluated in ten grades according to the following evaluation criteria.

10: Tone having no problem at all

7: Tone having no problem in practical use

5: Tone having slightly uncomfortable color, but no problem

3: Uncomfortable tone, which may be a problem

1: Tone clearly exhibiting a remarkable change, which is a problem in practical use Herein, other evaluation ranks in the tables indicate the intermediate characteristics of each rank. Ranks better than 5 were considered to have no problem.

The third piece of the sample was also exposed with a sensitometer for laser exposure in the same manner to the first sample, and was developed followed by fog measurement of said sample after having been kept in a dark room at 55° C. and 20% RH for 3 days (heat resistance as one of image lasting quality). As the indication of heat resistance which was one of image lasting quality, applied was the fog increase (Δfog) of the sample having been subjected to heat resistance test compared to the aforesaid immediate sample.

Herein, the laser exposure and development of the above sample were preformed in a room conditioned at 25±1° C. and 48±1% RH. The smaller are the fog increase and maximum density decrease as well as the smaller is the tone change, excellent is the image lasting quality. The results are shown in Table 4.

TABLE 4

| Thermally developable light-sensitive material | Immediate process | | Image lasting quality | | | |
|---|---|---|---|---|---|---|
| No. | Fog | Sensitivity | Δfog | Δmax | Tone | Remark |
| 1 | 0.12 | 100 | 0.18 | 0.35 | 4 | Comparison |
| 2 | 0.09 | 101 | 0.14 | 0.25 | 5 | Invention |
| 3 | 0.08 | 101 | 0.13 | 0.22 | 5.5 | Invention |
| 4 | 0.08 | 101 | 0.12 | 0.23 | 5.5 | Invention |
| 5 | 0.07 | 102 | 0.10 | 0.19 | 6 | Invention |
| 6 | 0.06 | 103 | 0.09 | 0.17 | 6 | Invention |
| 7 | 0.06 | 102 | 0.08 | 0.18 | 6 | Invention |

TABLE 4-continued

| Thermally developable light-sensitive material | Immediate process | | Image lasting quality | | | |
|---|---|---|---|---|---|---|
| No. | Fog | Sensitivity | Δfog | Δmax | Tone | Remark |
| 8 | 0.05 | 104 | 0.06 | 0.15 | 6 | Invention |
| 9 | 0.04 | 104 | 0.05 | 0.13 | 6 | Invention |
| 10 | 0.04 | 103 | 0.04 | 0.12 | 6.5 | Invention |
| 11 | 0.04 | 104 | 0.05 | 0.12 | 6.5 | Invention |

It has been proved from Table 4 that samples utilizing leuco dyes of this invention and at least one of compounds represented by General Formulas (2), (3) and (4) exhibit excellent photographic capabilities (sensitivity and fog) at the time of heat development and superior light fastness (prevention of maximum density decrease and tone change) as one of image lasting quality as well as heat resistance (prevention of fog increase) as another image lasting quality, incorporating a fluoride compound represented by General Formulas (7) or (8) and organic silver salts not less than 47 weight % of which is comprised of silver behenate.

Example 2

Thermally developable light-sensitive materials 21–31 were evaluated in the same manner to example 1, wherein a compound represented by General Formula (5) was added in the light-sensitive layer, as described in Table 5, so as to make $1\times10^{-5}$ mol/m$^2$. Further, hydrazine compounds represented by General Formulas (6) and (10) were added in the light-sensitive layer, as described in Table 5, so as to make $3\times10^{-5}$ mol/m$^2$.

TABLE 5

| Thermally developable light- | Leuco dye of general formula (1) | | | Compound of | Compound of | Compound of | Compound of | Compound of | Compound of | Type of | Types of light-sensitive layer, BC | Preparation method of |
|---|---|---|---|---|---|---|---|---|---|---|---|---|
| sensitive material No. | Cyan leuco dye | Yellow leuco dye | Magenta leuco dye | general formula (2) | general formula (3) | general formula (4) | general formula (5) | general formula (6) | general formula (10) | organic silver salt | layer and protective layer | organic silver salts |
| 21 | CL-9 | — | — | 2-3 | — | — | 5-1 | — | — | SB-1 | A | NaOH method |
| 22 | CL-5 | — | — | — | 3-4 | — | 5-1 | — | | SB-2 | A | NaOH method |
| 23 | CL-24 | — | — | — | — | 4-1 | — | 6-15 | — | SB-2 | B | NaOH method |
| 24 | — | YL-18 | — | 2-133 | — | — | 5-1 | 6-35 | — | SB-2 | B | NaOH method |
| 25 | — | YL-16 | — | — | 3-5 | — | 5-1 | 6-36 | — | SB-2 | B | KOH method |
| 26 | — | YL-9 | — | — | — | 4-10 | — | — | 10-9 | SB-2 | B | KOH method |
| 27 | CL-32 | YL-11 | ML-9 | 2-124 | 3-16 | — | 5-1 | — | 10-10 | SB-3 | C | KOH method |
| 28 | CL-36 | YL-9 | ML-7 | 2-133 | — | 4-21 | — | 6-37 | 10-11 | SB-3 | C | KOH method |
| 29 | CL-8 | YL-4 | ML-3 | 2-125 | 3-1 | — | 5-1 | 6-38 | 10-14 | SB-4 | B | KOH method |
| 30 | CL-3 | YL-2 | ML-1 | 2-133 | 3-9 | — | 5-1 | 6-39 | 10-19 | SB-4 | B | KOH method |
| 31 | CL-16 | YL-7 | ML-6 | 2-137 | — | 4-6 | 5-1 | 6-49 | 10-15 | SB-5 | D | KOH method |

Photographic capabilities and image lasting quality were evaluated in the same manner as example 1. Herein, the relative sensitivity was represented by a relative value when the sensitivity at immediate process of thermally developable light-sensitive material 21 was 100. The results are shown in Table 6.

TABLE 6

| Thermally developable light-sensitive material | Immediate process | | Image lasting quality | | | |
|---|---|---|---|---|---|---|
| No. | Fog | Sensitivity | Δfog | Δmax | Tone | Remark |
| 21 | 0.10 | 100 | 0.12 | 0.20 | 5.5 | Invention |
| 22 | 0.08 | 101 | 0.10 | 0.18 | 6 | Invention |
| 23 | 0.07 | 103 | 0.07 | 0.16 | 7 | Invention |
| 24 | 0.06 | 105 | 0.07 | 0.16 | 7.5 | Invention |

TABLE 6-continued

| Thermally developable light-sensitive material | Immediate process | | Image lasting quality | | | |
|---|---|---|---|---|---|---|
| No. | Fog | Sensitivity | Δfog | Δmax | Tone | Remark |
| 25 | 0.05 | 107 | 0.06 | 0.14 | 8 | Invention |
| 26 | 0.07 | 107 | 0.09 | 0.17 | 7.5 | Invention |
| 27 | 0.05 | 108 | 0.06 | 0.14 | 8.5 | Invention |
| 28 | 0.06 | 109 | 0.07 | 0.15 | 8.5 | Invention |
| 29 | 0.07 | 107 | 0.06 | 0.13 | 9.5 | Invention |
| 30 | 0.07 | 106 | 0.07 | 0.14 | 9.5 | Invention |
| 31 | 0.06 | 107 | 0.07 | 0.13 | 9.5 | Invention |

It has been proved from table 6 that samples utilizing leuco dyes represented by general formula (1) of this invention and at least one of compounds represented by General Formulas (2), (3) and (4) exhibit excellent photographic capabilities (sensitivity and fog) of the immediate process and superior light fastness (prevention of maximum denisyt decrease and tone change) as one of image lasting quality as well as heat resistance (prevention of fog increase) as another image lasting quality, by incorporating a fluoride compound represented by General formulas (7) or (8) and organic silver salts not less than 47 weight % of which is comprised of silver behenate.

The present invention can provide a thermally developable light-sensitive material exhibiting high sensitivity, low fog as well as excellent image lasting quality after heat development.

What is claimed is:

1. A photothermographic material comprising a support having at least on one side of the support:

photosensitive silver halide particles;

an organic silver salt, provided that the organic silver salt is selected from silver salts of an aliphatic carboxylic acid having a carbon number of 10–30;

a reducing agent for silver ions;

a leuco dye represented by General Formula (1);

a stabilizing compound represented by General Formula (2), (3) or (4); and a polyhalomethane compound represented by General Formula (11):

General Formula (1)

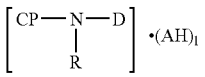

wherein CP represents a coupler group; —N(R)D represents a developer group, R represents a hydrogen atom or a blocking group and D represents a hydrogen atom or a substituerit; AH represents an acid; and 1 represents an integer of 0 to 5, General Formula (2)

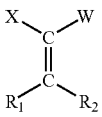

wherein, X represents an electron withdrawing group; W represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N—carbonylimino group, a N-sulfonylimino group, an ainmonium group, a sulfonium group, a phosphonium group, a pyrylium group or an immonium group; $R_1$ represents a hydroxyl group or a salt thereof; and $R_2$ represents an alkyl group, an alkenyl group, an alkynyl group, an aryl group or a heterocyclic group, provided that X and W may form a ring structure by bonding to each other, and X and $R_1$ may be a cis-form or a trans-form, General Formula (3)

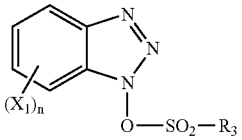

wherein $X_1$ represents a substituent; $R_3$ represents an alkyl group, an alkenyl group, an alkynyl group, an aryl group or a heterocyclic group; and n represents an integer of 0 to 4, General Formula (4)

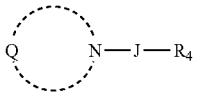

wherein Q represents an atomic group to form a nitrogen-containing heterocyclic ring; J represents —$SO_2$—, —CO—, —COO— or —CON($R_5$)—, $R_5$ represents a hydrogen atom or a substituent; $R_4$ represents an alkyl group, an alkenyl group, an alkynyl group, an aryl group or a heterocyclic group, General Formula (11)

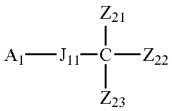

wherein $A_1$ represents an alkyl group, an alkenyl group, an alkynyl group, an aryl group or a heterocyclic group, $Z_{21}$, $Z_{22}$ and $Z_{23}$ each represent a hydrogen atom, a halogen atom, an acyl group, an alkoxycarbonyl group, an aryloxycarbonyl group, a sulfonyl group or an aryl group, and at least one of them is a halogen atom, $J_{11}$ is a group containing —C(═O)—, —SO— or —$SO_2$—, wherein —C(═O)—, —SO— or —$SO_2$— directly bonds to the C of —C($Z_{21}$) ($Z_{22}$) ($Z_{23}$).

2. The photothermographic material of claim 1, wherein the stabilizing compound is represented by General Formula (2).

3. The photothermographic material of claim 1, wherein the stabilizing compound is represented by General Formula (3).

4. The photothermographic material of claim 1, wherein the stabilizing compound is represented by General Formula (4).

5. The photothermographic material of claim 1, further contains a compound represented by General Formula (5) on the same side of the support:

General Formula (5)

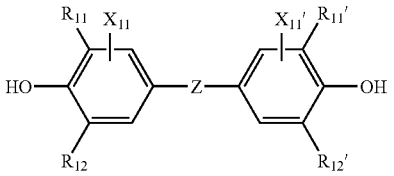

wherein Z represents a —S— group or a —C($R_{13}$)($R_{13'}$)— group, $R_{13}$ and $R_{13'}$ each represent a hydrogen atom or a substituent; $R_{11}$, $R_{12}$, $R_{11'}$ and $R_{12'}$ each represent a substituent; $X_{11}$ and $X_{11'}$ each represent a hydrogen atom or a substituent.

6. The photothermographic material of claim 1, further contains a compound represented by General Formula (6) on the same side of the support:

General Formula (6)

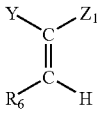

wherein Y represents an electron withdrawing group; $Z_1$ represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxy sulfinyl group, a —S-sulfinyl group, a sulfinamoyl group, a phosphoryl group, a nitro group, an imino group, a N-carbonylimino group, a N-sulfonylimino group, an ammonium group, a sulfonium group, a phosphonium group, a pyrilium group or an immonium group; and $R_6$ represents a halogen atom, an oxy group, a thio group, an amino group or a heterocyclic group; provided that Y and $Z_1$ may form a ring structure by bonding to each other, and Y and $R_6$ may be a cis-form or a trans-form.

7. The photothermographic material of claim 1, further contains a hydrazine compound on the same side of the support.

8. The photothermographic material of claim 1, further contains a compound represented by General Formulas (7) or (8) at least on one side of the support:

$MO_3S—(CF_2)_m—SO_3M$ General Formula (7)

wherein M represents H, Li, Na, K or an ammonium group; and m represents an integer of 1 to 4 when M represents Li, m represents an integer of 1 to 6 or 8 when M represents H, m represents an integer of 3 or 4 when M represents Na, m represents an integer of 1 to 6 when M represents K, and m, represents an integer of 1 to 8 when M represents an ammonium group, $L[O_3S—(CF_2)_n—SO_3]$ General Formula (8)

wherein L represents Ba, Ca or Mg; n represents an integer of 1 to 5 when L represents Ba and n represents an integer of 1 to 8 when L represents Ca or Mg.

9. The photothermographic material of claim 1, wherein at least 47 weight % of the organic silver salt is silver behenate.

10. The photothermographic material of claim 1, wherein the organic silver salt is prepared by using a potassium salt of the aliphatic carboxylic acid obtained from:

potassium hydroxide; and the aliphatic carboxylic acid.

11. The photothermographic material of claim 5, further contains a compound represented by General Formulas (7) or (8) at least on one side of the support:

$MO_3S—(CF_2)_m—SO_3M$ General Formula (7)

wherein N represents H, Li, Na, K or an ammonium group; and m represents an integer of 1 to 4 when M represents Li, m represents an integer of 1 to 6 or 8 when M represents H, m represents an integer of 4 when M represents Na, m represents an integer of 1 to 6 when M represents K, and in represents an integer of 1 to 8 when M represents an ammonium group, $L[O_3S—(CF_2)_n—SO_3]$ General Formula (8)

wherein L represents Ba, Ca or Mg; n represents an integer of 1 to 5 when L represents Ba and n represents an integer of 1 to 8 when L represents Ca or Mg.

12. The photothermographic material of claim 5, wherein at least 47 weight % of the organic silver salt is silver behenate.

13. The photothermographic material of claim 5, wherein the organic silver salt is prepared by using a potassium salt of the aliphatic carboxylic acid obtained from:

potassium hydroxide; and the aliphatic carboxylic acid.

14. The photothermographic material of claim 11, wherein at least 47 weight % of the organic silver salt is silver behenate.

15. The photothermographic material of claim 11, wherein the organic silver salt is prepared by using a potassium salt of the aliphatic carboxylic acid obtained from:

potassium hydroxide; and the aliphatic carboxylic acid.

16. The photothermographic material of claim 14, wherein the organic silver salt is prepared by using a potassium salt of the aliphatic carboxylic acid obtained from:

potassium hydroxide; and the aliphatic carboxylic acid.

17. The photothermographic material of claim 1, wherein the organic silver salt is silver behenate.

* * * * *